US011685572B2

(12) United States Patent
Savenok

(10) Patent No.: US 11,685,572 B2
(45) Date of Patent: Jun. 27, 2023

(54) RE-CLOSEABLE CAP FOR A CAN

(71) Applicant: Pavel Savenok, Wheaton, IL (US)

(72) Inventor: Pavel Savenok, Wheaton, IL (US)

(73) Assignee: Resolute Patents, LLC, Wheaton, IL (US)

( * ) Notice: Subject to any disclaimer, the term of this patent is extended or adjusted under 35 U.S.C. 154(b) by 0 days.

(21) Appl. No.: 17/615,407

(22) PCT Filed: Apr. 30, 2020

(86) PCT No.: PCT/US2020/030882
§ 371 (c)(1),
(2) Date: Nov. 30, 2021

(87) PCT Pub. No.: WO2020/242713
PCT Pub. Date: Dec. 3, 2020

(65) Prior Publication Data

US 2022/0227527 A1 Jul. 21, 2022

Related U.S. Application Data

(63) Continuation-in-part of application No. 16/791,062, filed on Feb. 14, 2020, now Pat. No. 11,279,531, and (Continued)

(51) Int. Cl.

| | |
|---|---|
| ***B65D 17/28*** | (2006.01) |
| ***B65D 51/00*** | (2006.01) |
| ***B65D 51/24*** | (2006.01) |

(52) U.S. Cl.
CPC ..... *B65D 17/4014* (2018.01); *B65D 51/007* (2013.01); *B65D 51/243* (2013.01); (Continued)

(58) Field of Classification Search
CPC ..... B65D 17/4014; B65D 51/007; B65D 51/243; B65D 2517/0014; B65D 2517/0022; B65D 2517/0041
(Continued)

(56) References Cited

U.S. PATENT DOCUMENTS

| | | | |
|---|---|---|---|
| 3,942,679 | A | 3/1976 | Starr |
| 4,938,379 | A | 7/1990 | Kellner |

(Continued)

*Primary Examiner* — J. Gregory Pickett
*Assistant Examiner* — Niki M Eloshway
(74) *Attorney, Agent, or Firm* — Christopher J. Scott

(57) ABSTRACT

A re-closeable cap is outfitted upon an upper portion of a beverage can or a series of beverage cans in a multi-pack arrangement for providing a protective barrier atop opened beverage cans. The re-closeable caps include a unibody material construction particularly configured to comprise a cap rim and a cap plate centrally located relative to the cap rim. The cap rim attaches the re-closeable cap to a can rim. The cap plate includes a static portion and at least one dynamic portion all formed from the unibody material construction with complex upper surface landscape and cut lines. The dynamic portions are pivotal relative to the static structure for providing a can-opening access aperture for enabling a user to consume can contents and closing the can-opening access aperture for enabling the user to cover the can opening during contents consumption.

34 Claims, 40 Drawing Sheets

Related U.S. Application Data a continuation-in-part of application No. 17/327,610, filed on May 21, 2021, now Pat. No. 11,608,210.

(52) U.S. Cl.
CPC ..... *B65D 2517/0014* (2013.01); *B65D 2517/0022* (2013.01); *B65D 2517/0041* (2013.01)

(58) Field of Classification Search
USPC ..... 220/258.2
See application file for complete search history.

(56) References Cited

U.S. PATENT DOCUMENTS

| | | | | |
|---|---|---|---|---|
| 5,054,640 | A | 10/1991 | Tucker | |
| 2003/0222083 | A1 | 12/2003 | Pladsbjerg | |
| 2007/0068943 | A1* | 3/2007 | Ramsey | B65D 17/506 220/269 |
| 2007/0164027 | A1* | 7/2007 | Auer | B65D 47/0847 220/784 |
| 2008/0078763 | A1* | 4/2008 | Auer | B65D 47/0847 220/254.3 |
| 2008/0110887 | A1 | 5/2008 | Ramsey | |
| 2012/0273490 | A1* | 11/2012 | Jensen | A47G 19/2205 220/253 |
| 2020/0130902 | A1* | 4/2020 | Sanguinet | B65D 41/46 |
| 2020/0262621 | A1* | 8/2020 | Savenok | B65D 43/0212 |
| 2020/0270033 | A1* | 8/2020 | Sanguinet | B65D 17/4012 |

* cited by examiner

RE-CLOSEABLE CAP FOR A CAN

PRIOR HISTORY

This application is a national stage entry or 371 application from International Patent Application No. PCT/US2020/030882 filed in the United States Patent and Trademark Office (USPTO) as International Receiving Office on 30 Apr. 2020.

BACKGROUND OF THE INVENTION

Field of the Invention

The present invention relates generally to cap formation for outfitting a beverage can. More particularly, the present invention relates to a re-closeable cap as variously exemplified for attachment to an upper can portion of a beverage can for covering a beverage-letting aperture formed in the upper can portion and/or for controlling beverage flow through the beverage-letting aperture.

Brief Description of the Prior Art

The present invention was born from the recognition of a need in the prior art for a re-closeable cap that is easily outfittable upon a beverage can or easily pre-packaged atop beverage cans for consumer use. To address this need in the art, the author considered ways to develop a re-closeable cap that would be easy for a consumer to understand and to provide a cap that would require a subconsciously similar motor task memory type of function on par with that of opening a can with a can opener, for example. The author determined the importance for market adoption of a re-closeable cap may well stem from a flip-flop functioning mechanism to mimic the current teeter-totter type mechanism for opening cans of this type.

The prior art thus perceives a need for a low cost, unibody, re-closeable can cap for outfitting an upper portion of a beverage can and enabling a user to selectively cover the upper can portion for preventing contaminants from freely entering the otherwise open beverage can and further for controlling beverage flow from an open beverage can.

Further, the prior art perceives a need for a re-closeable cap for outfitting a beverage can with a view toward improving or adding hygienic protections to beverage cans coming from manufacturers and packaging companies throughout the distribution channels terminating at the user consumption point. The present invention attempts to address this perceived need by providing certain low cost, unibody, re-closeable caps for outfitting beverage cans and providing removable barriers thereupon as the outfitted cans move through distribution channels as summarized in more detail hereinafter.

SUMMARY OF THE INVENTION

Among the many objectives of this invention is the provision of a re-closeable cap as variously exemplified for outfitting a beverage can and enabling a manufacturer or packaging company or retailer to outfit beverage cans prior to consumer purchase for protecting the upper can portion and providing the user with readily available means to cover an otherwise open beverage can, and may preferably remain affixed to the cans through the time of disposal.

Notably, however, the re-closable caps according to the present invention may also be removed by end user or consumer before consumption of the can contents. In this instance, the re-closeable caps primarily provide a hygienic barrier of protection during transit to the consumer from the packaging company. The user thus has the option of maintaining the re-closeable caps upon the beverage cans or may remove the caps as elected.

In this regard, it is noted that aluminum beverage cans are some the best or most often recycled materials. Providing a beverage can cap that travels with the can from packaging to the consumer and into the recycling process means that relatively more caps will enter the recycling process if piggybacked upon beverage cans that have become standard in the industry.

Secondarily, the present invention provides a cap for selectively covering an upper can portion of the beverage can and/or to control beverage flow from a beverage can as outfitted with the various beverage can caps. The upper can portion of the beverage can usable in combination with the beverage can cap(s) according to the present invention is believed to essentially comprise an upper can rim and a can capping plate.

The re-closeable caps according to the present invention may be said to essentially and preferably outfit a beverage can, preferably at the time of manufacture or beverage can packaging and travel with the beverage can through to the recycling or disposal process. Secondarily, the caps may be outfitted upon the beverage cans by the consumer. In either case, the re-closeable caps preferably and essentially comprise a unibody material construction particularly configured to comprise a cap rim and a cap plate centrally located relative to the cap rim. The cap rim attaches the re-closeable cap to a can rim.

The cap plate is believed to be central to the practice of the present invention and preferably comprises a static structure and at least a first dynamic structure all formed from the unibody material construction with complex upper surface landscape and cut lines to achieve the functionality more particularly described hereinbelow. Now summarizing, the first dynamic structure is pivotally matable with the static structure for (a) selectively providing a can-opening access aperture for enabling a user to consume can contents by way of a can opening formed in the can capping plate, and (b) selectively closing the can-opening access aperture for enabling the user to cover the can opening.

The re-closeable caps are all preferably formed with a select material construction in a unibody form having an inherent material resiliency. Noting that standardized beverage cans are typically constructed from a relatively rigid material, it will be noted that the can material construction may thus operate to actuate select portions of the re-closeable cap by way of its inherent material resiliency when outfitted upon the upper can portion for enhancing functionality of the re-closeable cap as outfitted upon the upper can portion.

In this regard, the first dynamic structure may preferably comprise an eccentric switch mechanism configured for maintaining the first dynamic structure in at least the first and second states of pivotal extension. In this regard, the static structure may be resiliently actuated via outside force input and cooperative action of the switch mechanism to position the first dynamic structure in at least the first and second states of pivotal extension and the inherent resilience maintains the first dynamic structure in at least the first and second states of pivotal extension when outside forces are absent.

Further, it will be seen that select portions of the first dynamic structure may resiliently overlap with select portions of the static structure when outfitted upon the upper can portion for enhancing functionality of the re-closeable cap. In this regard, an exemplary a rim wall-engaging protrusion formed opposite the first dynamic structure may provide a structural aid to direct edging of the first dynamic structure into overlapped relation with edging of the static structure for enhancing a can opening covering configuration by forming a seal at the overlap site of the opposed edging.

The first dynamic structure is preferably configured to mate with the static structure for maintaining the re-closeable cap in a can-opening access configuration. More particularly, the first dynamic structure is configured to simultaneously mate with the static structure by way of multiply spaced mate features as exemplified by the complex landscape of the cap surfacing as more particularly described below. When the first dynamic structure clamshell closes into engagement with the static structure, multiple surfaces, spaced from one another, frictionally engage with one another. Thus, the multiply spaced mate features enhance mated engagement of the first dynamic structure with the static structure.

The re-closeable caps may further preferably comprise a second dynamic structure as exemplified by a swinging cover element. The second dynamic structure at least partially covers the can opener element/assembly of the upper can portion and is pivotal in a direction opposite that of the first dynamic structure for enabling the user to form the can opening in the can capping plate by moving in unison with the can opener element. The static structure may preferably comprise a can opener access window as described in connection a certain embodiment, which can opener access window enhances a user's ability to access the can opener element.

Preferably, the second dynamic structure is configured to mate with the can opener element for enhancing movement therewith in unison. Noting that the first dynamic structure mates with the complex upper surfacing of the cap, it follows that the first dynamic structure is further preferably configured to mate with the second dynamic structure for maintaining the re-closeable cap in a can-opening access configuration.

The re-closeable caps according to the present invention may further preferably comprise a cap rim groove matable with a can rim groove situated in inferior adjacency to the can rim as is relatively standard in the industry. The matable cap and can rim grooves enhance cap-to-can attachment. To further enhance the cap-to-can attachment hold, the cap rim may further comprise at least one undercut formation. As described hereinbelow, the undercut formation(s) are configured for securing the cap rim groove in mated engagement with the can rim groove.

A preferred embodiment of the cap comprises a first dynamic structure and a static structure whereby opposed edging situated in superior adjacency to a tip portion of the can opener element. The tip portion of the can opener element operates to structurally support the opposed edging for enhancing a sealed interface at the opposed edging. The re-closeable caps according to the present invention may further preferably comprise a finger depression feature. The finger depression feature overlaps the first and second dynamic structures for enabling the user to depress the same and selectively actuate either of the first and second dynamic structures to initiate further movement thereof.

In an alternative embodiment, the re-closeable cap is rotatably outfitted upon the upper can portion for enabling the use to selectively cover the can opening with at least the static structure. This embodiment may preferably comprise at least one turning nub formed in adjacency to the cap rim for enhancing the user's ability to rotate the re-closeable cap relative to the upper can portion when outfitted thereupon. Further, at least one cap-removing grip formation is provided in connection with this embodiment and formed in alignment with the at least one turning nub for enhancing the user's ability to remove the re-closeable cap from the upper can portion.

This embodiment further preferably comprises a lower cap skirt that seats down upon a neck portion of the upper can portion. It will be seen from a consideration of the illustrative matter submitted in support of these specifications that the neck portion extends obliquely relative to the can capping plate and that the lower cap skirt extends obliquely relative to the cap plate, the lower cap skirt paralleling the neck portion.

Noting that the neck portion comprises an upper neck portion and a lower neck portion, and that the lower cap skirt comprises a skirt edge, the skirt edge particularly terminates intermediate the upper and lower neck portions for enhancing safe use of the re-closeable cap during cap rotation relative to the upper can portion. In contrast to this alternative embodiment, the preferred embodiment is designed for relatively permanent, non-rotatable attachment to the upper can portion and thus is preferably devoid of turning nubs, grip formations, and skirt features of this type.

The re-closeable caps according to the present invention may all be preferably provided in series within a web form for simultaneously outfitting a plurality of upper can portions of beverage cans by way of a multi-pack packaging arrangement as variously exemplified. As will be discussed in more detail, the preferred embodiment is designed for relatively permanent attachment to the upper can portions at the time of manufacture or packaging through contents consumption with a view toward further entering the recycling system in view of the fact that beverage cans are among the most recycled items in the system. The caps may further preferably comprise cap-marking indicia for individually labeling re-closeable caps as provided in series within the web form for enabling multiple consumers to properly identify outfitted beverage cans as belonging to individual consumers at the time of consumption.

Other secondary objects of the present invention, as well as particular features, elements, and advantages thereof, will be elucidated or become apparent from, the following brief descriptions of the drawings and the accompanying drawing figures.

BRIEF DESCRIPTIONS OF THE DRAWINGS

Other features and objectives of the invention will become more evident from a consideration of the following brief descriptions of patent drawings.

Figures 30, 30A:
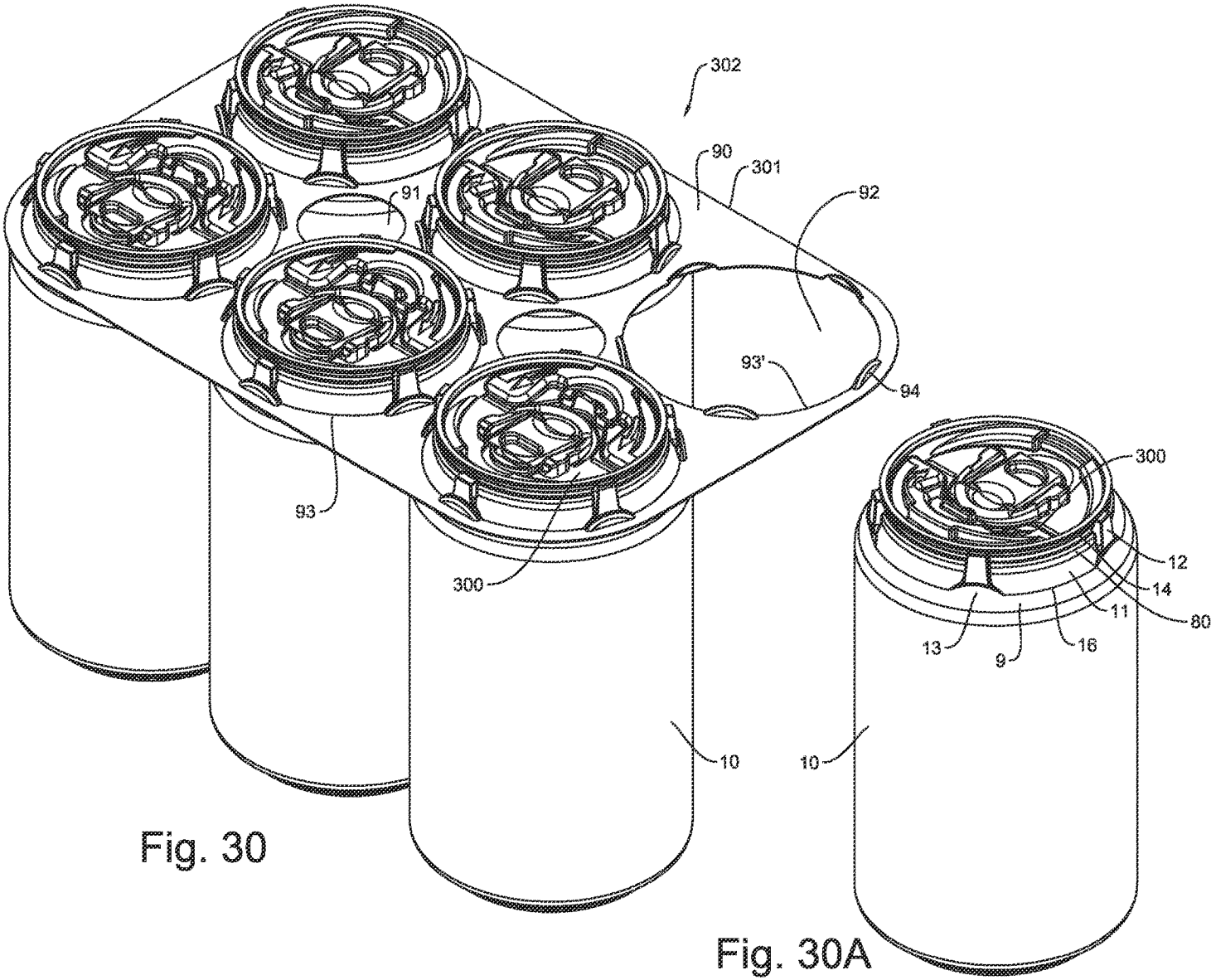

FIG. 30 is a top perspective view of the first alternative re-closeable cap packaging arrangement according to the present invention showing a series of five first re-closeable caps according to the present invention formed in a packaging material web in outfitted or assembled relation with or upon a series of five generic beverage cans and depicting a single first re-closeable cap removed from the first alternative re-closeable cap packaging arrangement.

FIG. 30A is a top perspective view of a generic beverage can outfitted with a first re-closeable cap according to the present invention as removed from the first alternative re-closeable cap packaging arrangement otherwise depicted in FIG. 30.

Figure 31:
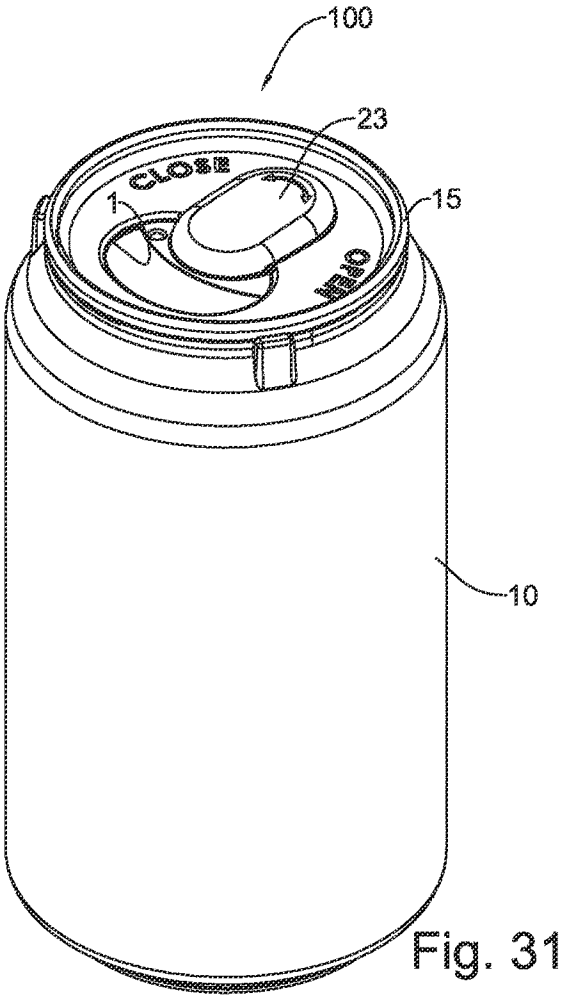

FIG. 31 is a top perspective view of a generic beverage can outfitted with a second alternative re-closeable cap according to the present invention.

Figure 32:
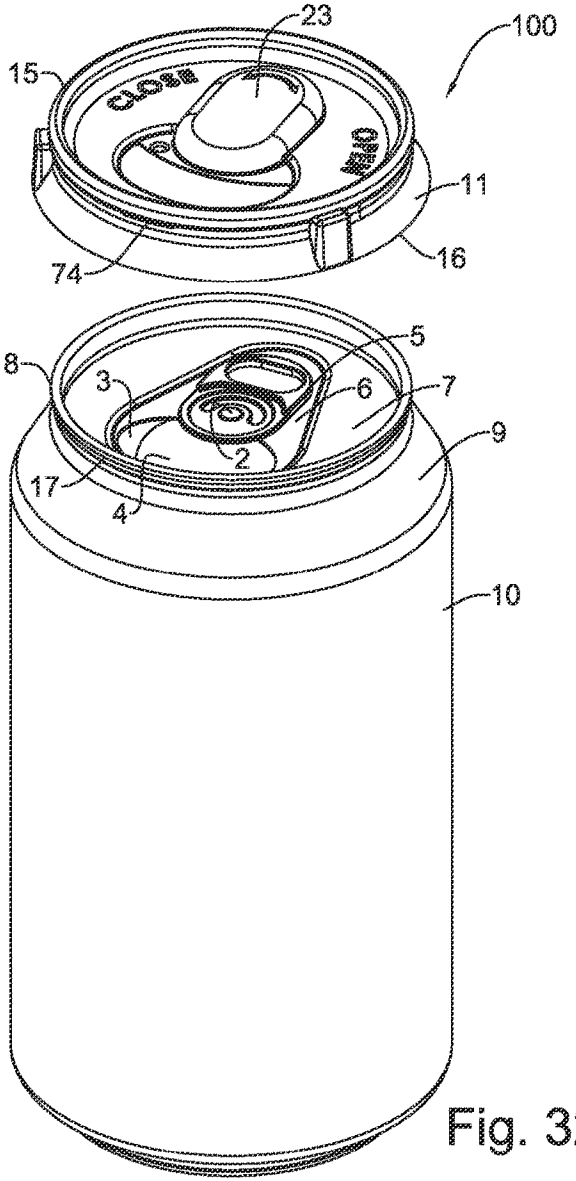

FIG. 32 is an exploded top perspective view of a generic beverage can and the second alternative re-closeable cap according to the present invention.

Figures 33, 34:
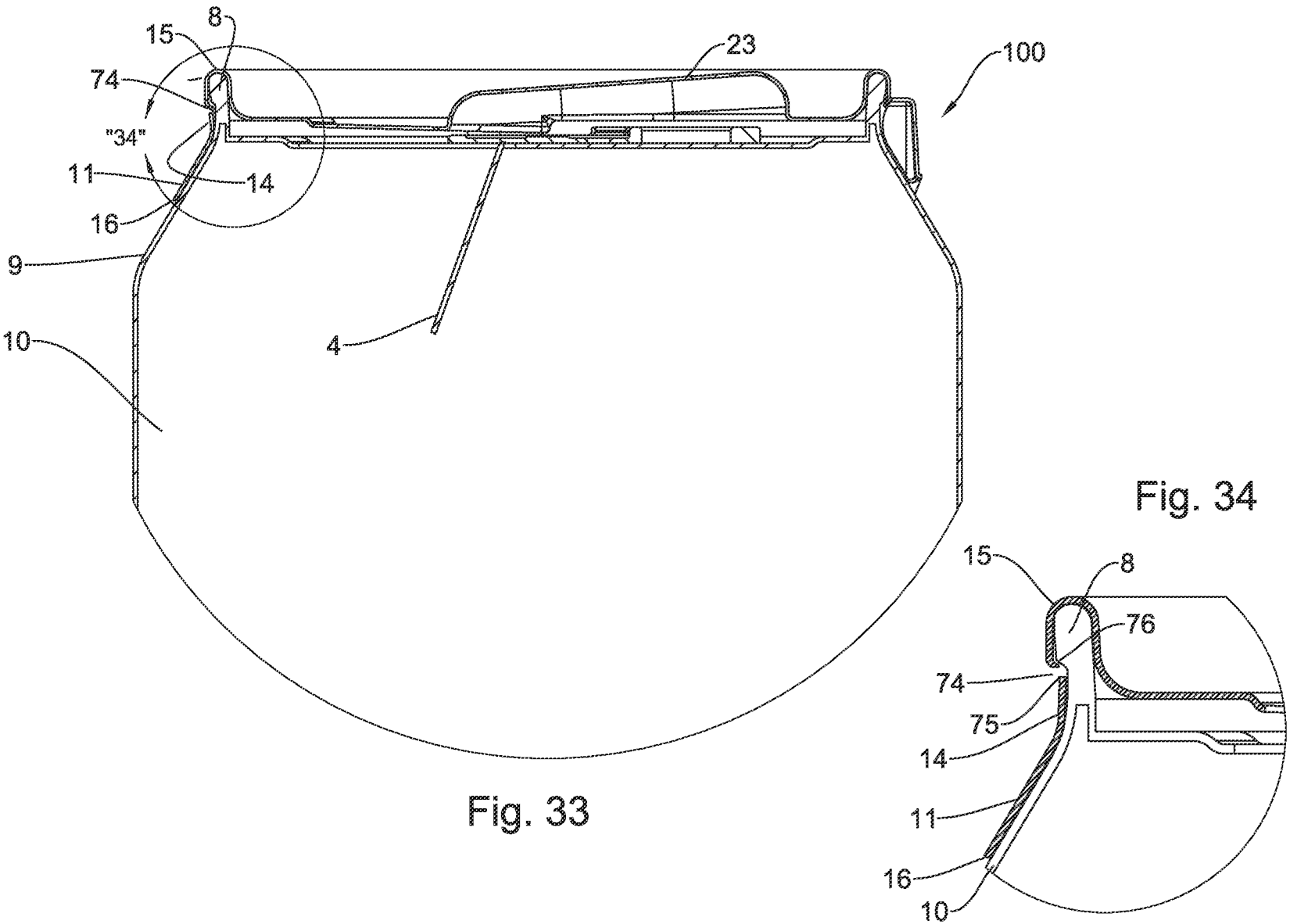

FIG. 33 is an enlarged, fragmentary cross-sectional view of an upper portion of a generic beverage can outfitted with the second alternative re-closeable cap according to the present invention showing the can opening plate of the beverage can extending downwardly within the beverage can.

FIG. 34 is an enlarged, fragmentary cross-sectional view as enlarged and sectioned from FIG. 33 to depict in greater detail the structures associated with the attachment site of the upper portion of a generic beverage can as outfitted with the second alternative re-closeable cap according to the present invention.

Figures 35, 36, 37:
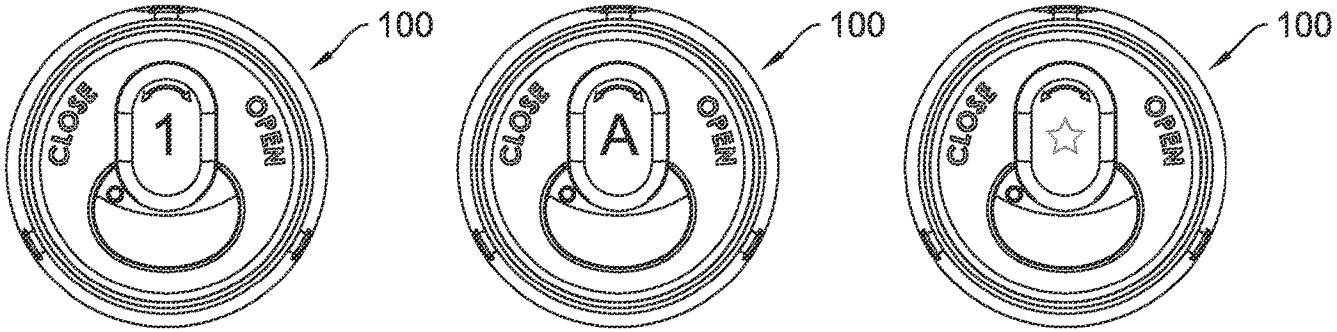

FIG. 35 is a first series of three second alternative re-closeable caps according to the present invention outfitted with first number-based, cap-marking indicia for labeling the three second alternative re-closeable caps from top to bottom as 1 cap—2 cap—3 cap.

FIG. 36 is a second series of three second alternative re-closeable caps according to the present invention outfitted with second letter-based, cap-marking indicia for labeling the three second alternative re-closeable caps from top to bottom as A cap—B cap—C cap.

FIG. 37 is a third series of three second alternative re-closeable caps according to the present invention outfitted with third shape-based, cap-marking indicia for denoting the three second alternative re-closeable caps from top to bottom as 5-point star cap—4-point star cap—7-point star cap.

Figure 38:
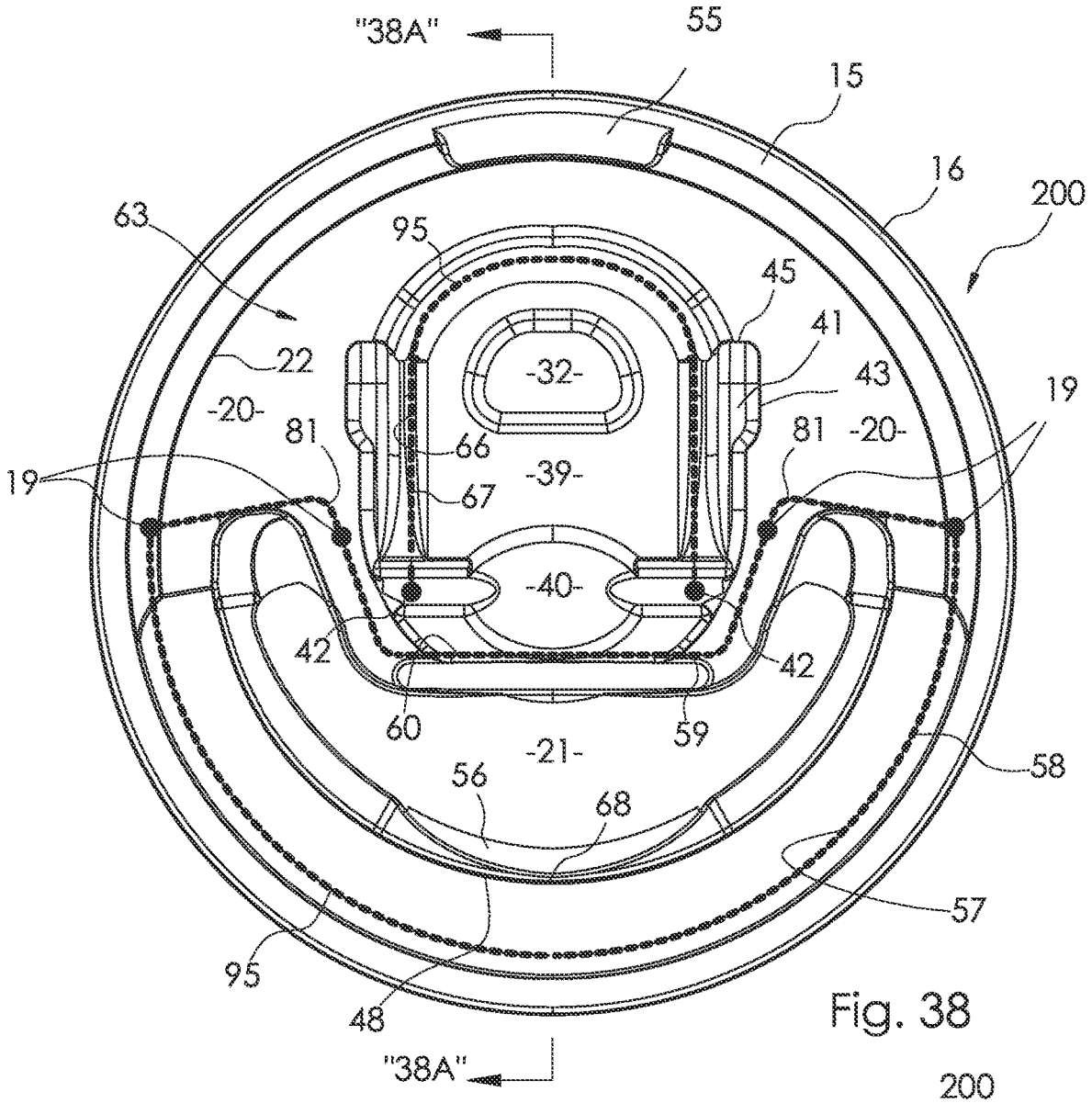

FIG. 38 is a top plan view of a third alternative re-closeable cap according to the present invention as attached to or outfitted upon a generic beverage can and showing a dotted line detail for depicting a perforated or cut line for the cap swinging structure and the swinging cover element of the third alternative re-closeable cap according to the present invention.

Figure 38A:
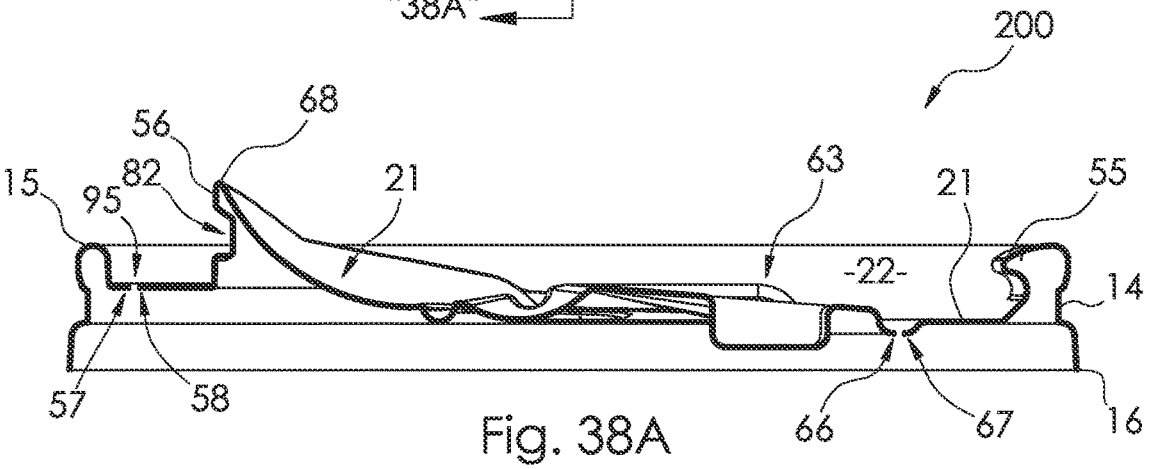

FIG. 38A is a longitudinal cross-sectional view as sectioned from FIG. 38 to diagrammatically depict or highlight the slotted features following separations along the dotted line detail of the cap swinging structure and the swinging cover element of the third alternative re-closeable cap.

Figure 38B:
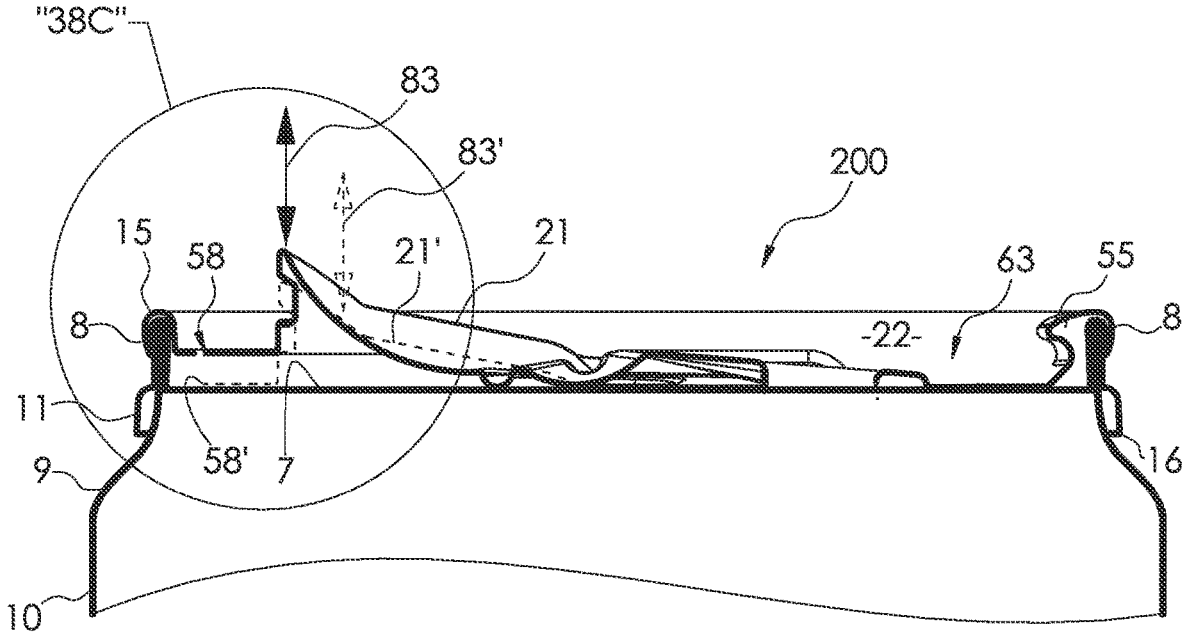

FIG. 38B is a diagrammatic depiction of the structures otherwise depicted in FIG. 38A to further diagrammatically depict or highlight a first slotted feature following its separation along the dotted line detail of the cap swinging structure of the third alternative re-closeable cap.

Figure 38D:
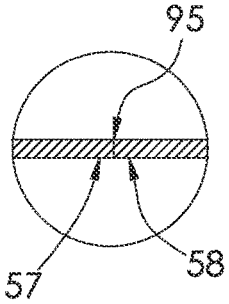
Figure 38C:
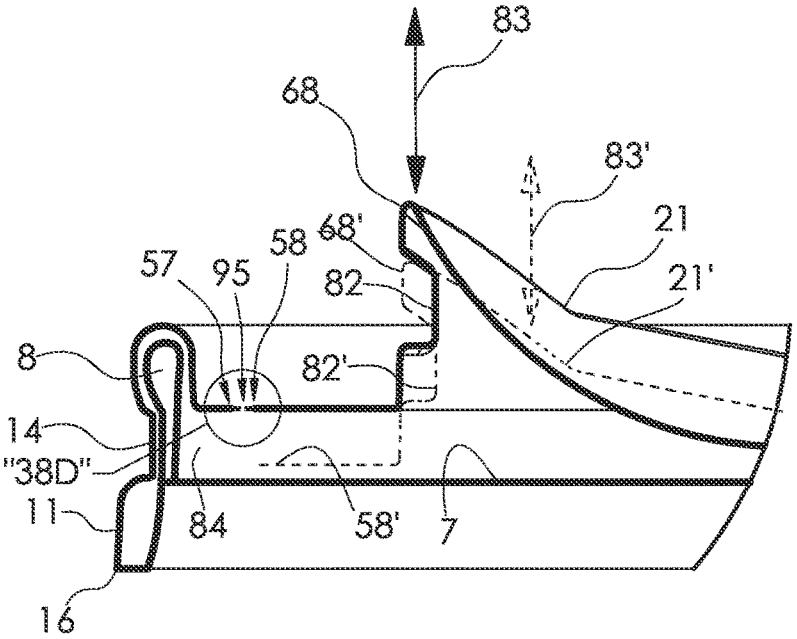

FIG. 38C is an enlarged, fragmentary depiction as enlarged from FIG. 38B to show in greater clarity or detail the structures associated with the first slotted feature following its separation along the dotted line detail of the cap swinging structure of the third alternative re-closeable cap.

FIG. 38D is an enlarged, fragmentary depiction as enlarged from FIG. 38C to show in greater clarity or detail the edge-to-edge scored separation point along the dotted line detail of the cap swinging structure of the third alternative re-closeable cap.

Figure 39:
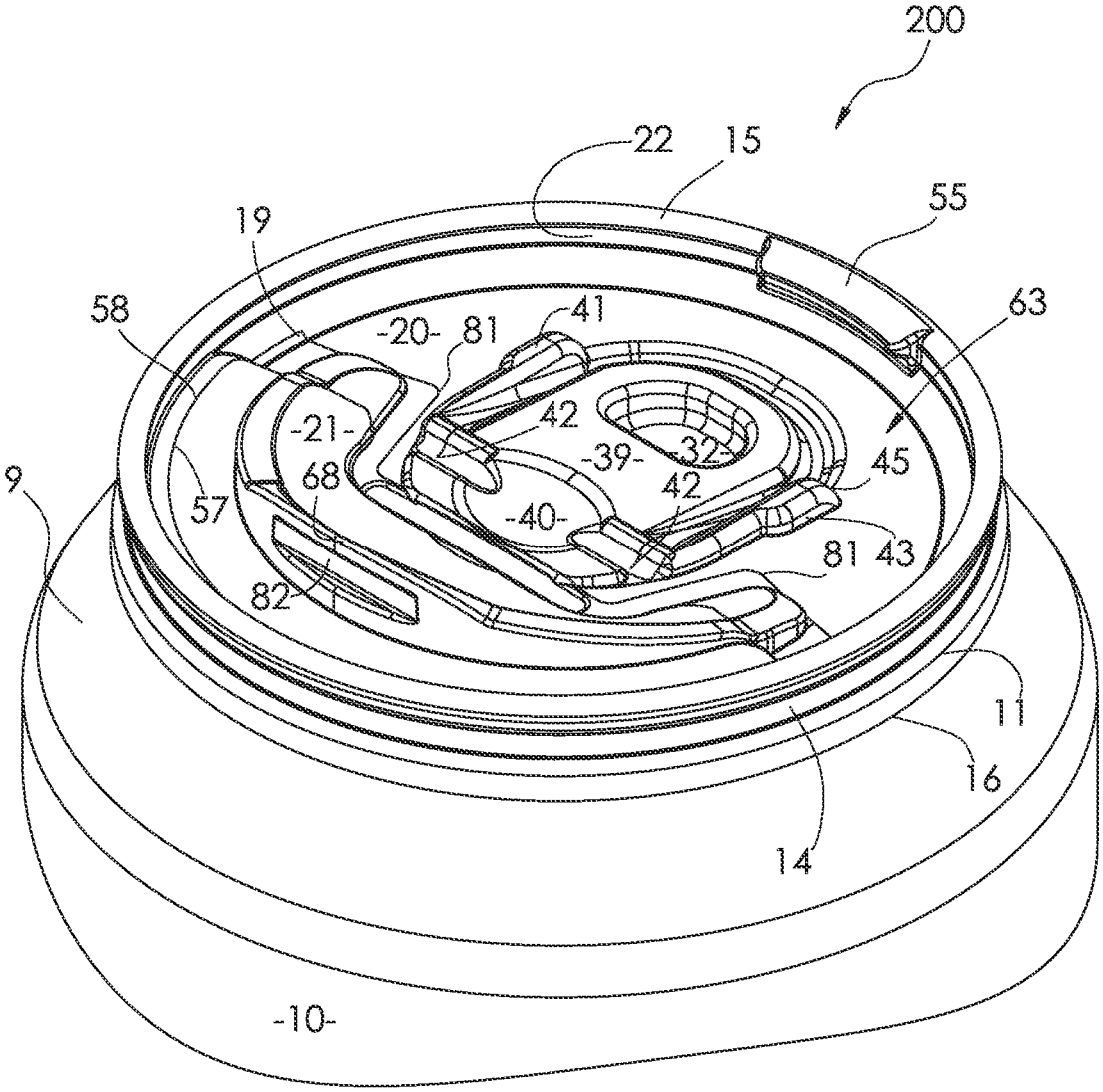

FIG. 39 is a top perspective view of the third alternative re-closeable cap according to the present invention in outfitted assembly upon an upper can portion of a beverage can.

Figure 40:
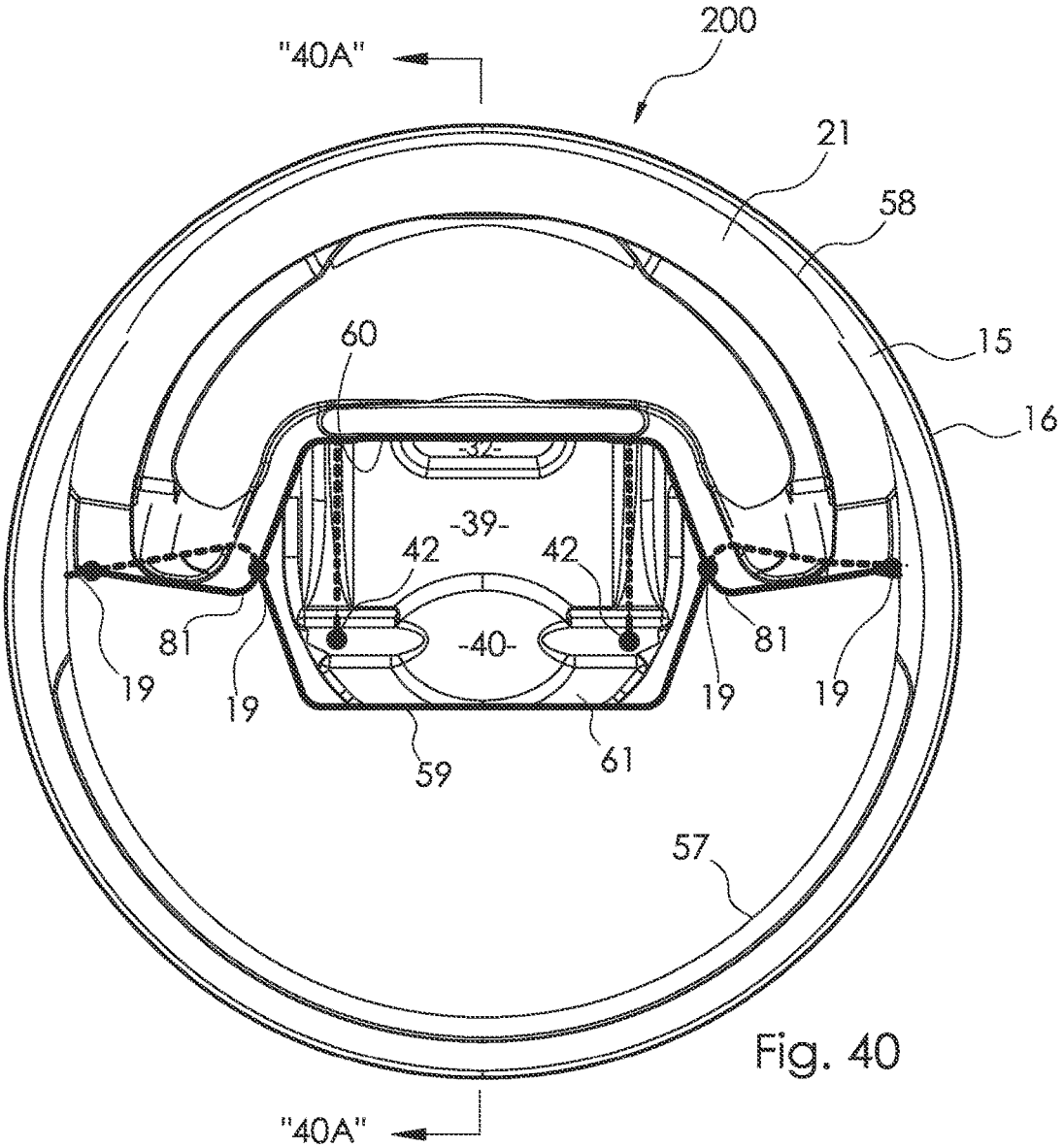

FIG. 40 is a top plan view of the third alternative re-closeable cap according to the present invention showing the cap swinging structure in a locked, full state of swing extension or can-opening access state highlighting pivot points of the cap swinging structure.

Figure 40A:
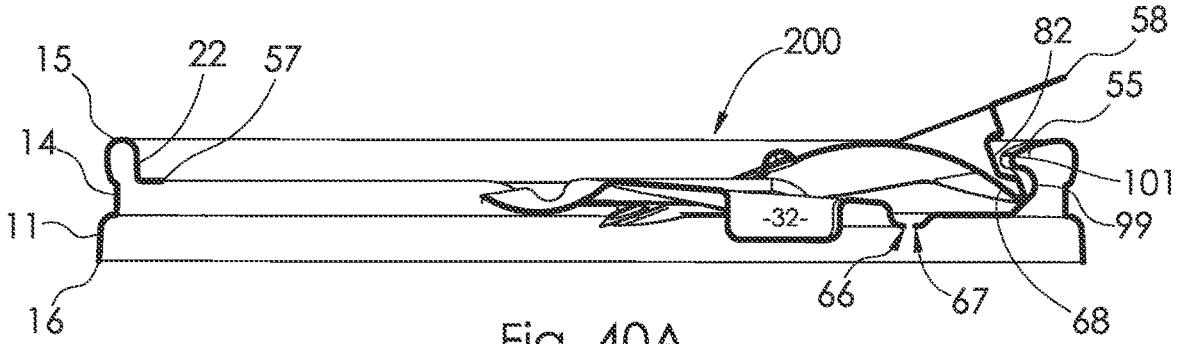
Figure 41:
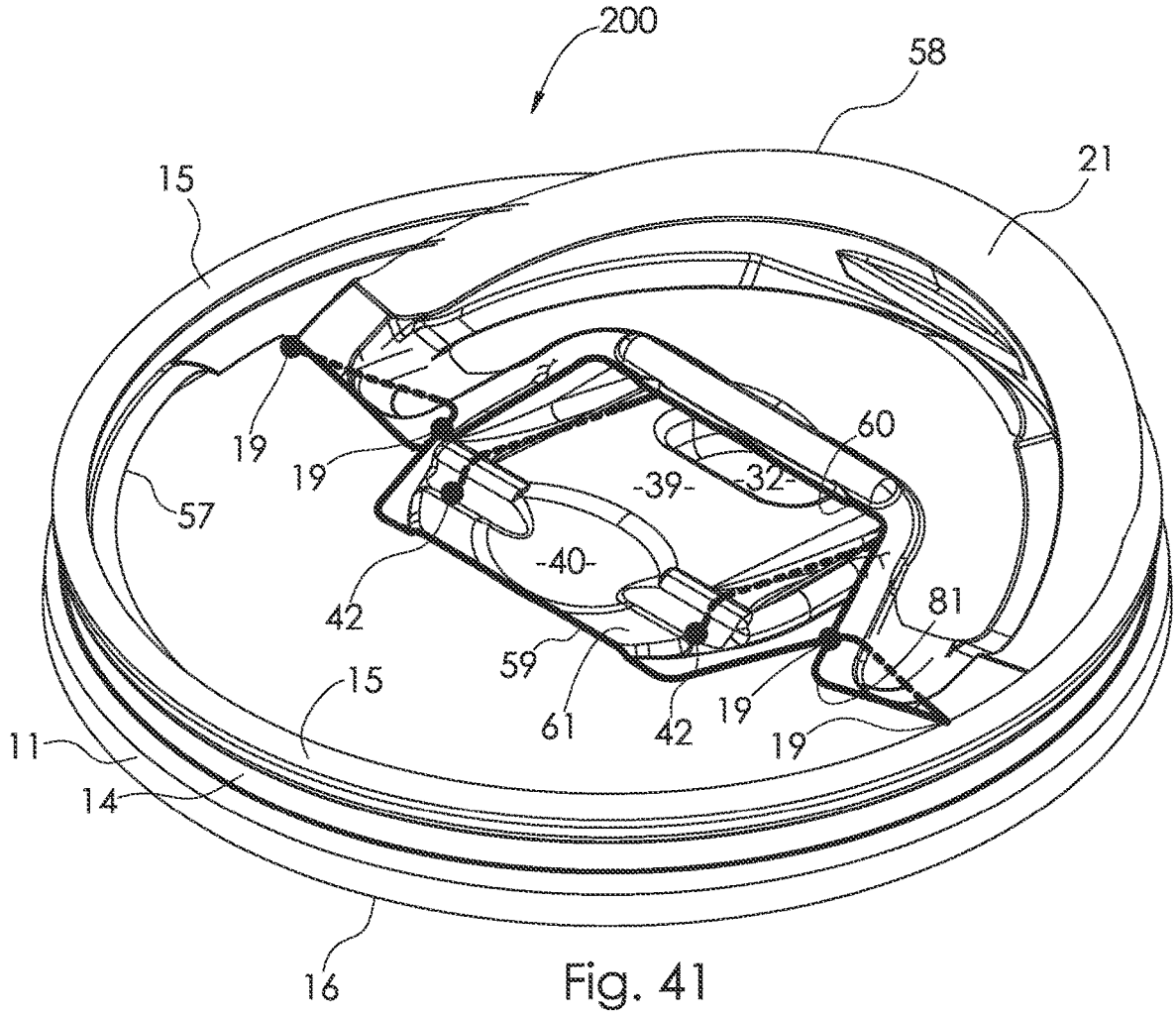

FIG. 40A is a longitudinal cross-sectional view as sectioned from FIG. 40 to show in greater clarity or detail the cap swinging structure in a full state of swing extension FIG. 41 is a top perspective view of the third alternative re-closeable cap according to the present invention showing the cap swinging structure in a full state of swing extension or can-opening access state highlighting pivot points of the cap swinging structure.

Figure 42:
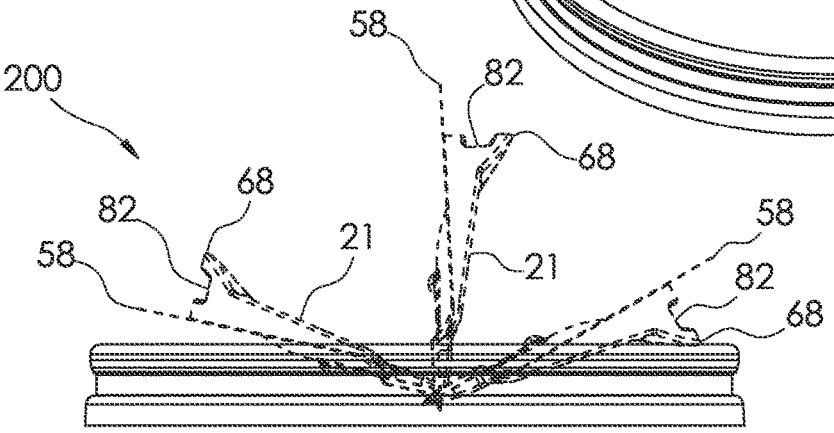

FIG. 42 is an edge view of the third alternative re-closeable cap according to the present invention showing the cap swinging structure thereof in broken lining in first, second, and third states of swing extension.

Figure 43:
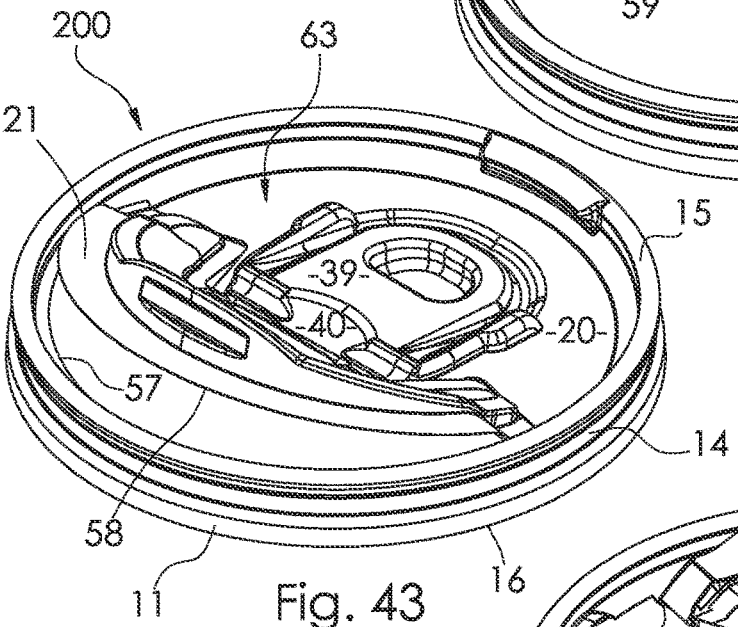

FIG. 43 is top perspective view of the third alternative re-closeable cap according to the present invention showing the cap swinging structure thereof in a first state of swing extension.

Figure 44:
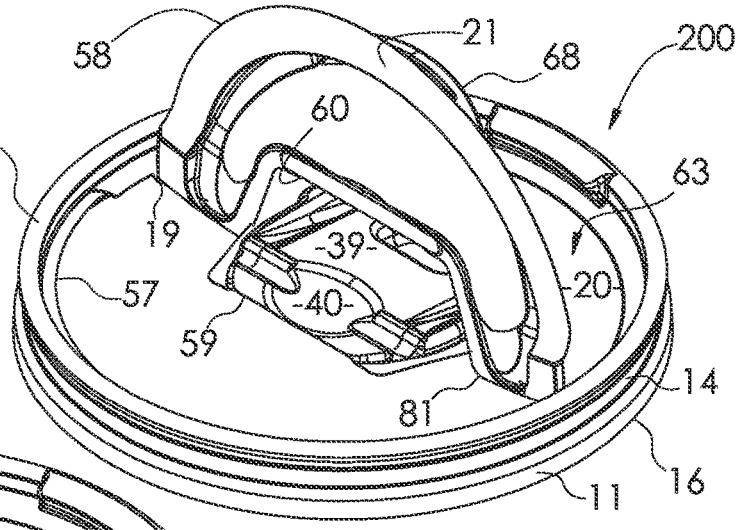

FIG. 44 is top perspective view of the third alternative re-closeable cap according to the present invention showing the cap swinging structure thereof in a second state of swing extension.

Figure 45:
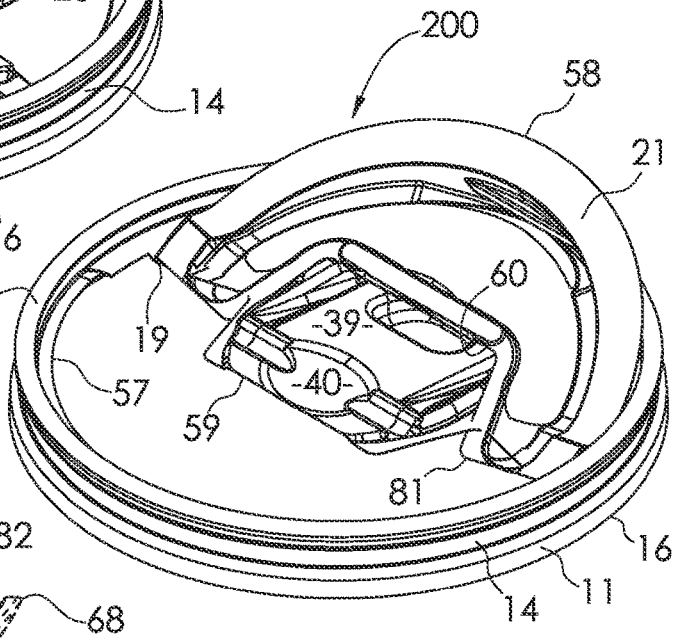

FIG. 45 is top perspective view of the third alternative re-closeable cap according to the present invention showing the cap swinging structure thereof in a third state of swing extension.

Figure 46:
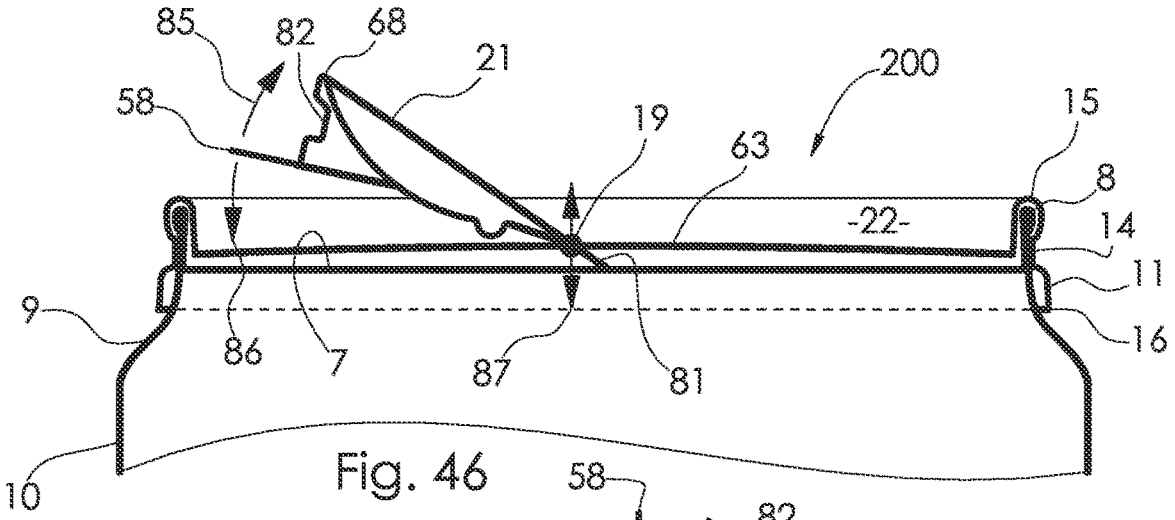

FIG. 46 is a longitudinal cross-section depiction of the third alternative re-closeable cap according to the present invention showing the cap swinging structure thereof in a first state of swing extension to depict a first aspect of an eccentric switch effect of a flip-flop mechanism according to the present invention.

Figure 47:
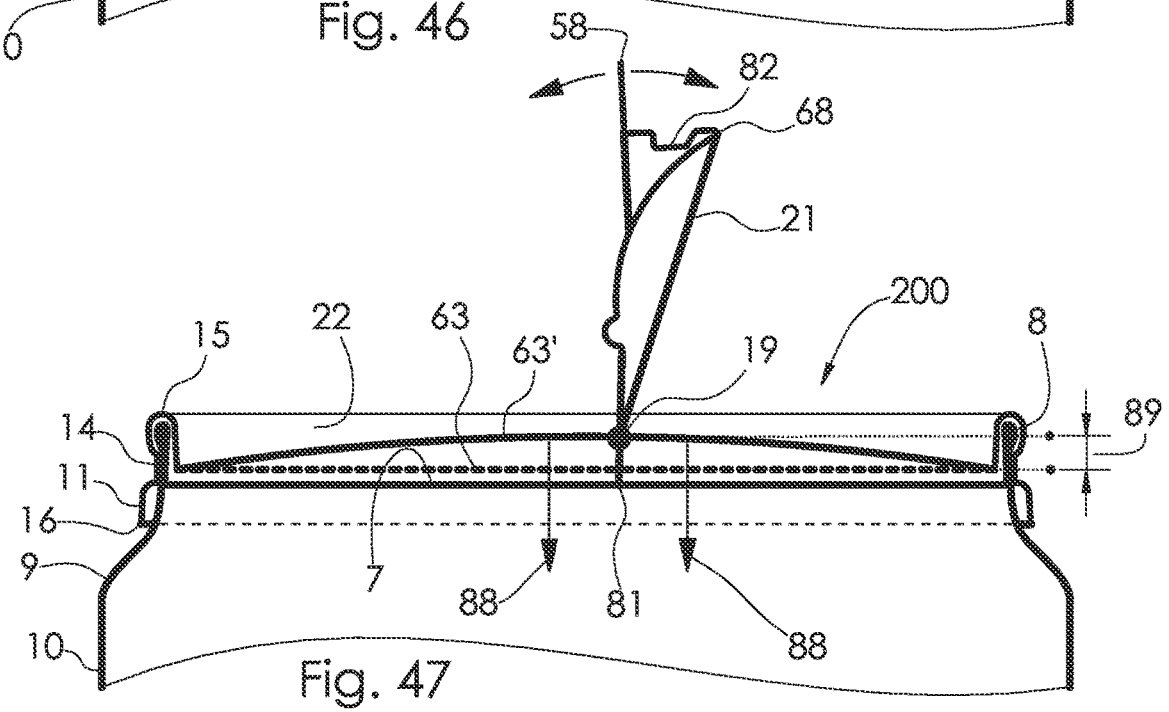

FIG. 47 is a longitudinal cross-section depiction of the third alternative re-closeable cap according to the present invention showing the cap swinging structure thereof in a second state of swing extension to depict a second aspect of an eccentric switch effect of a flip-flop mechanism according to the present invention.

Figure 48:
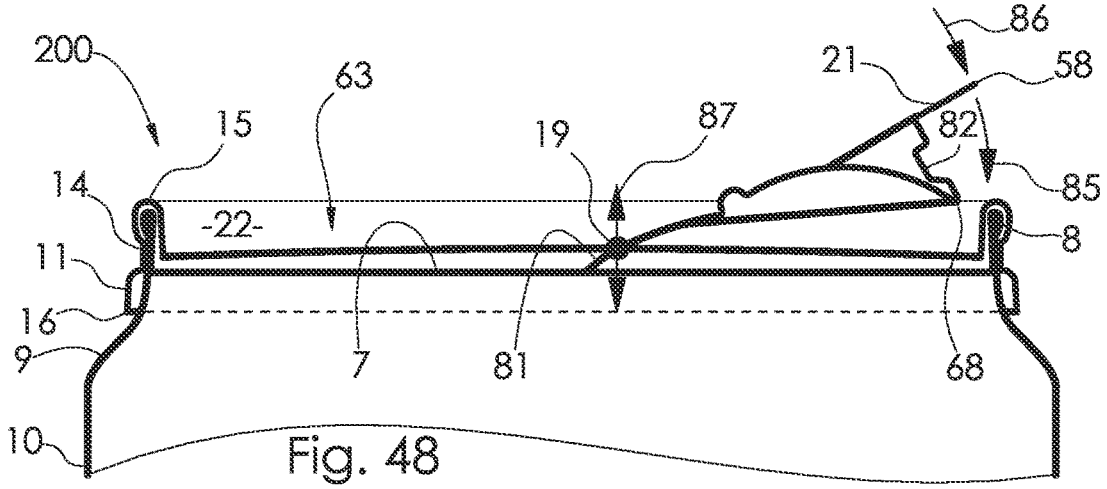

FIG. 48 is a longitudinal cross-section depiction of the third alternative re-closeable cap according to the present invention showing the cap swinging structure thereof in a third state of swing extension to depict a third aspect of an eccentric switch effect of a flip-flop mechanism according to the present invention.

Figure 49:
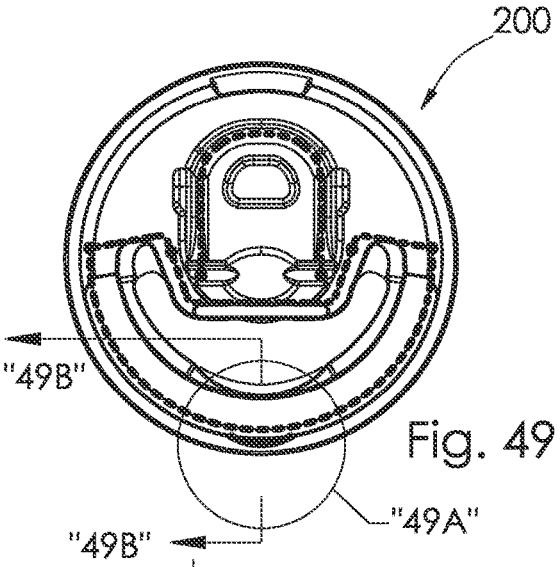

FIG. 49 is a reduced top plan view of the third alternative re-closeable cap according to the present invention shown in exploded relation relative to an underlying generic beverage can and showing a dotted line detail for depicting a perforated or cut line for the cap swinging structure shown in a fully retracted, can-opening covering state and the swinging cover element of the third alternative re-closeable cap according to the present invention.

Figure 49A:
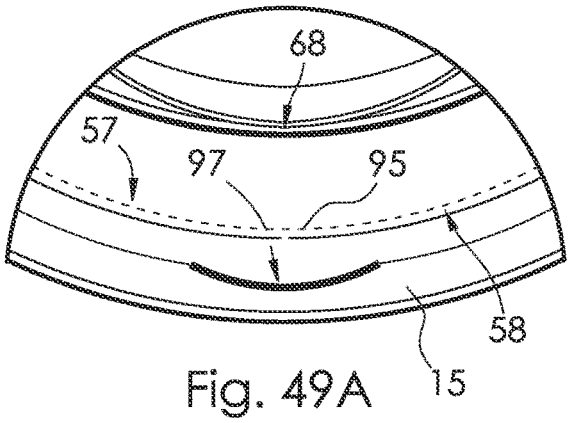

FIG. 49A is an enlarged, fragmentary sectional view as enlarged and sectioned from FIG. 49 to depict in greater clarity or detail a first aspect of an optional locking mechanism according to the present invention.

Figure 49B:
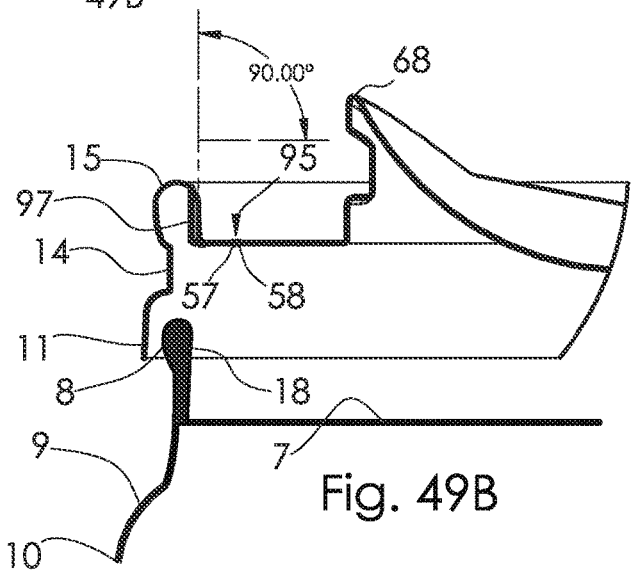

FIG. 49B is a first enlarged, fragmentary sectional view as enlarged and sectioned from FIG. 49 to depict in greater clarity or detail a second aspect of an optional locking mechanism according to the present invention.

Figure 49D:
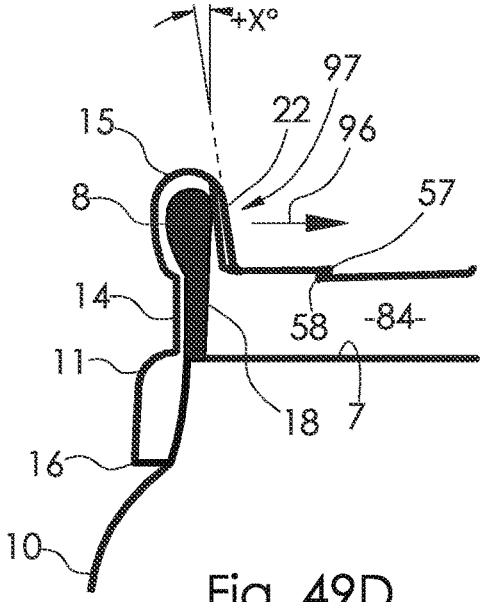
Figure 49C:
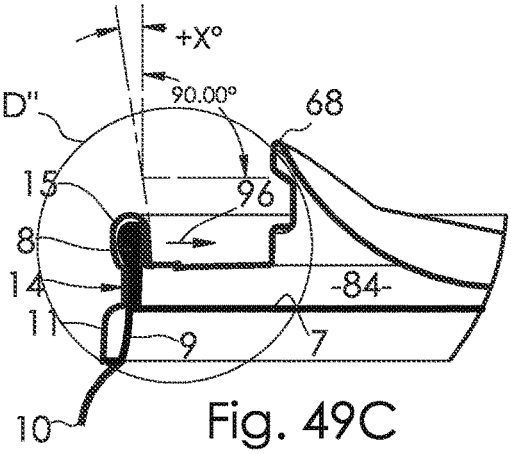

FIG. 49C is a second enlarged, fragmentary sectional view to depict in greater clarity or detail the second aspect of an optional locking mechanism when the cap is outfitted upon the beverage can according to the present invention.

FIG. 49D is an enlarged, fragmentary sectional view as enlarged from FIG. 49C to depict in still greater clarity or detail the second aspect of an optional locking mechanism when the cap is outfitted upon the beverage can according to the present invention.

Figure 50:
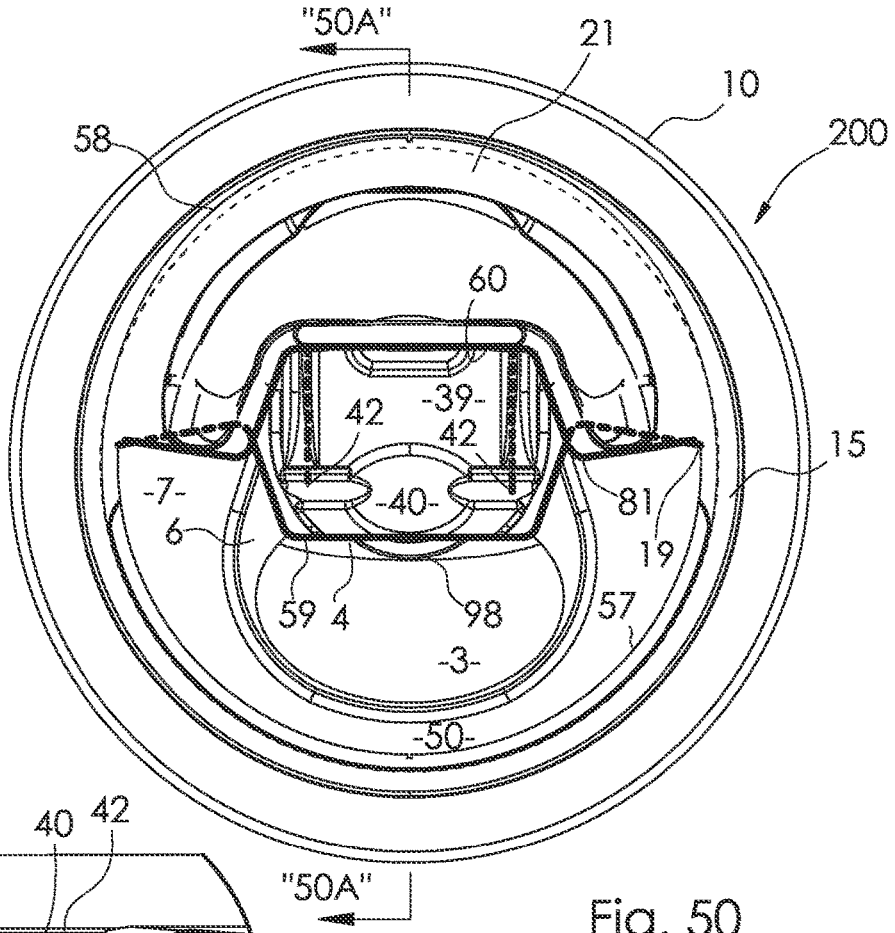

FIG. 50 is a top plan view of the third alternative re-closeable cap according to the present invention shown in assembled relation with an underlying generic beverage can and showing the cap swinging structure shown in a locked, fully open, can-opening access state.

Figure 50B:
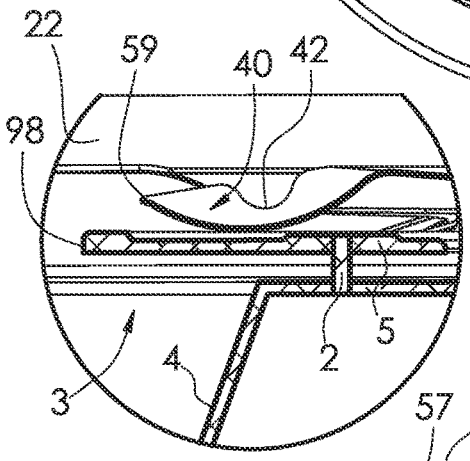
Figure 50A:
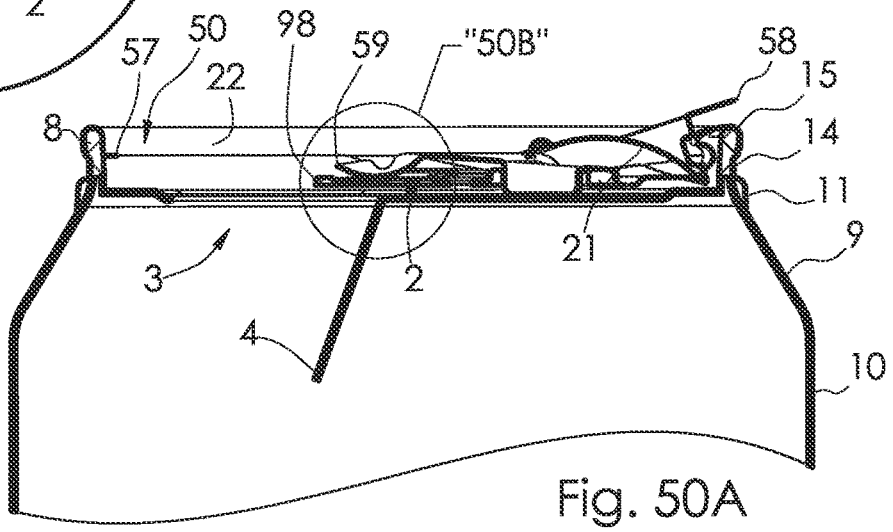

FIG. 50A is an enlarged, fragmentary sectional view as enlarged and sectioned from FIG. 50 to depict in greater clarity or detail the structures associated with the cap swinging structure according to the present invention.

FIG. 50B is an enlarged, fragmentary sectional view as enlarged and sectioned from FIG. 50A to depict in greater clarity or detail structures in adjacency to the underlying can opener element when the cap swinging structure is in the locked, fully open, can-opening access state.

Figure 51:
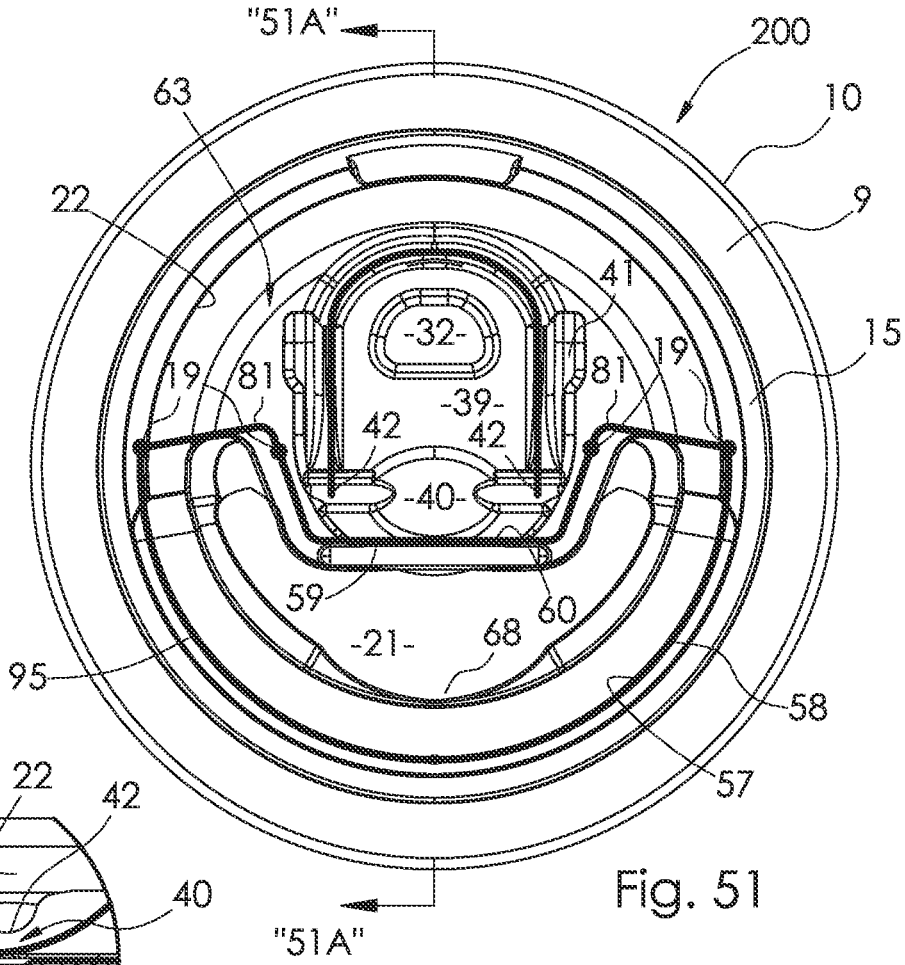

FIG. 51 is a top plan view of the third alternative re-closeable cap according to the present invention shown in assembled relation with an underlying generic beverage can and showing the cap swinging structure shown in a fully retracted, can-opening covering state.

Figure 51B:
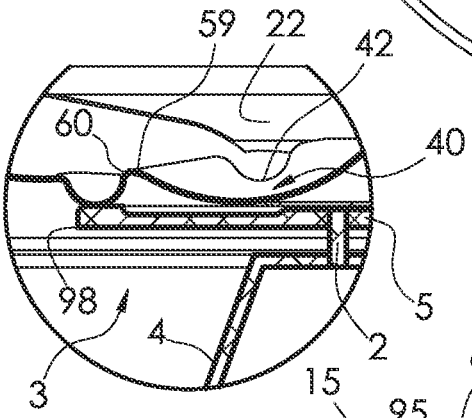
Figure 51A:
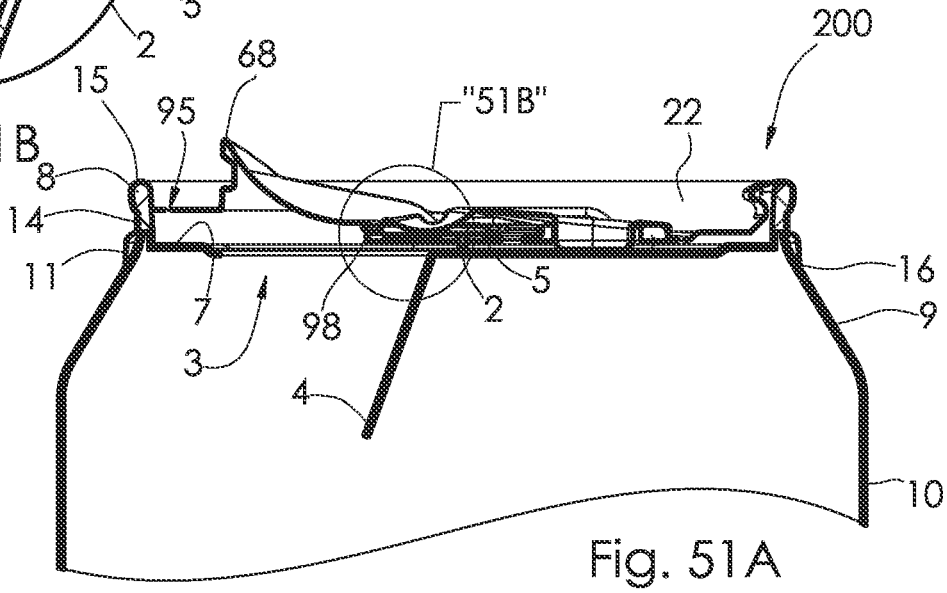

FIG. 51A is an enlarged, fragmentary sectional view as enlarged and sectioned from FIG. 51 to depict in greater clarity or detail the structures associated with the cap swinging structure and the underlying can opener element according to the present invention.

FIG. 51B is an enlarged, fragmentary sectional view as enlarged and sectioned from FIG. 51A to depict in greater clarity or detail structures in adjacency to the underlying can opener element when the cap swinging structure is in the fully retracted can-opening covering state.

Figure 52:
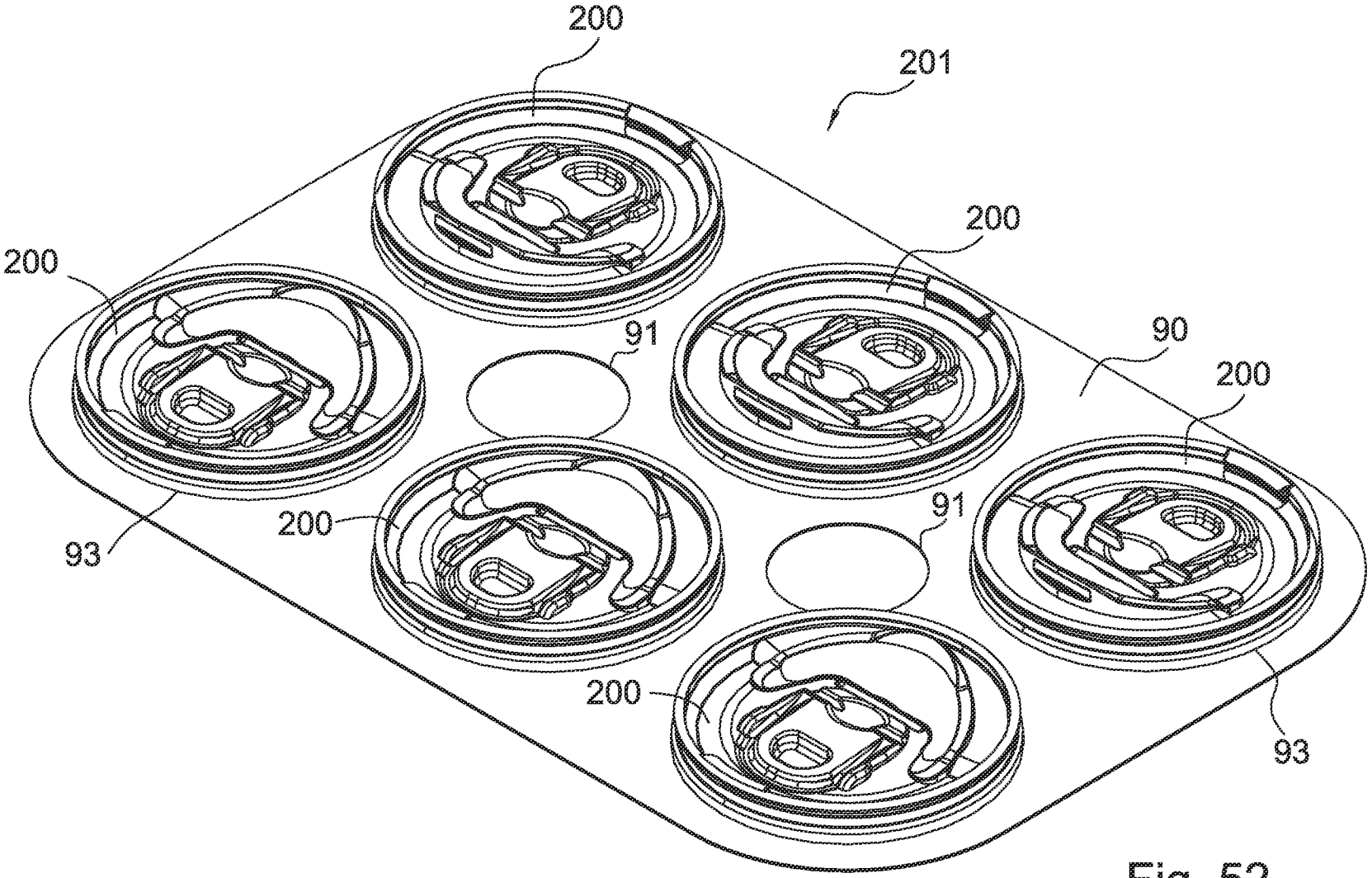

FIG. 52 is a top perspective view of a third alternative re-closeable cap packaging arrangement according to the present invention showing a series of six third re-closeable caps according to the present invention formed in a packaging material web.

DETAILED DESCRIPTION OF THE PREFERRED EMBODIMENTS

Referring now to the drawings with more specificity, the following specifications generally describe certain re-closeable caps as variously exemplified for outfitting and capping beverage cans, which beverage cans have become relatively standard in the industry for serving beverages to consumers. A generic beverage can usable in combination with the re-closeable caps according to the present invention is generally depicted and referenced at 10 throughout the illustrative matter submitted in support of these specifications.

The beverage can 10 usable in combination with the alternative re-closeable caps 100, 200, and 300 according to the present invention preferably comprise a can rim 8, a frustoconical neck portion 9; a can groove 17 formed in inferior adjacency to the can rim; a can rim inner wall as at 18; a can capping plate 7; an indentation or depression 6 formed in the can capping plate 7; a (pivotable) can opener element or assembly 5; a turning center 2 (e.g. a pivot pin through which an axis of rotation extends) of the can opener element or assembly 5; a (scored) can-opening or aperture-forming plate portion 4; and a can opening 3 once the (scored) aperture-forming plate portion 4 is separated from the can capping plate portion 7 forming a can opening edge 1 at the score line.

The present specifications further contemplate certain embodiments of the re-closeable cap as generally depicted at a first alternative embodiment or first alternative re-closeable cap as at 300; a second alternative embodiment or second alternative re-closeable cap as at 100; and a third alternative embodiment or third alternative re-closeable cap as at 200. The third alternative embodiment or third alternative re-closeable cap as at 200 may be considered the preferred embodiment according to the present invention while the first alternative re-closeable cap is utilized to exemplify the various component features of the caps 300 and 200. The second alternative re-closeable cap 100 is illustrated to support various peripheral features also embraced by the caps 300 and 200.

The variously exemplified re-closeable caps 100, 200, and 300 according to the present invention are all designed to be removably outfitted upon or attached to an upper can portion of a beverage can 10 typified by aluminum cans for containing sodas, beers or any other beverage that is sold after having been packaged and sealed by a manufacturer or packaging company. The re-closeable caps 200 and 300 are particularly designed with a view toward outfitting beverage cans during the manufacturing or packaging process so as to provide a cap that will ride upon an outfitted beverage from packaging to user consumption for enhancing safety concerns. Further, it is contemplated that the re-closeable caps 200 and 300 will travel with the outfitted beverage cans 10 to the point of disposal with the aim of directing as many re-closeable caps 200/300 into the recycling process as possible given the high tendency for aluminum beverage cans to enter recycling systems.

In this regard, it is contemplated that the re-closeable caps 100, 200, and 300 for beverage cans 10 according to the present invention may thus be attached to the upper can portion exemplified by a can rim 8 of the beverage can 10 preferably by the manufacturer or packaging company, but alternatively by the consumer. In either case, the re-closeable caps 100, 200, and 300, when outfitted upon beverage cans 10, operate to selectively open or allow access to beverage can 10 contents and close or cover the beverage can 10 after the scored aperture-forming plate 4 has been depressed or removed from the score line or edge 1 of the beverage can 10.

The variously exemplified re-closeable caps 100, 200, and 300 may also be attached or outfitted upon the can rims 8 or upper can portions of beverage cans 10 by the manufacturers, packaging company, or establishments that sell the canned products. The variously exemplified re-closeable caps 100, 200, and 300 may also be outfitted upon multiply arranged beverage cans 10 as part of a multi-cap packaging arrangement as at 301 in FIGS. 25-30 for forming a multi-can-capped packaging arrangement as at 302 in FIGS. 29 and 30.

The reader will note that while the packaging arrangements 301 and 302 are depicted comprising the first alternative re-closeable caps 300, that similar packaging arrangements are contemplated comprising the second and third alternative re-closeable caps 100 and 200. In this regard, an exemplary packaging arrangement 201 is generally depicted in FIG. 52 showing a series of third alternative re-closeable caps 200 within a preferably or optionally thermoformed web 90 preferably outfitted with arrangement-grabbling finger holes as at 91. In this last regard, the reader will note that the re-closeable caps may alternatively be formed by or constructed by way of injection molding, stamping and/or paper-based constructions.

Figure 27:
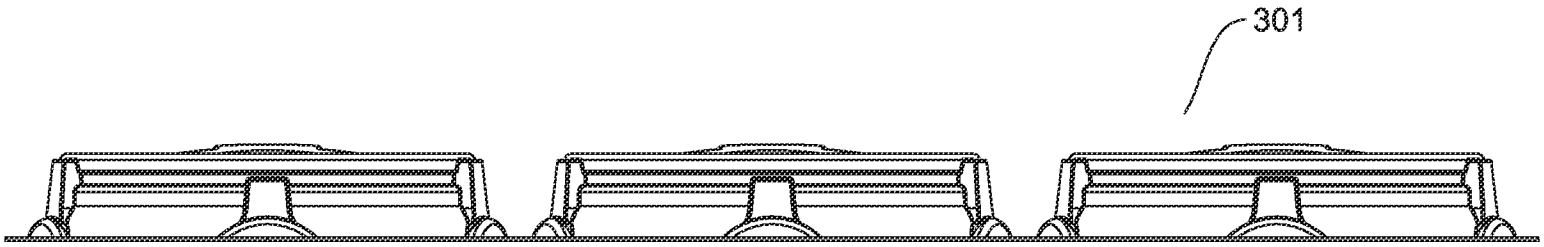
FIG. 27 is a lateral edge view of the first alternative re-closeable cap packaging arrangement according to the present invention.
Figure 28:
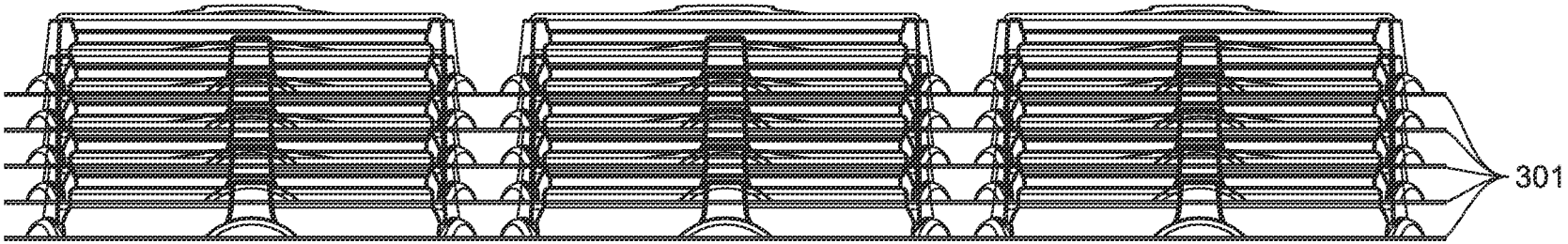
FIG. 28 is a longitudinal sectional view of a series of stacked first alternative re-closeable cap packaging arrangements according to the present invention.
Figure 29:
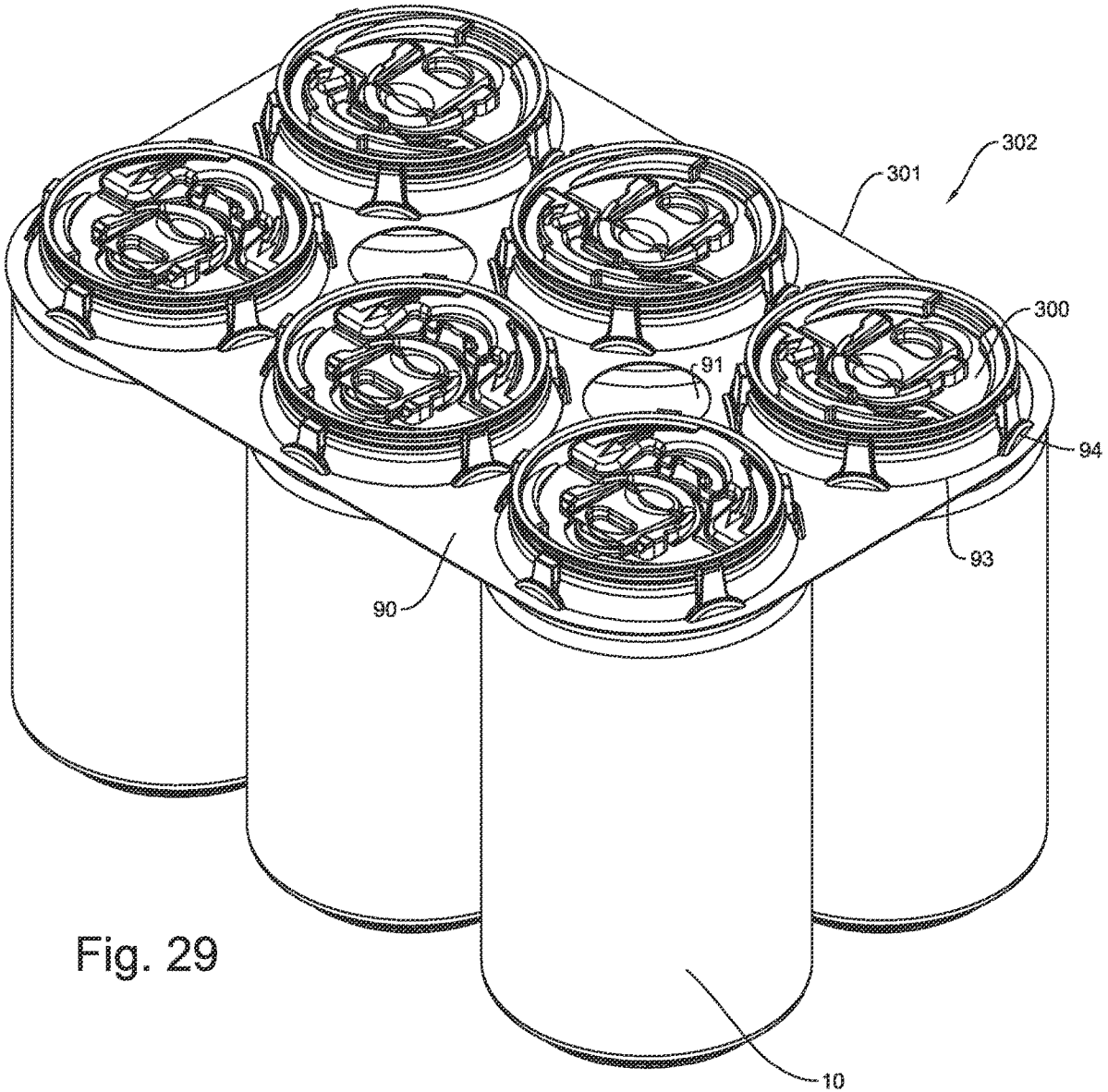
FIG. 29 is a top perspective view of the first alternative re-closeable cap packaging arrangement according to the present invention showing a series of six first re-closeable caps according to the present invention formed in a packaging material web in outfitted or assembled relation with or upon a series of six generic beverage cans.

The packaging arrangements 201 and 301 are exemplary and show a series of six caps per web 90 with pre-cut or perforated lining as at 93 or enabling easier removal of cap-outfitted beverage cans 10 from the web(s) 90. The present invention contemplates multi-pack arrangements differing in cap number such as four-pack and two-pack arrangements. Once a cap-outfitted beverage can 10 is removed from the multi-pack arrangements 201/301, an opening 92 remains with opening or aperture edging 93'. Arrangement 301 further depicts grip leftovers or remnants 94 as remnant portions of grip or nub formations formed upon the cap 300. Further, the detached cap-outfitted can 10 shown in FIG. 30A depicts a stacking ledge 80, which ledges may be included in the overall design for aiding a stacked series of webs 90 or packaging arrangements as generally depicted in FIGS. 27 and 28.

Comparatively referencing FIGS. 25-30A, the reader will there consider that when packaging arrangements 301 and 302 are provided, a single beverage can 10 as outfitted with any of the re-closeable caps (100, 200, or) 300 is removed from the packaging arrangement 302 of the packaging material web 90, the re-closeable cap 300 remains attached to or outfitted upon the beverage can as generally depicted in FIG. 30A. When provided as part of the packaging arrangement 301, the re-closeable caps 100, 200, and 300 according to the present invention not only function as a protective cover for the outfitted beverage can 10 as provided to the consumer at the time of purchase, but may also be utilized by the consumer as a re-closeable cap for a beverage can 10 later during the time of consumption as discussed in more detail below.

This dual-functionality is of critical importance for the consumer, particularly in view of beverage cans 10 of this type often being brought outdoors for contents consumption. In this regard, it is noted that outside elements are ever-present and debris and/or insects can gain access to an uncovered beverage can 10 through the can opening 3 formed in the beverage can 10 once the scored aperture-forming plate 4 has been depressed or removed from the score line or edge 1. The opening-covering functionality of the re-closeable caps 100, 200, and 300 helps prevent contamination of the container or beverage can 10 contents. In some cases, such contamination can be lethal or fatal to the consumer as in the case of insect bites and the like.

All of the re-closeable caps 100, 200, and 300 may be said to preferably comprise a number of features, including a unibody (one piece), thermoplastic material construction, which unibody is configured to provide a cap rim as at 15 and a cap plate centrally located relative to the cap rim 15. These two structural features are central to the practice of the re-closeable caps 100, 200, and 300. The cap rim 15 operates to enable the user to attach the re-closeable caps to the can rim 8 of the upper can portion of the beverage can 10. The cap plate comprises a number of features that define the primary functionality of the caps 100, 200, and 300, and particularly caps 200 and 300. The cap plate very basically comprises a static structure or portion as at 63, a first dynamic structure or as at 21, and a second dynamic structure or portion as at 39.

The first dynamic structure or portion 21 may otherwise be referred to as a cap swinging structure 21. The first dynamic structure or portion 21 is a movable or dynamic feature according to the present invention that essentially and selectively provides a capping function as well as pivots or swings through space in superior adjacency to the static or stationary static structure 62. The two elements thus move in a clamshell-like manner with the first dynamic structure or portion 21 being the primary movable half of the two-part action for selectively capping an otherwise accessible can opening 3. The first dynamic structure or portion 21 may thus be referred to as a cap swinging structure 21.

The static portion or structure 63 is that stationary portion of the cap plate that remains relatively fixed in place in parallel relation to the can capping plate 7. The static portion or structure 63 may, however, comprise the second dynamic portion or structure 39 preferably defined or otherwise referred to as a swing cover element 39. Similar to the cap swinging structure 21, the swing cover element 39 pivots or swings through space in superior adjacency to the otherwise stationary static portion 63, but in an opposite direction relative to the cap swinging structure 21. The second dynamic structure or swing cover element 39 covers at least a portion of the can opener element 5 and preferably moves in unison therewith during cover-enabled can opening events.

The re-closable caps 100, 200, and 300 all further preferably comprise a lower cap skirt or funnel skirt as at 11; a series of circumferentially spaced outwardly radiating turning nubs as at 12; a series of circumferentially spaced cap-removal grip formations as at 13 preferably aligned with the turning nubs 12; and a recessed cap groove 14 for cooperably mating with the recessed can groove 17. The lower cap skirt or funnel skirt 11 seats down upon the neck portion 9 of the upper can portion when the cap rim 15 receives the can rim 8. The reader will note that standard beverage cans 10 of the type illustrated in the drawing support submitted with these specifications provide a neck portion 9 that extends obliquely relative to the can capping plate 7.

The lower cap skirt 11 according to the present invention similarly preferably extends obliquely relative to the cap plate such that the lower cap skirt 11 parallels the neck portion. The neck portion 9 of the upper can portion preferably comprises an upper neck portion and a lower neck portion defining the upper and lower ends of the oblique, frustoconical region. The lower cap skirt 11 according to the present invention preferably comprises a lower skirt edge as at 16, which lower skirt edge 16 preferably terminates intermediate the upper and lower neck portions for enhancing safe use of the re-closeable caps during cap rotations relative to the upper can portion. In other words, the exposed portion of the neck portion helps space the user's fingers from the lower skirt edge 16 such that rotations against the user's skin of the lower skirt edge become less likely.

The re-closeable caps 100, 200, and 300 may further operate as a spill-prevention barrier and still further to help prevent or retard carbonation leakage from the container contents. There are two primary mechanisms to open the re-closeable caps 200 and 300 for enabling access to container contents held within the beverage can 10, and to re-close the re-closeable caps 200 and 300 for covering or closing the beverage can 10 according to the present invention as discussed in more detail below.

The first option, mechanism or method for opening-closing the re-closeable caps 200 and 300 basically derives primarily from the "flip-flop" or swinging pivot action of the cap swinging structure 21 and secondarily by way of the swinging cover element 39. The first re-closable option named the "flip-flop" option is figuratively depicted in an opening sequence comparatively set forth in FIGS. 7, 7A, 7B and 8 and in a closing sequence comparatively depicted in FIGS. 12, 12A, 12B and 13. This option is believed to be simpler and easier to understand, and mostly protects or covers the beverage can 10 from insects and dirt/debris entering into the beverage can 10 when the cap swinging structure 21 is in a fully retracted, can opening covering state or configuration as generally depicted in FIGS. 14-16A. As an added benefit, the fully retracted cap swinging structure 21 helps to prevent major spillage of beverage from the beverage can 10.

Both the cap swinging structure 21 and the swinging cover element 39 are pivotally attached to the re-closeable caps 200 and 300. The swinging cover element 39 is preferably pivotally attached to the re-closeable caps 200 and 300 at laterally-opposed swinging cover hinges as at 42, the pivot axes of which swinging cover hinges 42 lie within a first mid-lid hinge plane preferably and substantially dividing the anterior half of the cap 300 from the posterior half of the re-closeable cap 300. In the re-closeable cap 200, the swinging cover hinges 42 are preferably provided as pivot points as discussed in more detail in connection with re-closeable cap 200.

The cap swinging structure 21 is preferably pivotally attached to the re-closeable caps 300 and 200 at swinging structure hinges 19, the pivot axes of which hinges 19 lie within a second mid-lid hinge plane preferably and substantially dividing the anterior half of the cap 300 from the posterior half of the caps 300. In the re-closeable cap 200, the swinging structure hinges 19 are preferably provided as two pairs of laterally opposed pivot points as discussed in more detail in connection with re-closeable cap 200.

Figure 17A:
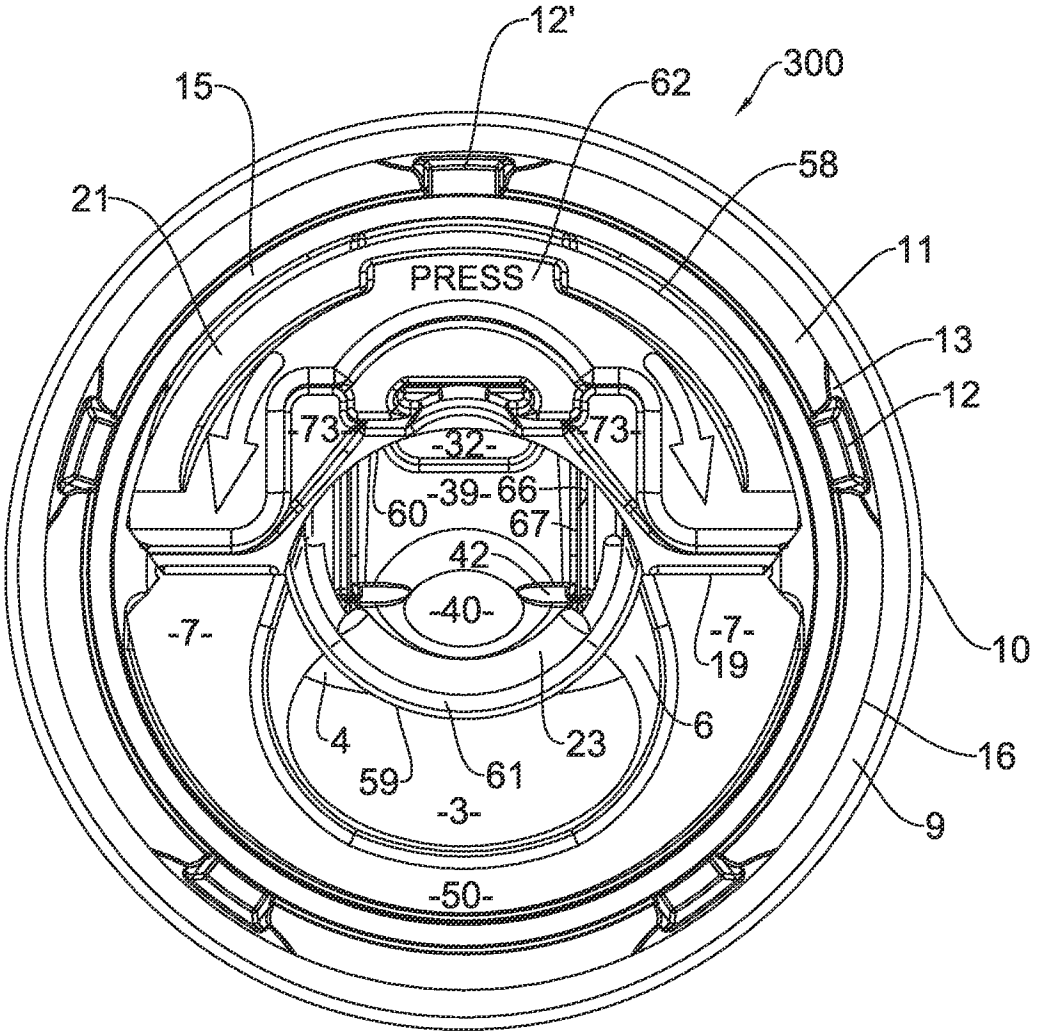
FIG. 17A is a top plan view of a generic beverage can outfitted with the first re-closeable cap according to the present invention showing the cap swinging structure thereof in a fully open, can-opening access state in the optional first state of rotation relative to the beverage can.
Figure 17:
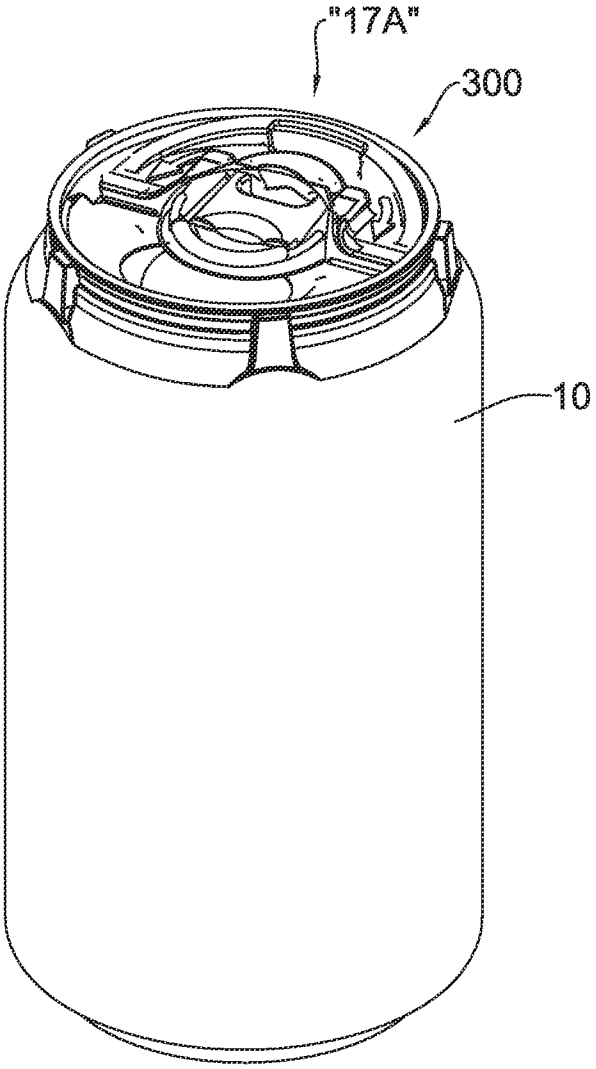
FIG. 17 is a top perspective view of a generic beverage can outfitted with the first re-closeable cap according to the present invention showing the cap swinging structure thereof in a fully open, can-opening access state in an optional first state of rotation relative to the beverage can.
Figure 18A:
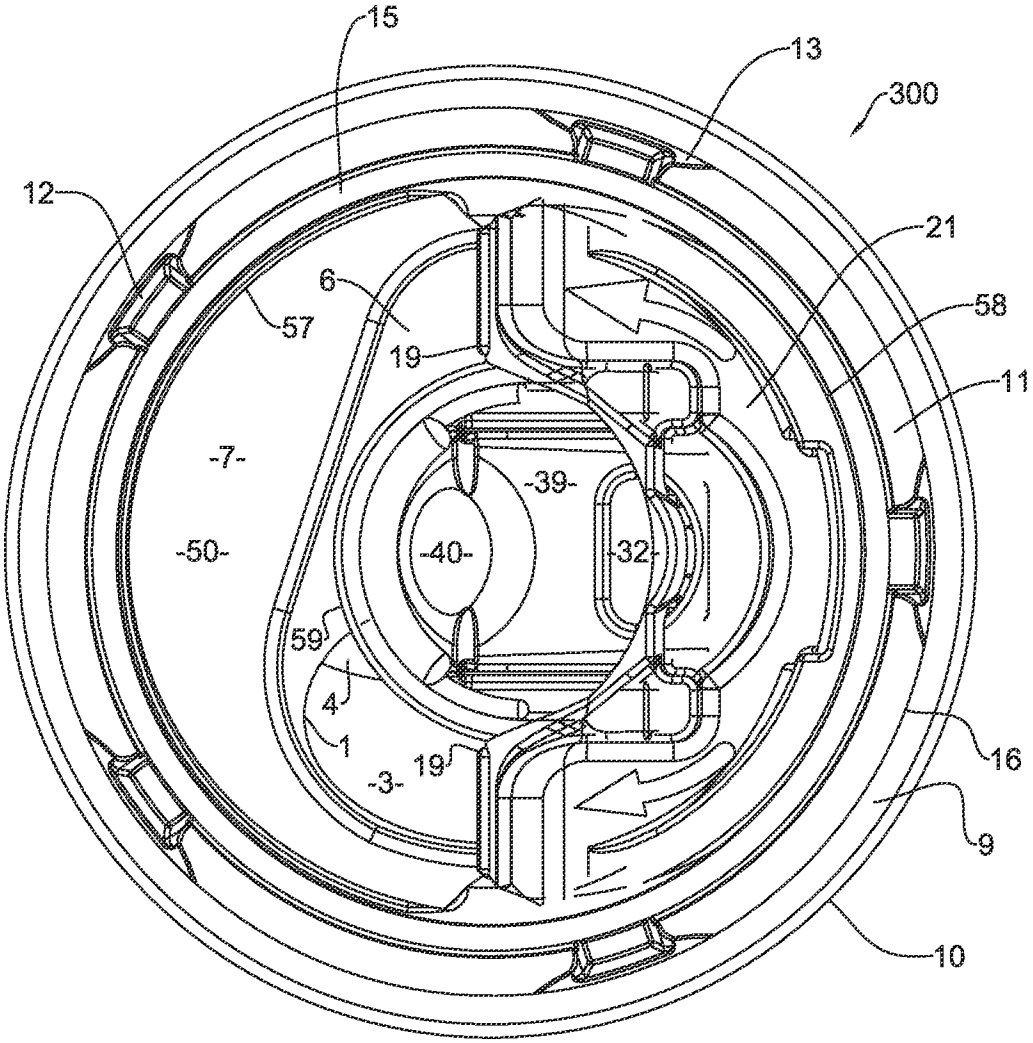
FIG. 18A is a top plan view of a generic beverage can outfitted with the first re-closeable cap according to the present invention showing the cap swinging structure thereof in a fully open, can-opening access state in the optional second state of rotation relative to the beverage can.
Figure 18:
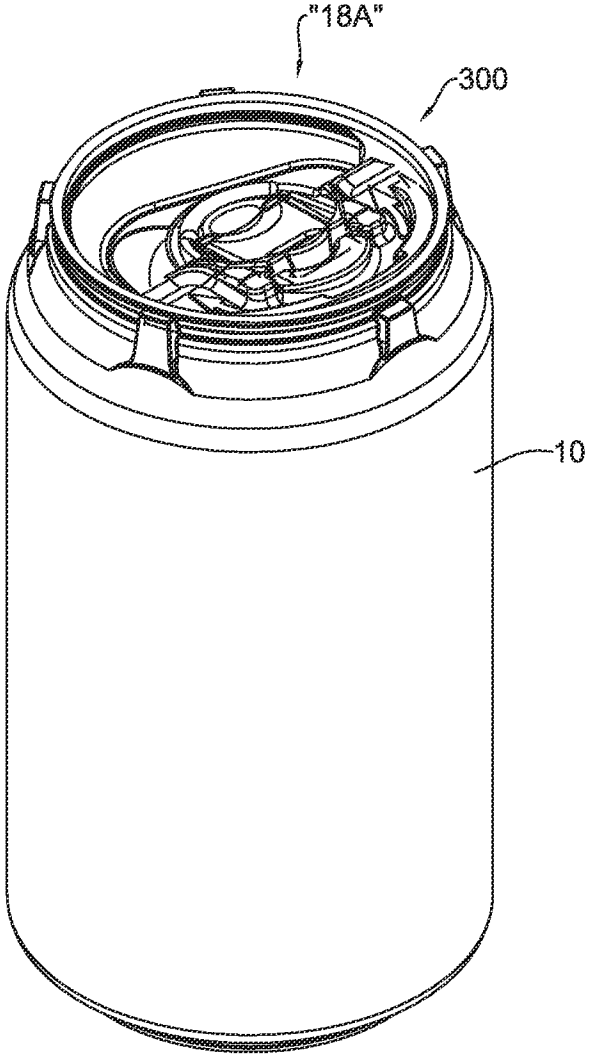
FIG. 18 is a top perspective view of a generic beverage can outfitted with the first re-closeable cap according to the present invention showing the cap swinging structure thereof in a fully open, can-opening access state in an optional second state of rotation relative to the beverage can.

The second option for selectively covering the can opening 3 is generally and comparatively depicted in FIG. 17 through FIG. 19A in connection with re-closeable cap 300. The re-closeable cap 300 may be rotated about the longitudinal axis of the beverage can 10 extending through the turning center 2 by turning the re-closeable cap 300 180 (plus-minus) degrees clockwise or counter-clockwise relative to the can opening 3. One of the benefits of this iteration is that re-closeable cap 300 may be operated so as to place the cap swinging structure 21 into a fully extended can access state as generally depicted in FIGS. 17 and 17A, and proceed to selectively cover the can opening 3 with the static portion or structure 63 or posterior portions of the re-closeable caps 300 by rotating the caps 300 about an axis of rotation without removing the re-closeable caps 300 from the beverage can 10.

As prefaced above, the re-closable caps 100, 200, and 300 and associated packaging arrangements 201 and 301 are preferably constructed from a thinly formed thermoplastic material and provided in web form by a preferred thermoforming process. The benefits of the thermoforming process are primarily the relatively low cost thereof, its aesthetic look, and user friendliness of thermoformed packaging and products. It is noted that materials used in the thermoforming process are usually not structural and thin, which makes it difficult to design thermoformed parts having moving aspects as embodied in the re-closable caps 100, 200, and 300 according to the present invention. Notably, the re-closeable caps 100, 200, and 300 may alternatively be formed by or constructed by way of injection molding, stamping and/or paper-based constructions.

Figure 10:
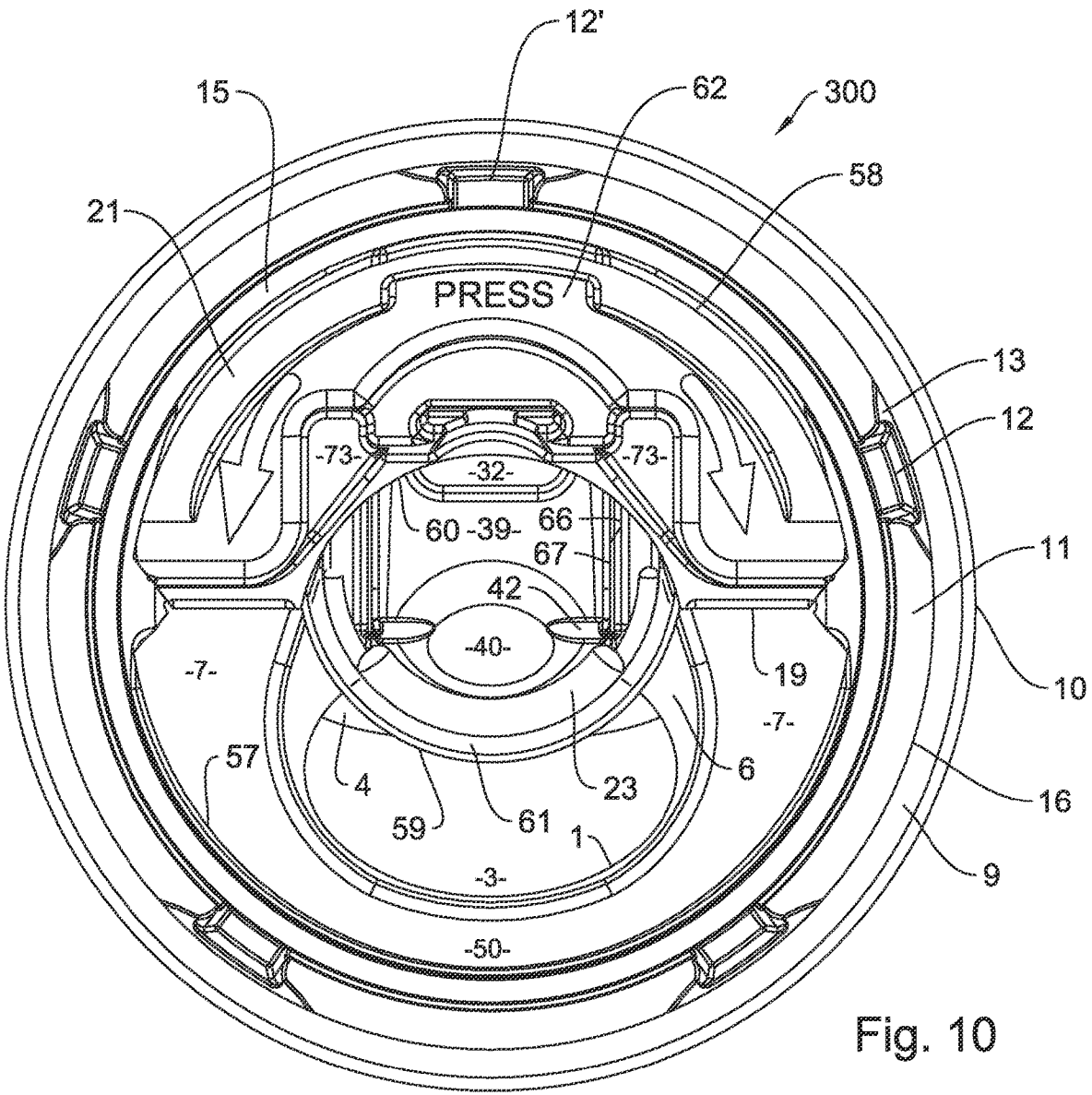
FIG. 10 is a top plan view of a generic beverage can outfitted with the first re-closeable cap according to the present invention showing the cap swinging structure thereof in the fully open state of swing extension for fully uncovering a can opening of the beverage can.
Figure 10A:
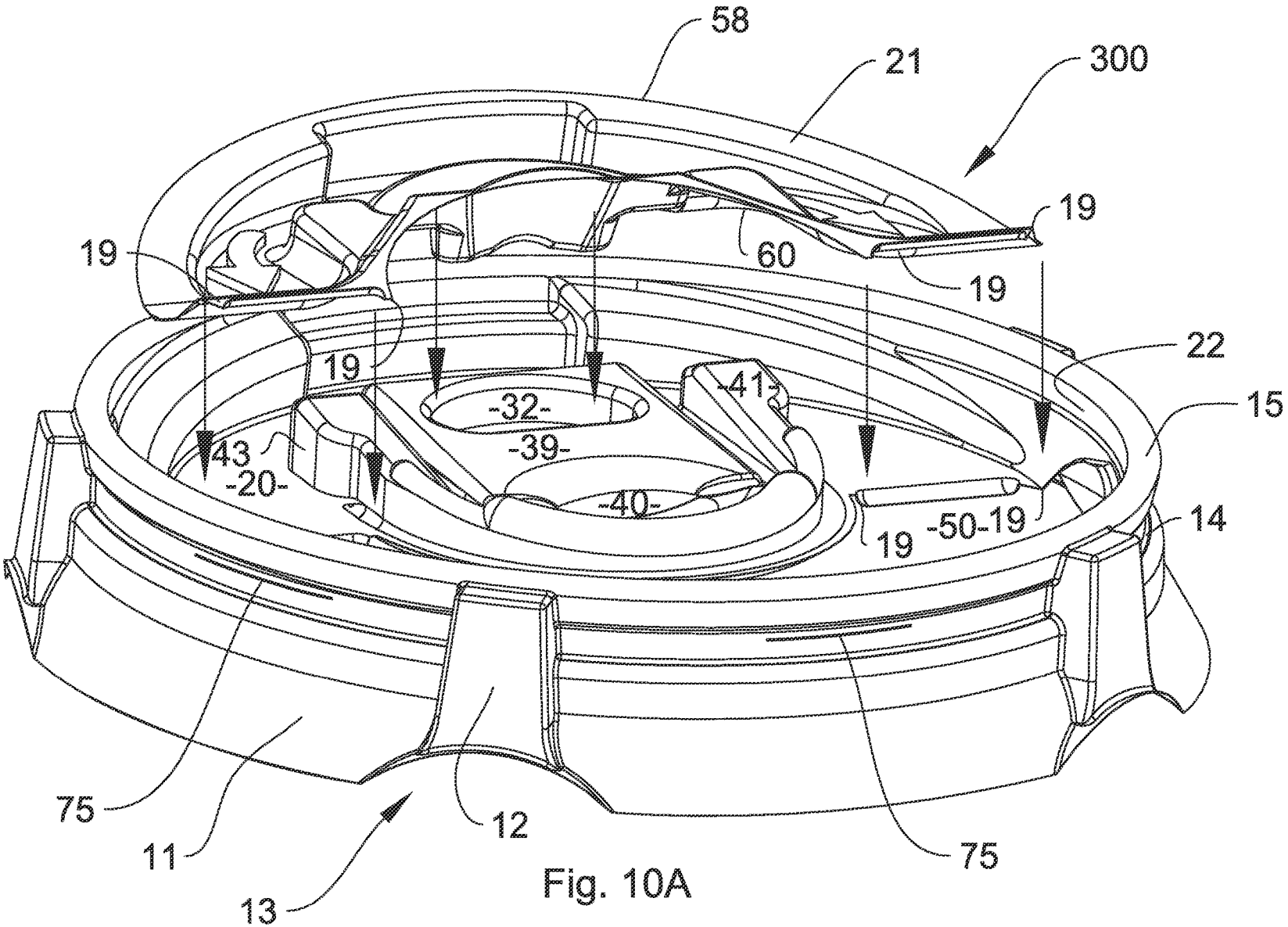
FIG. 10A is a top perspective view of a generic beverage can outfitted with the first re-closeable cap according to the present invention showing the cap swinging structure thereof exploded from the first re-closeable cap for a beverage can and in the fully open state of swing extension.

One of the reasons why the present invention is able to function consistently and reliably is the fact that re-closeable caps 100, 200, and 300 are configured to form a relatively tight grip between the resilient cap rim(s) as at 15 on top of structurally much firmer or rigid can rim(s) 8 and the interlocking relationship of the dynamic anterior portion and the static posterior portion of the caps 200 and 300 as defined by the dynamic cap swinging structure 21 and static posterior structure 63 each of which structures 21 and 63 are provided with multiply spaced interlocking protrusions and depressions for mated engagement with one another as generally depicted in FIG. 10A. When these two structures 21 and 63 are interlocked, the mated engagement thereof creates a highly stable thermoplastic material construction that not only mates well together but further functions as a unified and stable double-layer cover mechanism.

In other words, the double layer of thermoplastic material and the mated engagement thereof allows or enables the manufacturer to create a unique functional mechanism from an otherwise relatively thin and relatively soft single layer of inherently resilient thermoplastic material. The preferred, relatively thin and soft thermoplastic material further allows the formation of the packaging arrangements 201 and 301 with additional benefits to open and close the beverage can 10 without adding cost and enabling cost savings in many instances.

The reader will here note, however, that the interlock-ability of the cap swinging structure 21 with the static portion or structure 63 of re-closeable cap 200 (which embodiment 200 is not necessarily designed to rotate atop the upper can portion) is of secondary importance as compared to the interlock-ability of the cap swinging structure 21 with the static portion or structure 63 of re-closeable cap 300. The re-closeable cap 200 primarily functions with the "flip-flop" function for selectively opening and closing the cap with the rotational option being of secondary importance. The re-closeable cap 200 is designed with a significantly tight fit of the cap rim 15 upon the can rim 8. The reader will further note that re-closeable cap 200 is devoid of can opener access window 69.

Figures 1, 2, 2A:
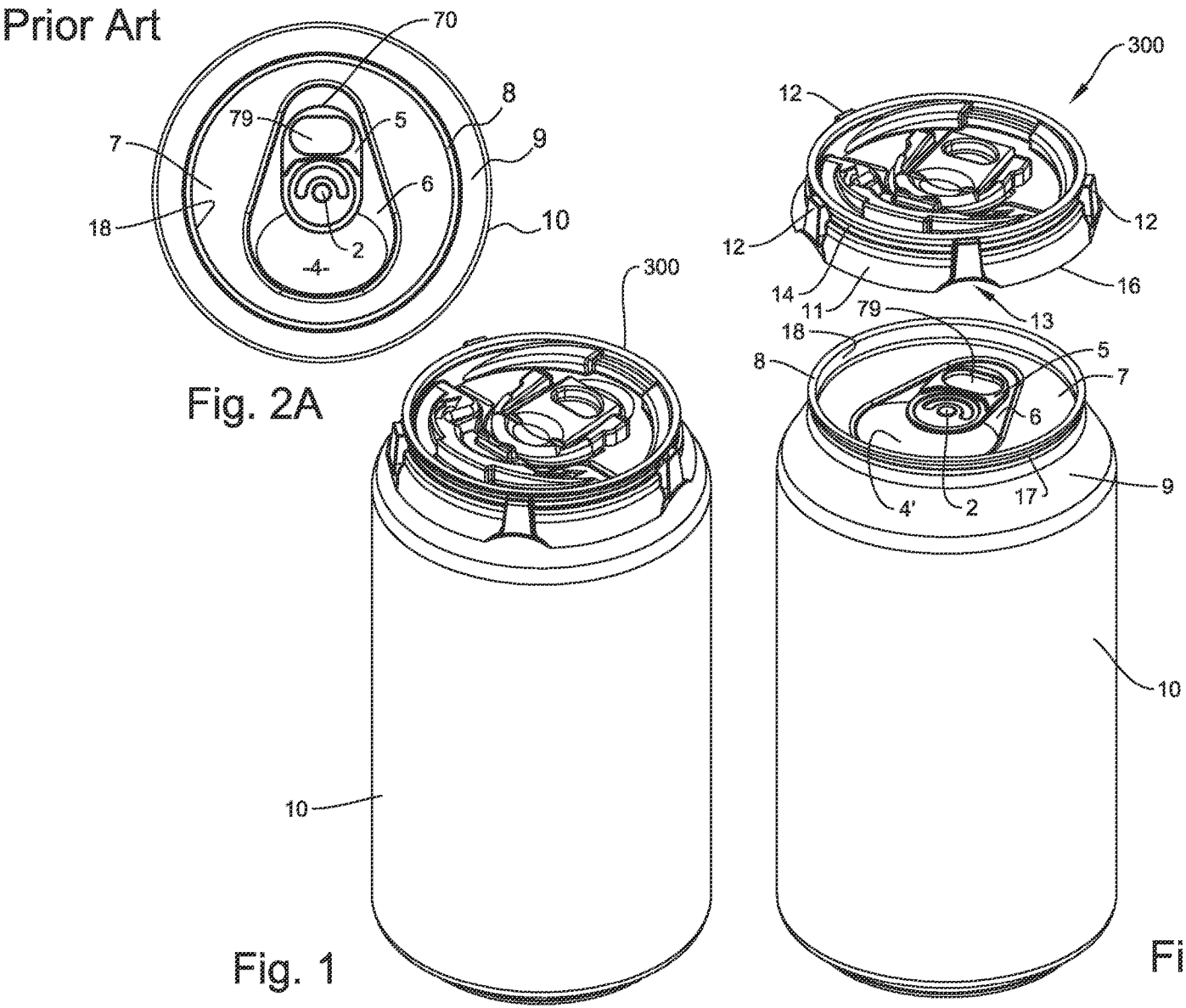
Prior Art Fig. 2A
FIG. 1 is a top perspective view of a generic beverage can outfitted with a first re-closeable cap according to the present invention showing a swinging cover element of the first re-closeable cap for a beverage can in a retracted state.
FIG. 2 is an exploded top perspective view of a generic beverage can outfitted with the first re-closeable cap according to the present invention showing the swinging cover element of the first re-closeable cap for a beverage can in a retracted state.
FIG. 2A is a top plan view of a Prior Art generic beverage can in an unopened state or configuration.
Figure 3A:
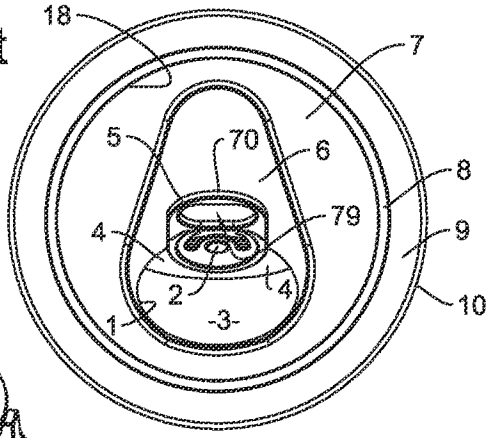
Prior Art Fig. 3A
FIG. 3A is a top plan view of a Prior Art generic beverage can in an opened state or configuration with a can opener element thereof depicted in a can-opening extended state.

It is contemplated that the type of packaging arrangement 301 shown in FIGS. 25-30 and the packaging arrangement 201 shown in FIG. 2 will support the development of other non-carbonated beverages to be provided or packaged in beverage cans 10 of the type generally contemplated typically constructed from aluminum material(s). Note: The reader will note that the re-closeable caps 200 and 300 may preferably dimensioned so as to tightly outfit the can rim 8 to prevent even minimal spillage of beverages of both non-carbonated and carbonated types. The differences in material construction of the beverage can 10 relative to the re-closeable caps 200 and 300 enable added functionality whereby the relatively rigid material construction of the beverage can 10 may operate to actuate however slightly the material construction of the re-closeable caps for enhancing functionality of the caps 200 and 300.

When a user takes a packaged beverage can 10 as typically provided in a 6-pack arrangement as generally depicted in FIGS. 25-30A, the user may remove an individual beverage can 10 from the packaging web material 90 having a series of caps as exemplified by re-closeable caps 300 in FIGS. 25-30A, and particularly depicted in FIG. 30A. The re-closeable caps 100, 200, and 300 may further preferably comprise a cap groove as at 14 that tightly grips, mates or cooperates with the can groove 17. Bearing the cap groove 14 in mind, the re-closeable caps 100, 200, and 300 may further preferably comprise a series of circumferentially spaced undercut formations 74 formed in the cap groove 14 as generally depicted and referenced in FIGS. 32-34 in connection with the second alternative re-closeable cap 100.

The undercut formations 74 essentially provide apertures or slots spaced circumferentially about the periphery of the caps 100, 200, and 300 that further provide undercut edges as at 75. The undercut edges 75 are configured to slide into engagement with the bottom rim edge 76 of the can rim 8 for holding the caps 100, 200, and 300 to the can rim 8 under the bottom rim edge 76 for significantly increasing the grip or hold action of the caps 100, 200, and 300 without adding significant friction in order to make it possible for drinker to still rotate the 100, 200, and 300 as outfitted upon the beverage can 10 by hand if the user so chooses. Simultaneously, the undercuts 74 and the undercut edges 75, as engaged with the bottom rim edge 76, prevents the caps 100, 200, and 300 from coming off of the beverage can 10 when an outfitted beverage can 10 is removed from the arrangement 201 or from the arrangement 301 as in FIG. 30A as the case may be.

Figure 4:
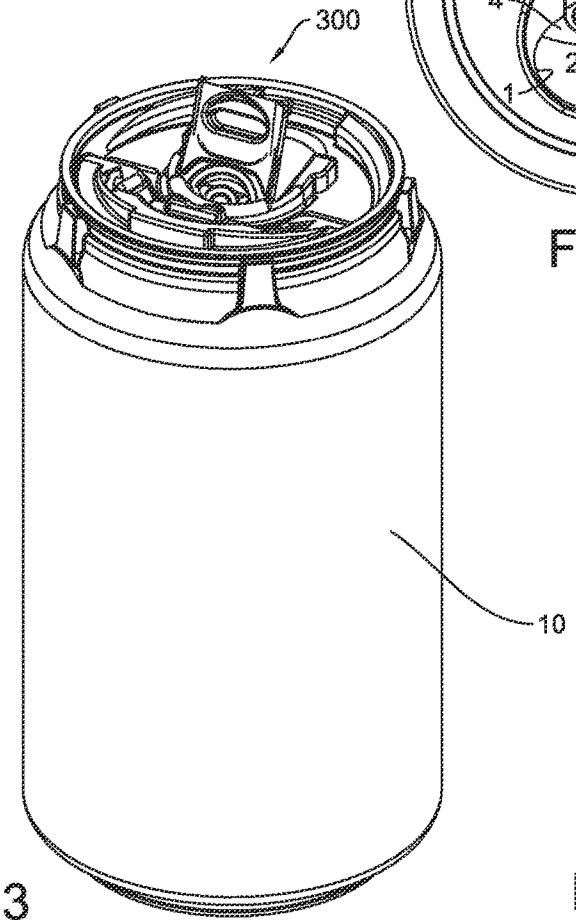
FIG. 4 is a top perspective view of a generic beverage can outfitted with the first re-closeable cap according to the present invention showing the swinging cover element of the first re-closeable cap for a beverage can in an extended state.
Figure 3:
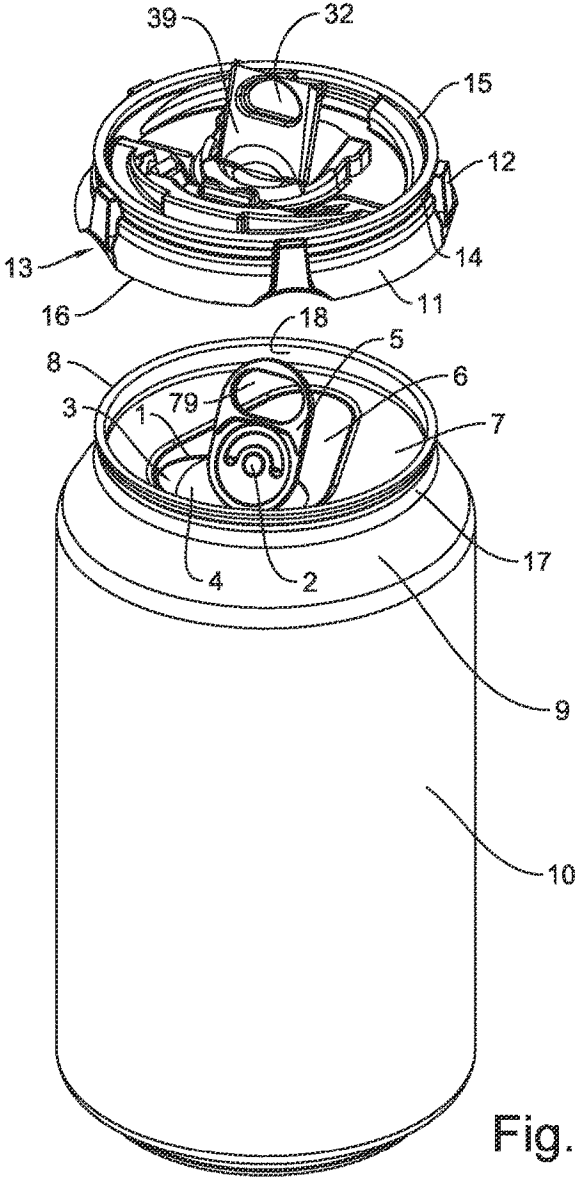
FIG. 3 is an exploded top perspective view of a generic beverage can outfitted with the first re-closeable cap according to the present invention showing the swinging cover element of the first re-closeable cap for a beverage can in the extended state and a can opener element of the beverage can in a can-opening extended state.
Figure 6:
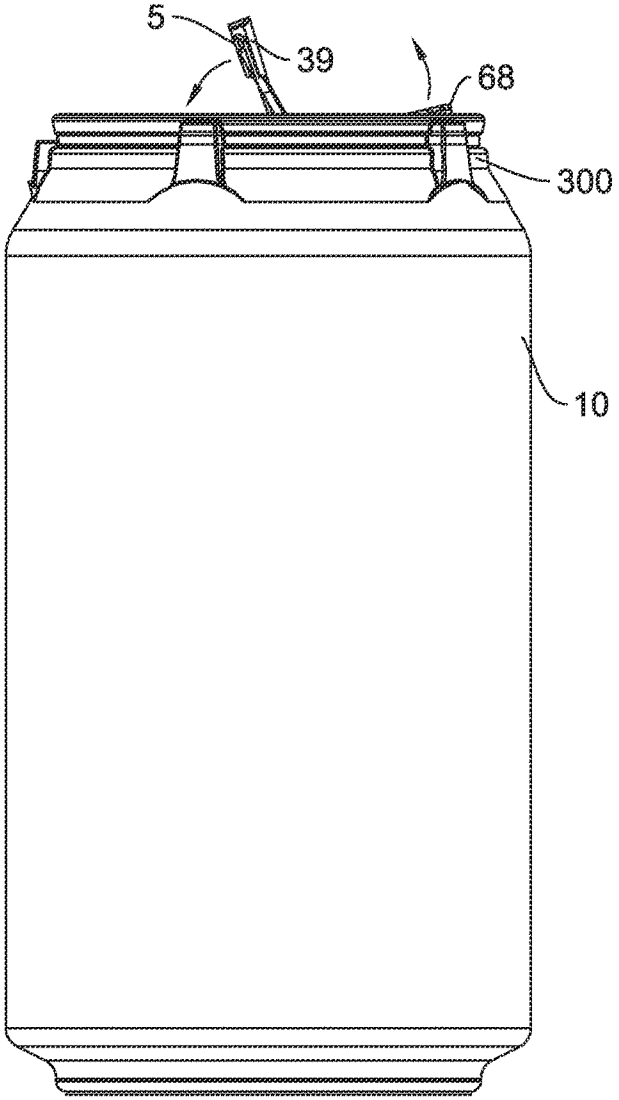
FIG. 6 is a second elevational side view of a generic beverage can outfitted with the first re-closeable cap according to the present invention showing the swinging cover element of the first re-closeable cap for a beverage can coupled to the can opener element of the beverage can being directed into a retracted state.
Figure 5:
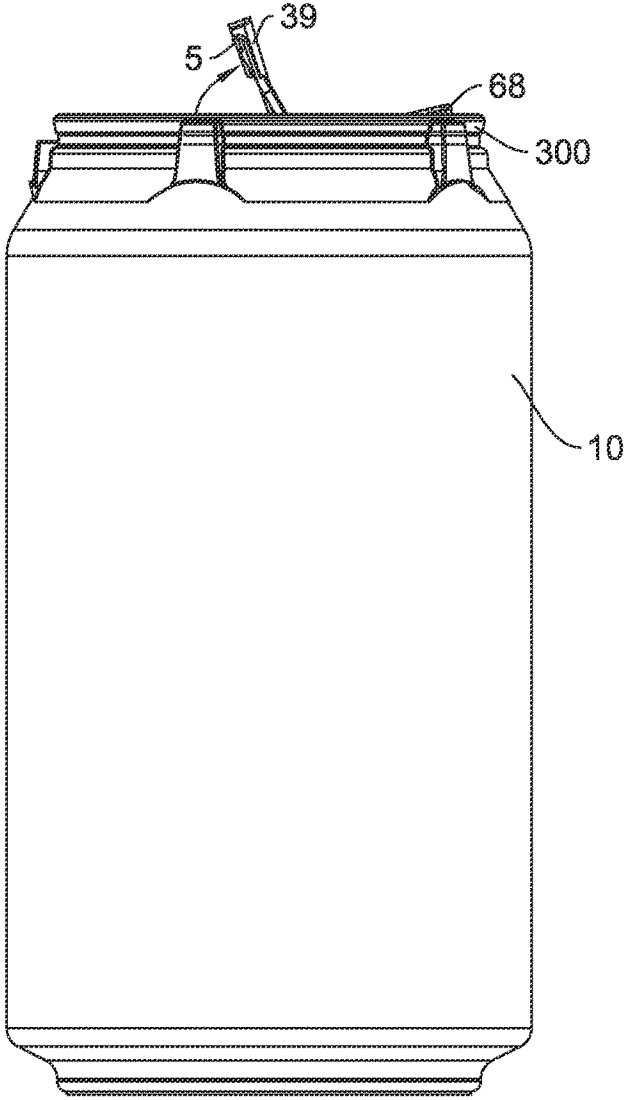
FIG. 5 is a first elevational side view of a generic beverage can outfitted with the first re-closeable cap according to the present invention showing the swinging cover element of the first re-closeable cap for a beverage can coupled to the can opener element of the beverage can being directed into an extended state.
Figure 7A:
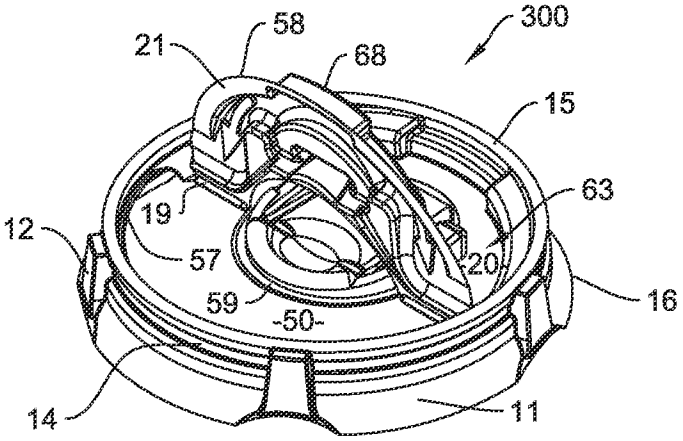
FIG. 7A is a second top perspective view of the first re-closeable cap according to the present invention showing the cap swinging structure thereof in a second state of swing extension.
Figure 7B:
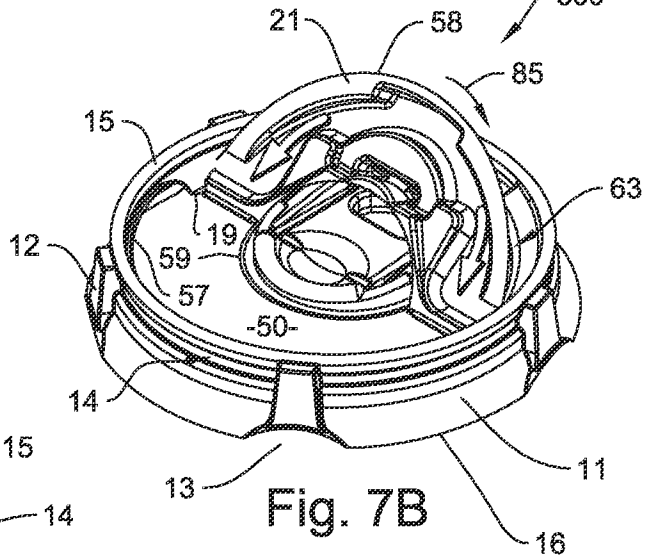
FIG. 7B is a third top perspective view of the first re-closeable cap according to the present invention showing the cap swinging structure thereof in a third state of swing extension.
Figure 8:
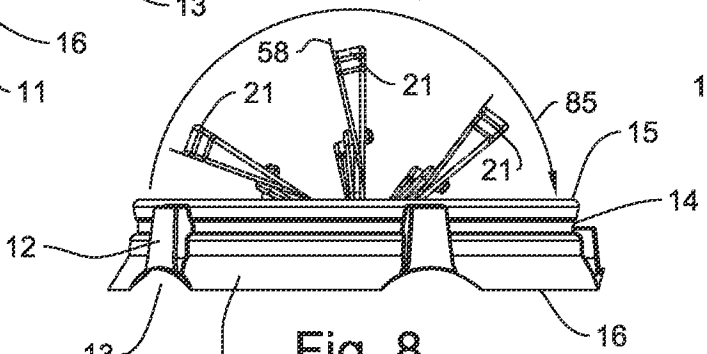
FIG. 8 is an edge view of the first re-closeable cap according to the present invention showing the cap swinging structure thereof in broken lining in the first, second, and third states of swing extension.
Figure 7:
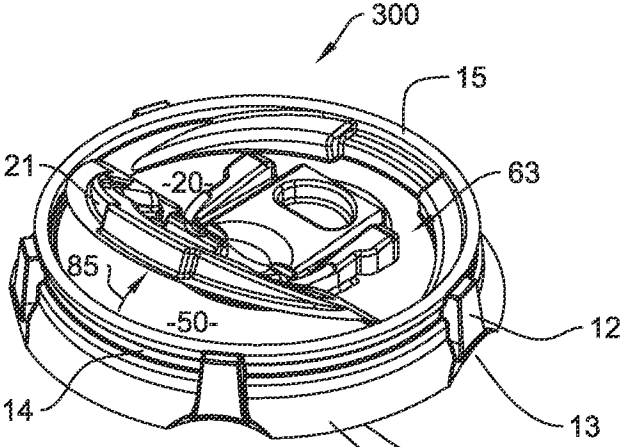
FIG. 7 is a first top perspective view of the first re-closeable cap according to the present invention showing a cap swinging structure thereof in a first state of swing extension.
Figure 22:
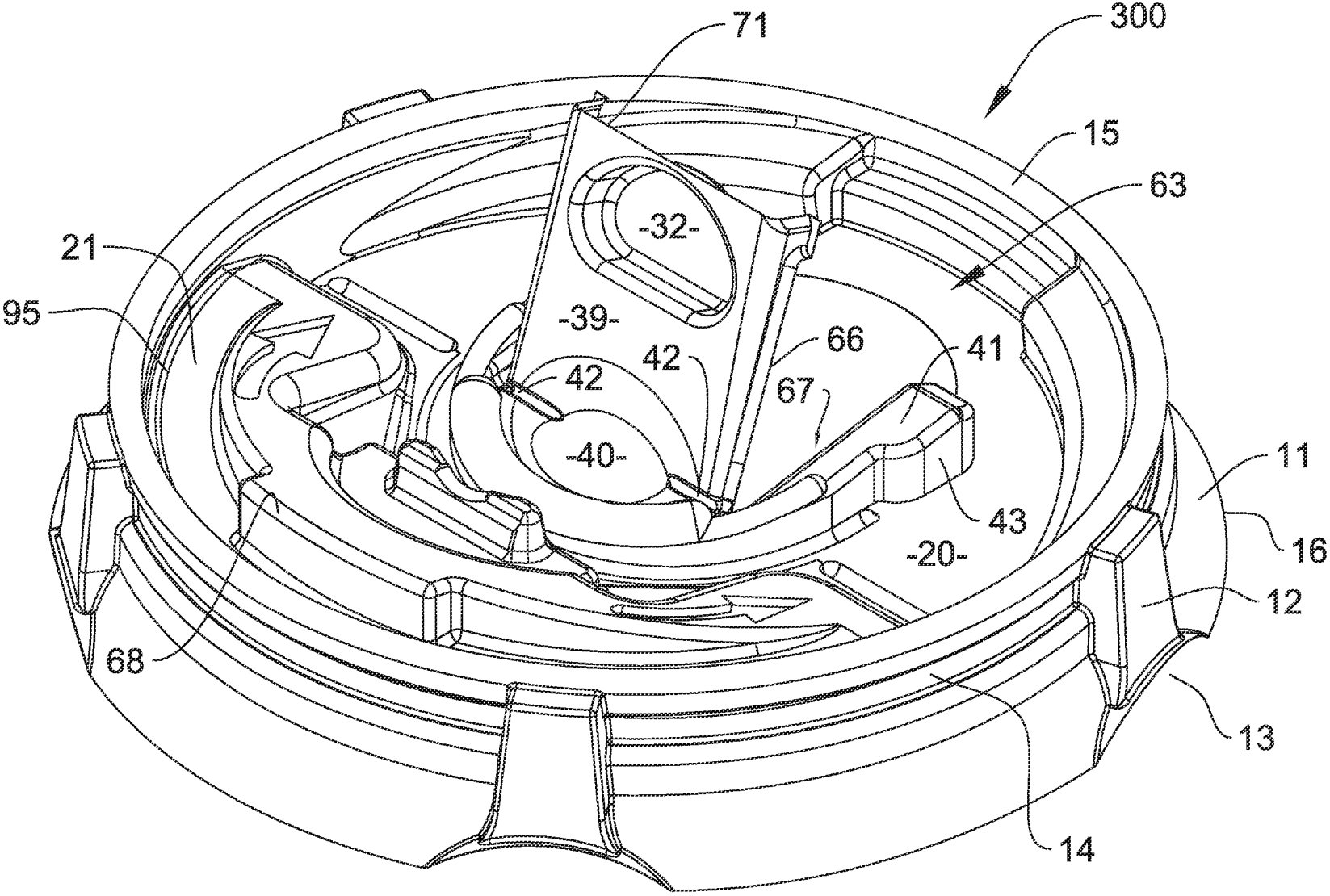
FIG. 22 is an enlarged top perspective view of the first re-closeable cap according to the present invention showing the swinging cover element thereof in an extended state and the cap swinging structure in a retracted stated.
Figure 22A:
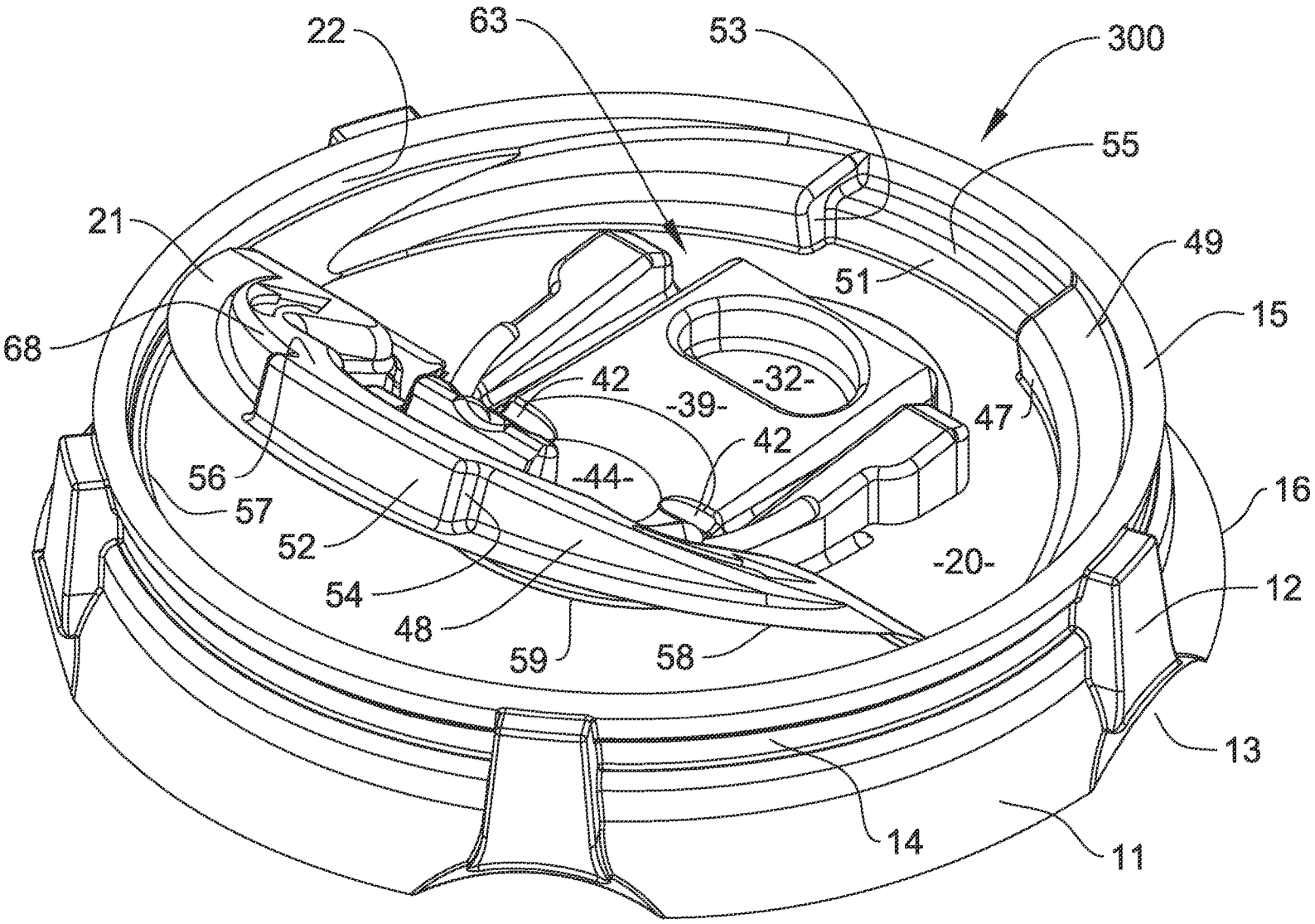
FIG. 22A is a first enlarged top perspective view of the first re-closeable cap according to the present invention showing the swinging cover element thereof in a retracted state and the cap swinging structure in a first extended state.
Figure 23:
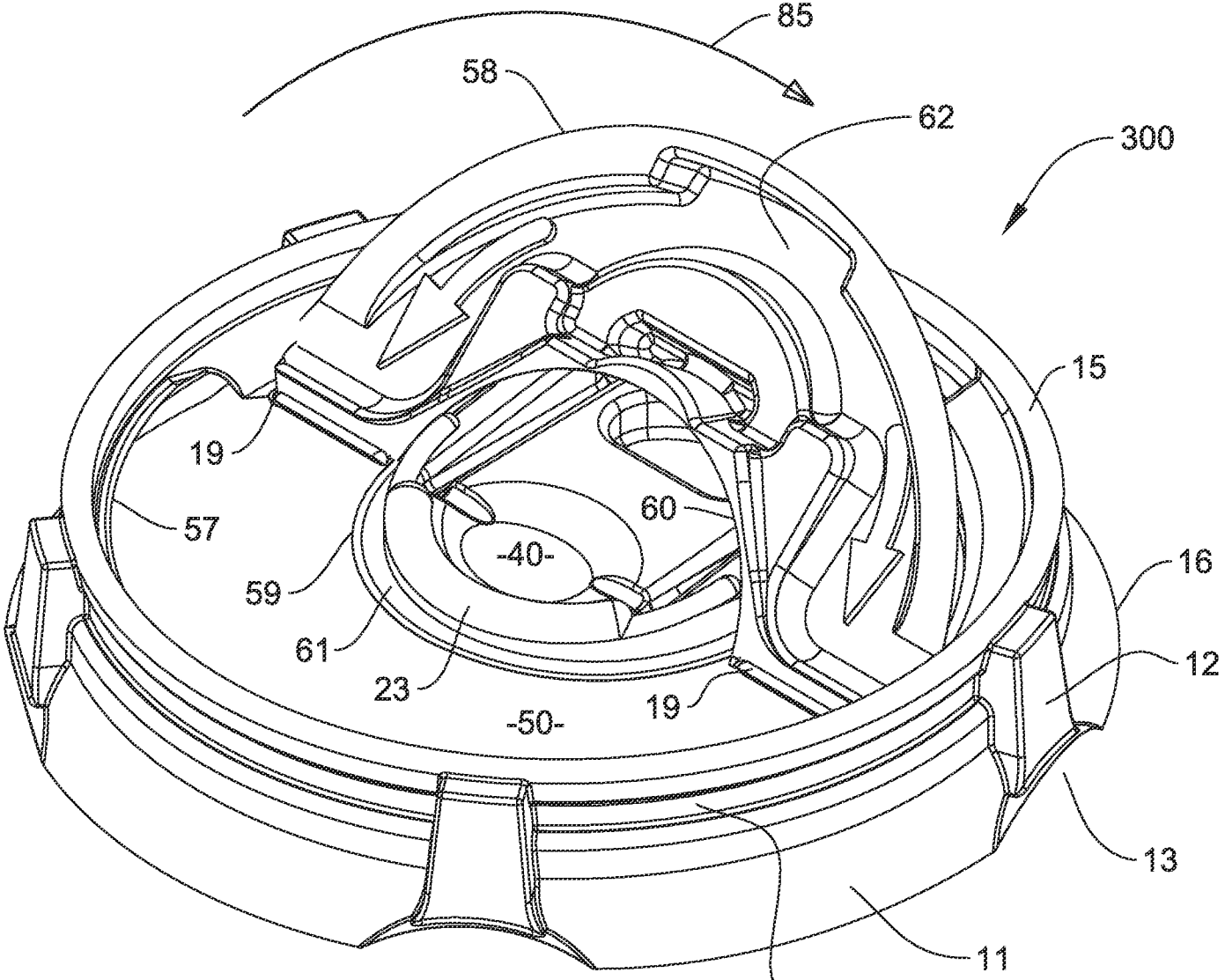
FIG. 23 is a second enlarged top perspective view of the first re-closeable cap according to the present invention showing the swinging cover element thereof in a retracted state and the cap swinging structure in a second extended state.
Figure 24:
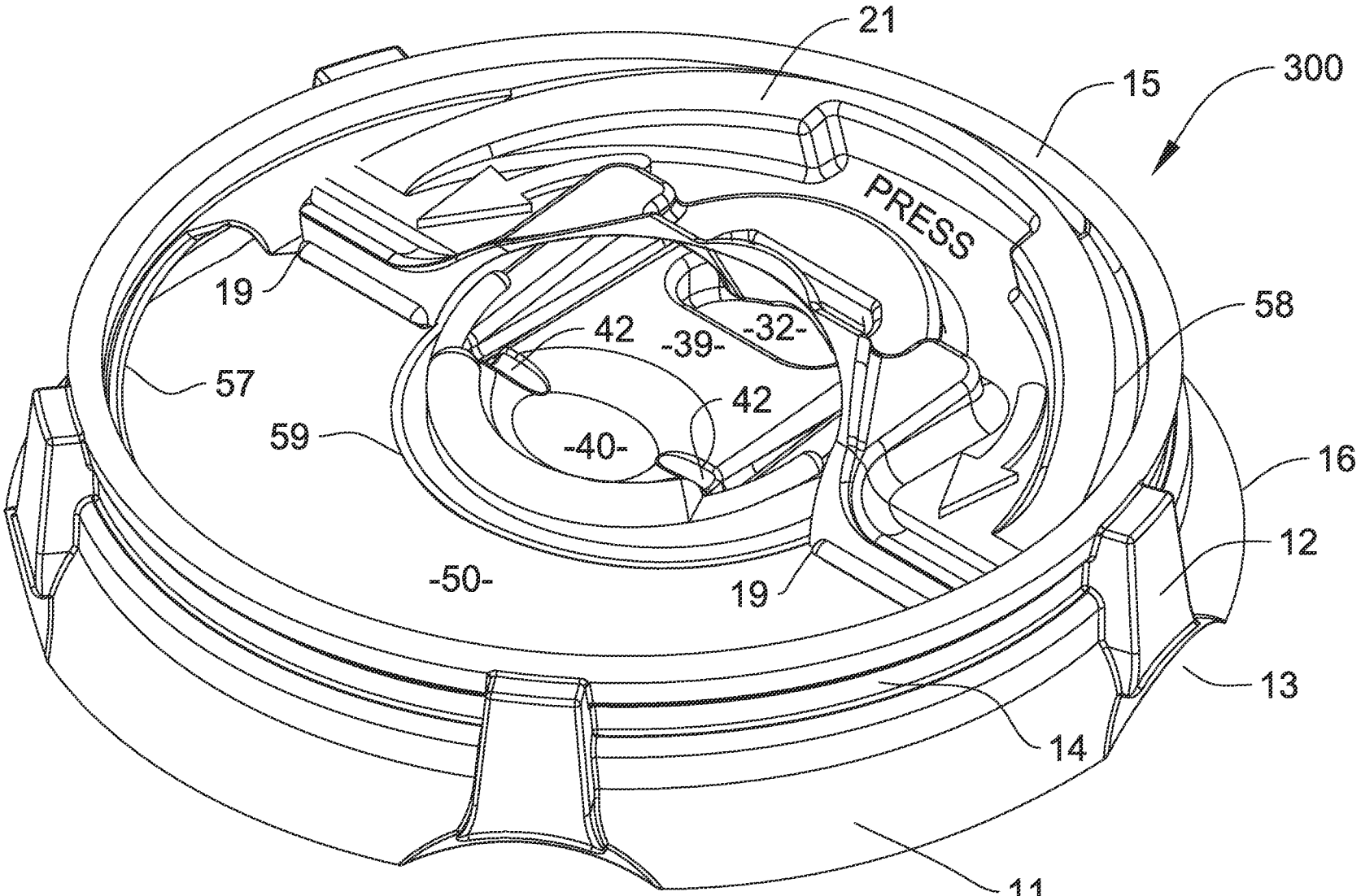
FIG. 24 is an enlarged top perspective view of the first re-closeable cap according to the present invention showing the cap swinging structure thereof in the fully open state of swing extension.
Figure 25:
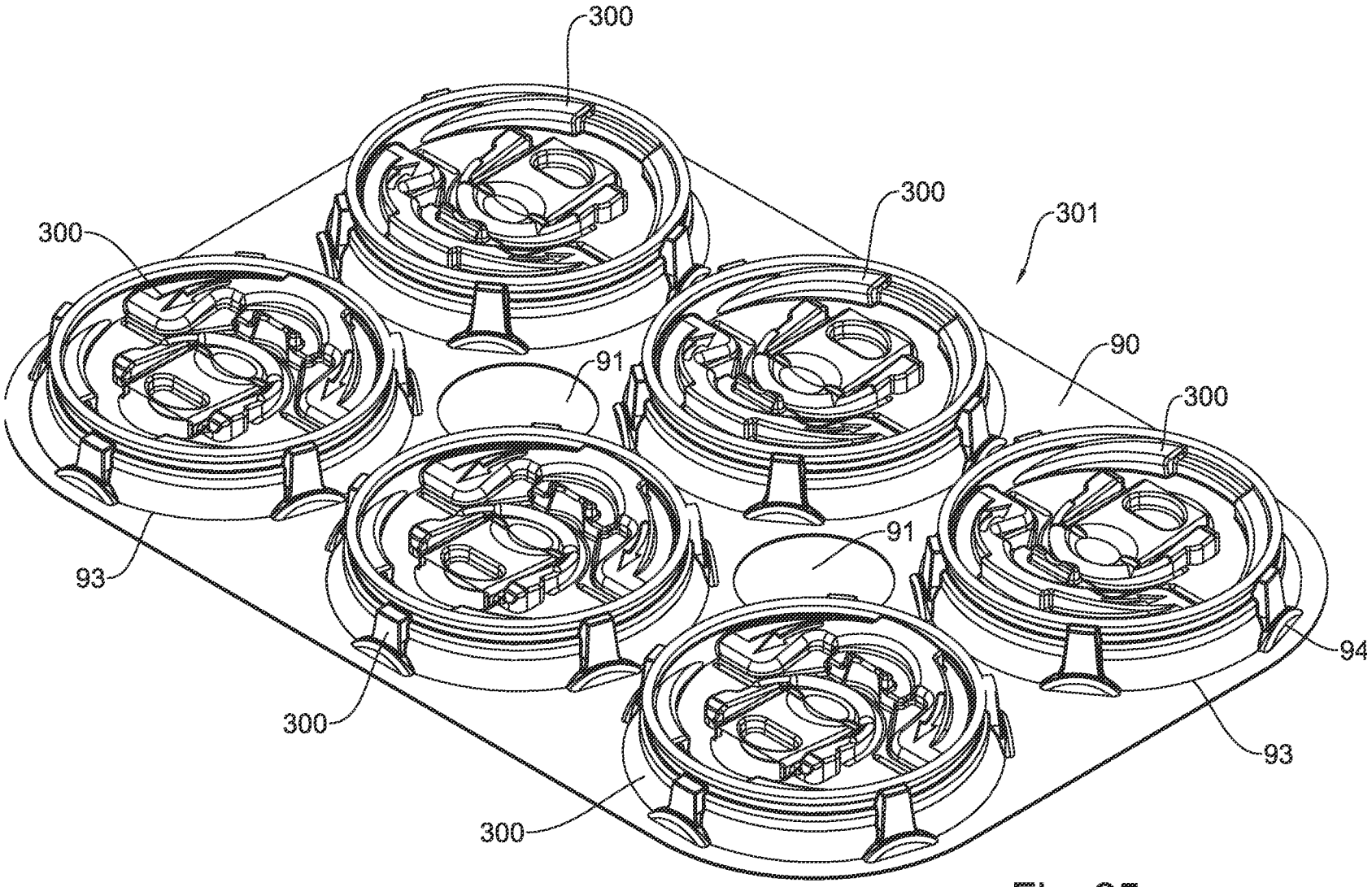
FIG. 25 is a top perspective view of a first alternative re-closeable cap packaging arrangement according to the present invention showing a series of six first re-closeable caps according to the present invention formed in a packaging material web.
Figure 26:
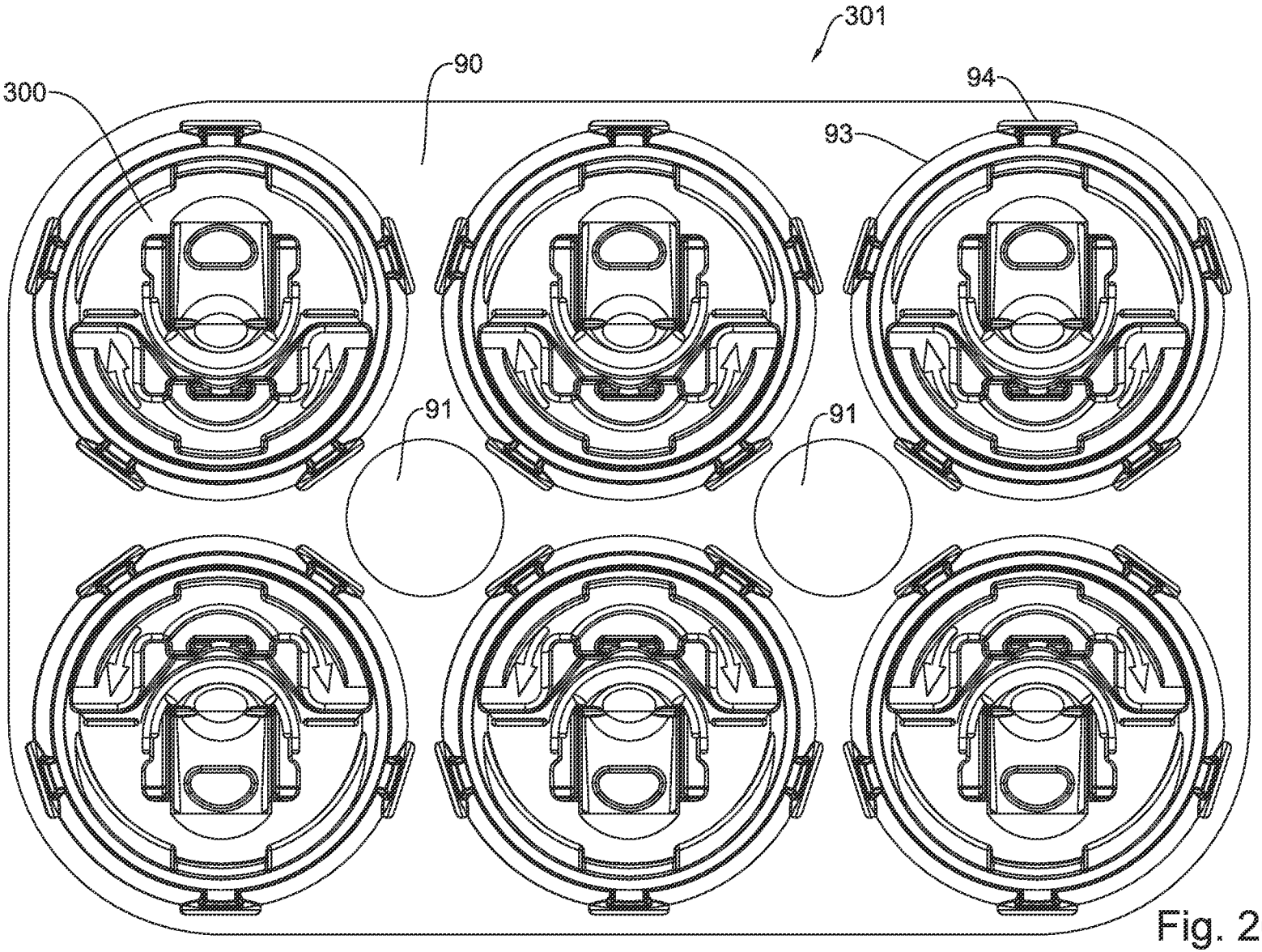
FIG. 26 is a top plan view of the first alternative re-closeable cap packaging arrangement according to the present invention showing a series of six first re-closeable caps according to the present invention formed in a packaging material web.

In the next step, the user may open the outfitted beverage can 10 by way of the standard can opener element 5 or opener assembly. In this regard, the reader will note that the standard can opener element 5 preferably comprises a slot or window as at 79. The finger-grabbing outer edge 70 of the can opener element 5 is accessible via the can opener window 69 and under the top edge 71 of the swing cover element 39. In other words, the finger-grabbing outer edge 70 is visible and accessible under top edge 71 via the window 69 to provide the user with a good grip access by his or her fingertip in order to open the beverage can 10 as has become standard in the art. The can opener element 5 and the swing cover element, preferably mated to one another, move in unison as the user pulls up on the can opener element as generally depicted in FIGS. 4 and 22.

The re-closeable caps 200 and 300 may further preferably comprise a finger depression feature as at 40. The finger depression feature 40 preferably overlaps the first dynamic portion and the static portion for enabling the user to depress the same to selectively actuate the first and second dynamic portions. In other words, the fingertip depression 40 aids the user to direct a fingertip therein to direct force into the end of the can opener element opposite the outer edge 70.

Figure 16A:
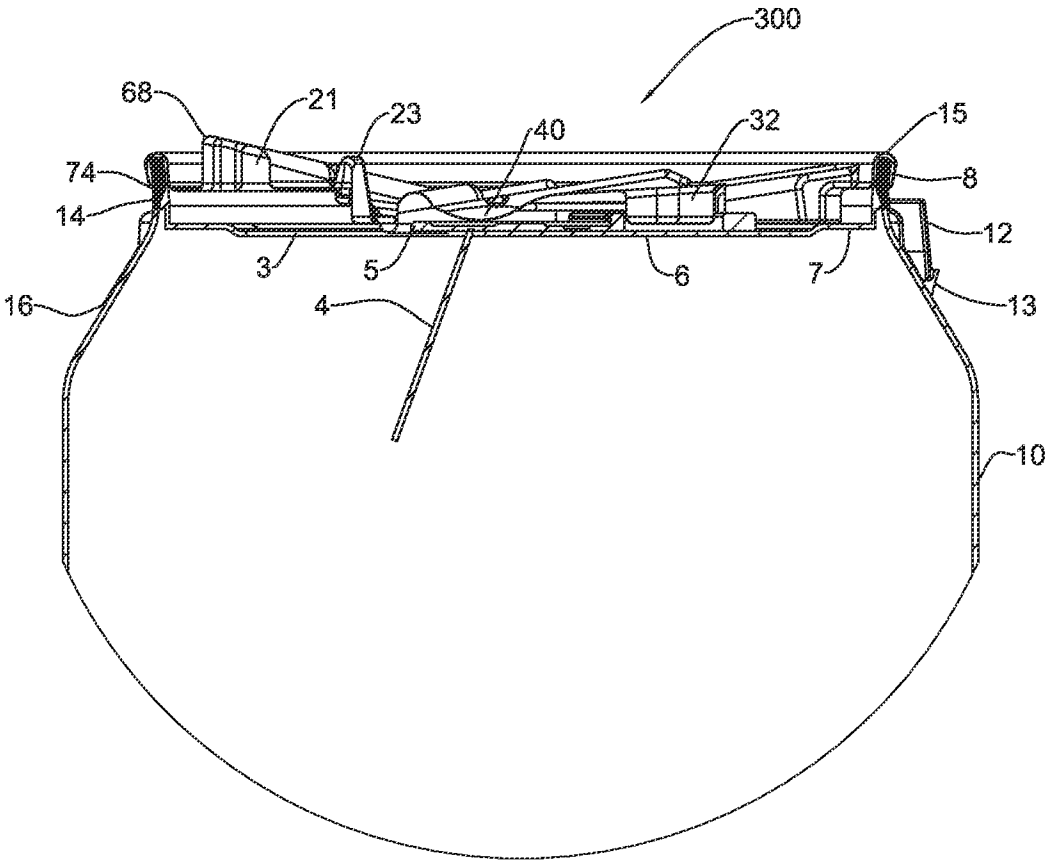
FIG. 16A is an enlarged, fragmentary section view as enlarged and sectioned from FIG. 16 to show in greater detail the first re-closeable cap according to the present invention as outfitted upon a generic beverage can.
Figure 16:
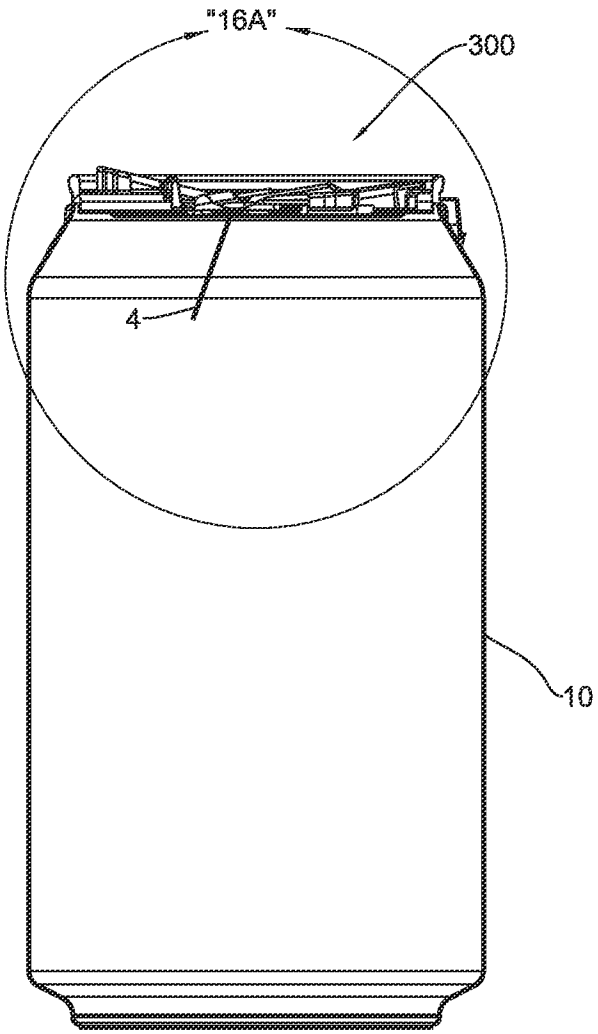
FIG. 16 is a longitudinal cross-sectional view of the first re-closeable cap according to the present invention as outfitted upon a generic beverage can as sectioned from FIG. 15 to showing the cap swinging structure thereof in a fully retracted, can opening-covering state and the can opening plate of the beverage can extending downwardly within the beverage can.

The swinging cover element 39 covers the can opener element 5 and moves in the same manner as or in unison with the can opener element 5 to enable the user to open the beverage can 10 by depressing the scored plate 4 for forming the can opening 3. The lock-receiving protrusion 32 of the swinging cover element 39 fits into can opener gap 79 and preferably mates therewith as generally and comparatively depicted in FIGS. 3-6. After the beverage can 10 is opened, the can opener element 5 interlocks with the swinging cover element 39 and may be pushed back or retracted into a flattened state as usually is done once a beverage can 10 is opened as generally depicted in FIGS. 14-16A. At that moment the can opening 3 is covered by the cap swinging structure 21 of the re-closable cap 300 as generally depicted in FIG. 16A.

Figure 9:
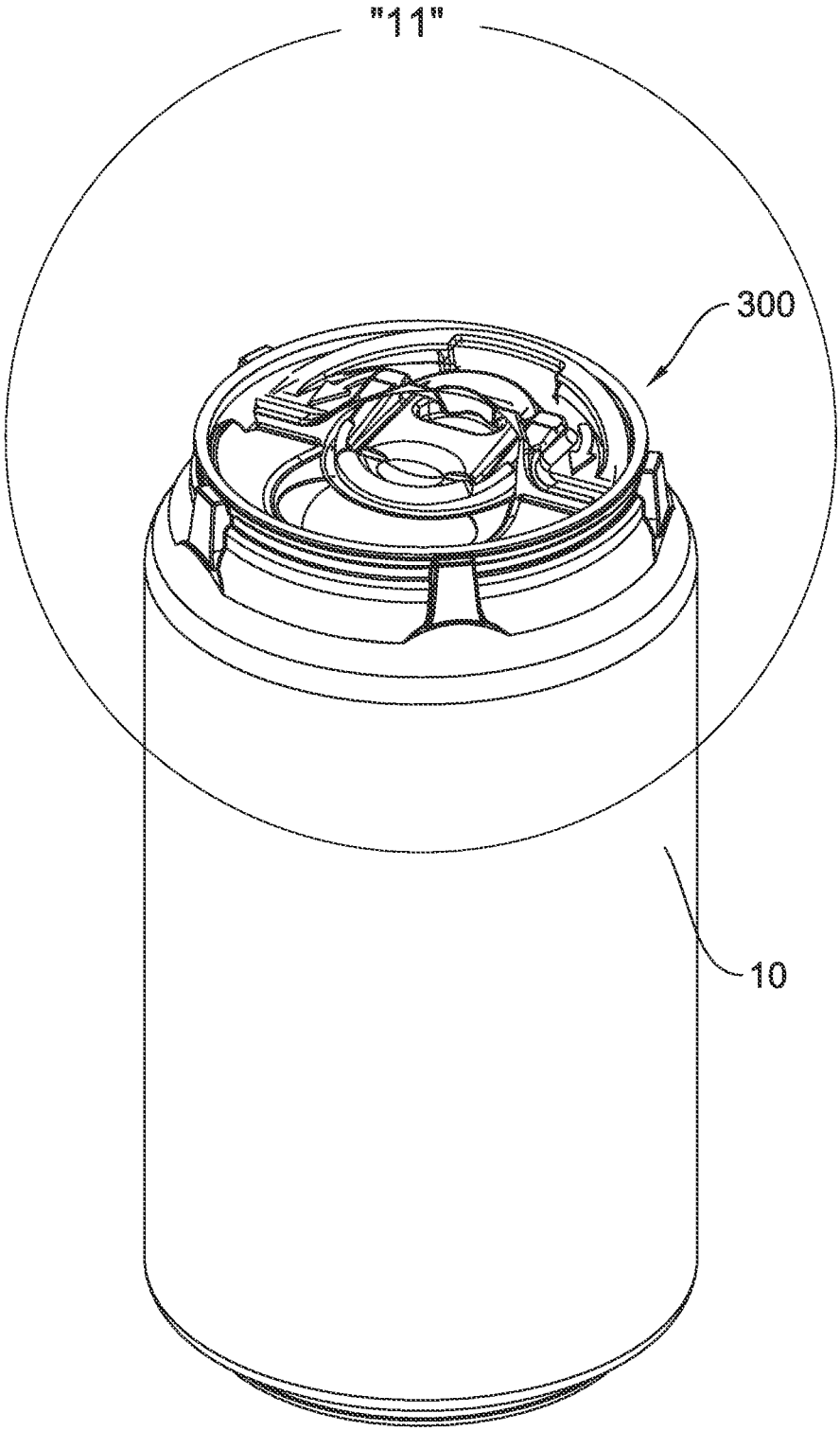
FIG. 9 is a top perspective view of a generic beverage can outfitted with the first re-closeable cap according to the present invention showing the cap swinging structure thereof in a fully open state of swing extension.

Comparatively referencing FIGS. 1 and 7-10, the user may then lift the cap swinging structure 21 (as optionally initiated by the finger depression feature 40) from a fully-retracted, can-opening covering state (as depicted in FIG. 1), and pivot the cap swinging structure 21 about the pivot axis defined by swinging structure hinges 19 so as to re-position the cap swinging structure 21 in a fully-extended or fully open can-opening access state as generally depicted in FIGS. 9 and 10. The user may lift up the cap swinging structure 21 by gripping it with a fingertip as at the tip or edge 68 or groove 82 of the cap swinging structure 21.

Once the user engages the tip or edge 68 and lifts the tip or edge 68, the cap swinging structure 21 pivots about the pivot axis defined by the swinging structure hinges 19, and may be pivoted to a fully extended or fully open can-opening access state whereby a lock (depression 55) formed in the raised, arcuate locking structure 49 of the re-closeable cap 300 mates with the a key structure 56 formed at the tip or edge 68 of the cap swinging structure 21. The swinging structure hinges 19 are preferably living hinge mechanisms whereby the material construction bends back and forth maintaining some inherent internal resistivity, which internal resistivity allows the cap swinging structure 21 to actually spring up when the lock depression 55 of the raised, arcuate locking structure 49 releases the key structure 56 of the cap swinging structure 21.

To release the key structure 56 from the lock depression 55 of the static portion 63 of the re-closable cap 300, the user may depress the back side 62 of the key structure 56. Before the act of finger-depressing the back side 62 to release the mated engagement of the key structure 56 and the lock depression 55, the corresponding male and female features of the two mated portions (comprising the pivotable or dynamic, cap swinging structure 21 and the static portion 63) are interlocked as generally depicted in FIG. 17A. From a consideration of FIG. 17A, it will be seen that the cap opening 50 is fully open and the can opening 3 is exposed. Beverage contained within the outfitted beverage can 10 may then be readily consumed by way of the can opening 3 and cap opening 50.

The interlocking mechanism of the cap swinging structure 21 and the static portion 63 may be further preferably defined or described in connection with certain peripheral support features. In this regard, the front wall 48 of the swinging structure 21 may be pressed against the front wall 47 of the locking structure 49. At the same time the back wall 46 of the lever receiving depression 72 may be pressed against the back sides 45 of the laterally opposed lever 41 for creating directional frictional forces in opposite directions.

Both side walls 43 of laterally opposed levers 41 are squeezed between side walls 44 of the lever-receiving depression 72 pushing the edge 67 of can opener window or gap 79 against side edge 66 of the swinging cover element 39, making a tight seal between these two edges 66 and 67. The can opener element 5 firmly stays between these relatively strong structures created by interlocking the lever-receiving depression 72 and the structural lever(s) 41. The lock-receiving protrusion 32 further tightly fits into the can opener window or gap 79. Lock 33 tightly fits into or mates with the lock-receiving protrusion 32 and the lock support step 64 presses against the swinging cover element 39 at the same time it presses against the edge 70 of the can opener element 5.

Figure 19A:
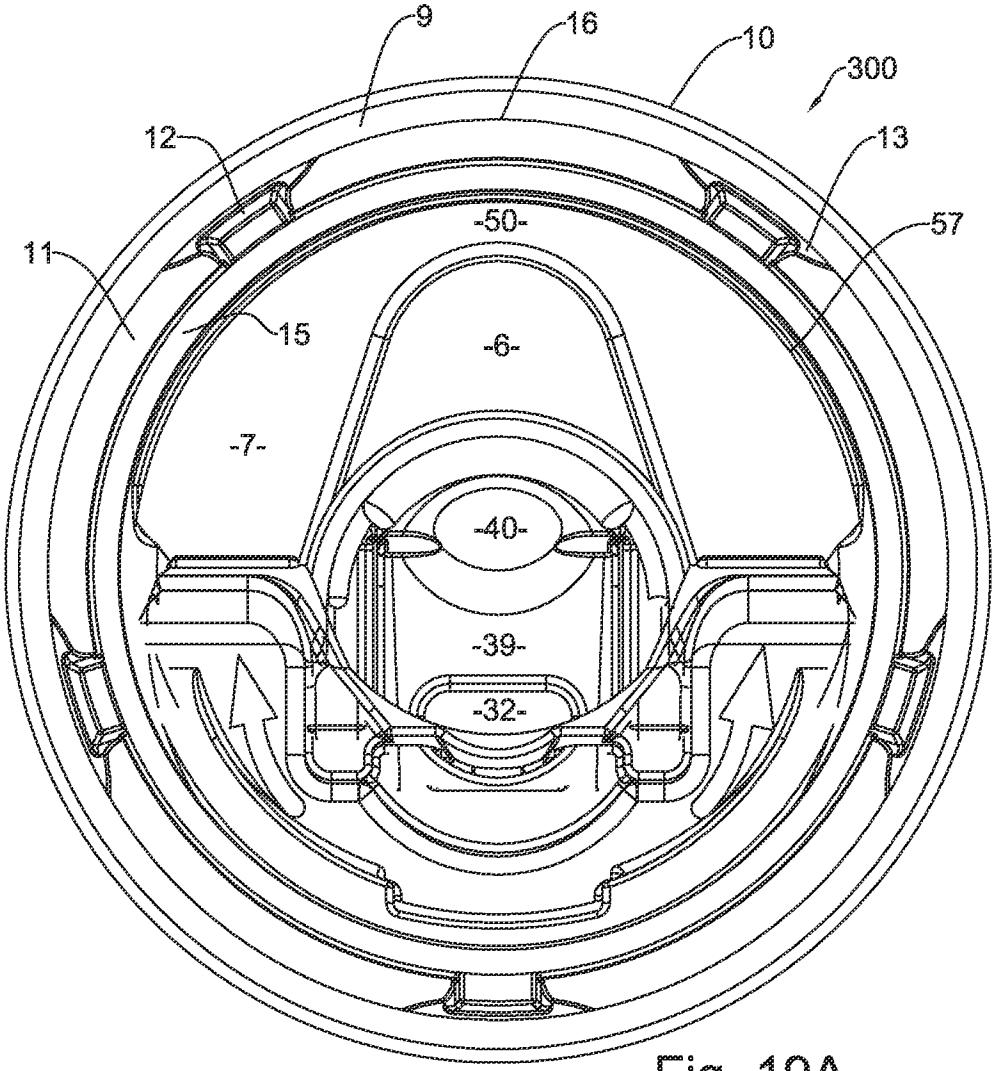
FIG. 19A is a top plan view of a generic beverage can outfitted with the first re-closeable cap according to the present invention showing the cap swinging structure thereof in a fully open, can-opening access state in the optional third state of rotation relative to the beverage can.

At the same time, both sides of the lock support 64 press against inner walls 65 of the structural levers 41 as counterbalance to pressure from the engagement of side wall 44 of the lever-receiving depression 72 and side wall 43 of the structural lever 41. The secure interlocked relationship between the dynamic cap swinging structure 21 and the static portion 63 is important for exercising the option of enabling can opening access and coverage by rotating the re-closeable cap 300 180 degrees relative to the can opening 3 and for further preventing beverage from passing through gaps. Also, these structural arrangements help form a seal between the cap depression 20 and the can capping plate 7 when rotated to a can opening cover configuration as generally depicted in FIG. 19A. The reader will note that side edge 66 and edge 67 are created as a result of a cut through a unibody material construction thereby providing a tight fit when these two edges 66 and 67 are pressed against one another.

When interlocking the dynamic cap swinging structure 21 to the static portion 63, the key structure 56 of the cap winging structure 21 is pressed into the lock depression 55 of the locking structure 49. The front wall 52 of the key structure 56 presses against the front wall 51 of the lock depression 55 of the locking structure 49. The side walls 54 of the key structure 56 are squeezed between the side walls 53 of the lock depression 55 of the locking structure 49. The front portion of the structural levers 41 are connected by the arch of the can opener-engaging protrusion 23 of which flange 61 is an extension.

Figure 19:
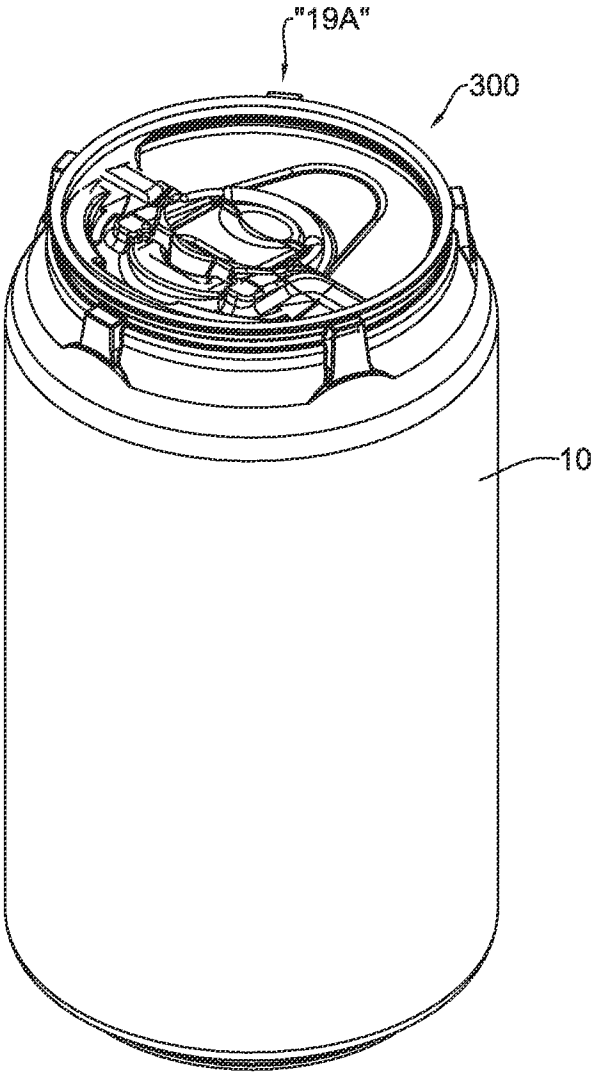
FIG. 19 is a top perspective view of a generic beverage can outfitted with the first re-closeable cap according to the present invention showing the cap swinging structure thereof in a fully open, can-opening access state in an optional third state of rotation relative to the beverage can.
Figure 20:
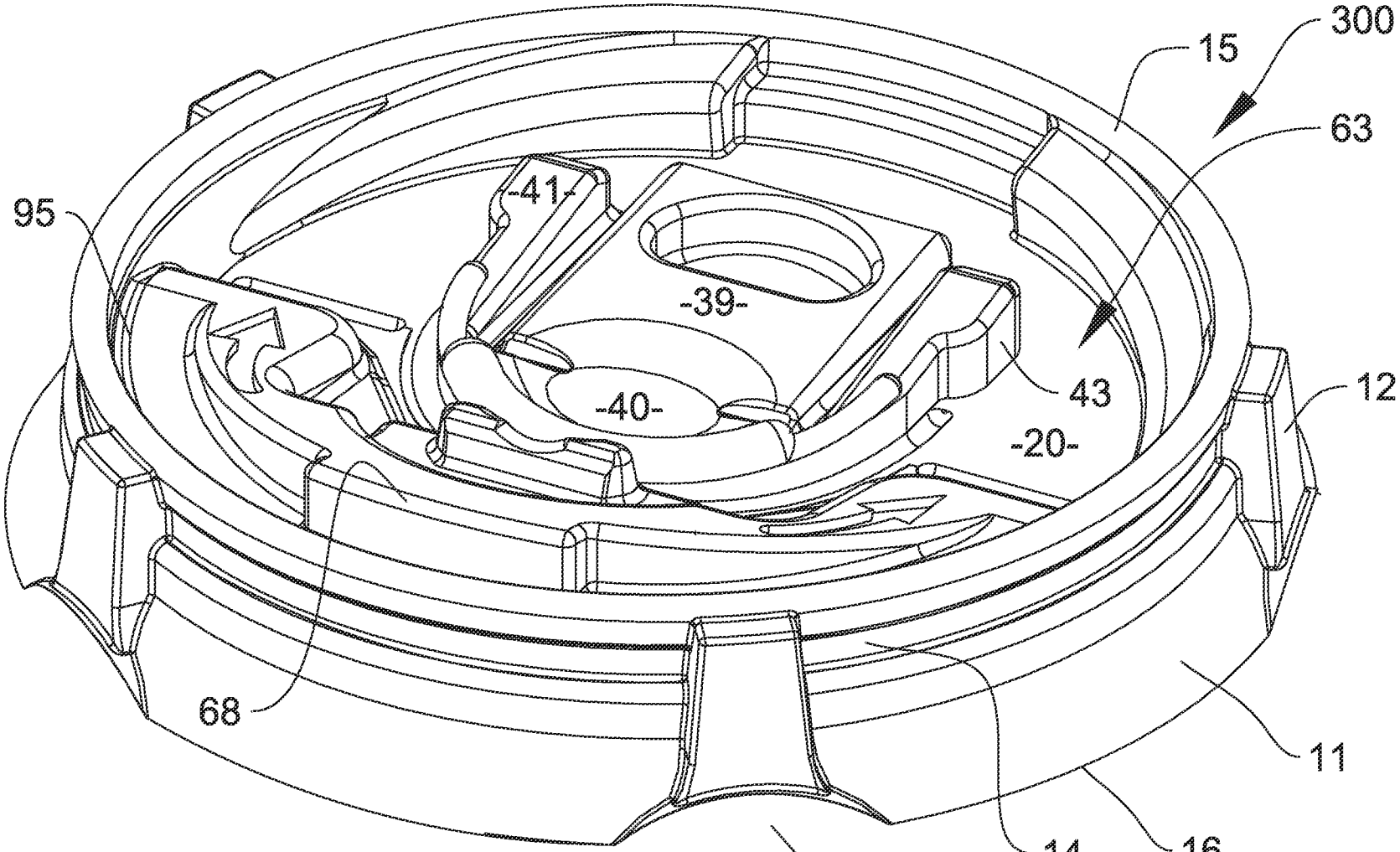
FIG. 20 is an enlarged top perspective view of the first re-closeable cap according to the present invention showing the cap swinging structure thereof in a fully retracted, can opening-covering state.
Figure 21:
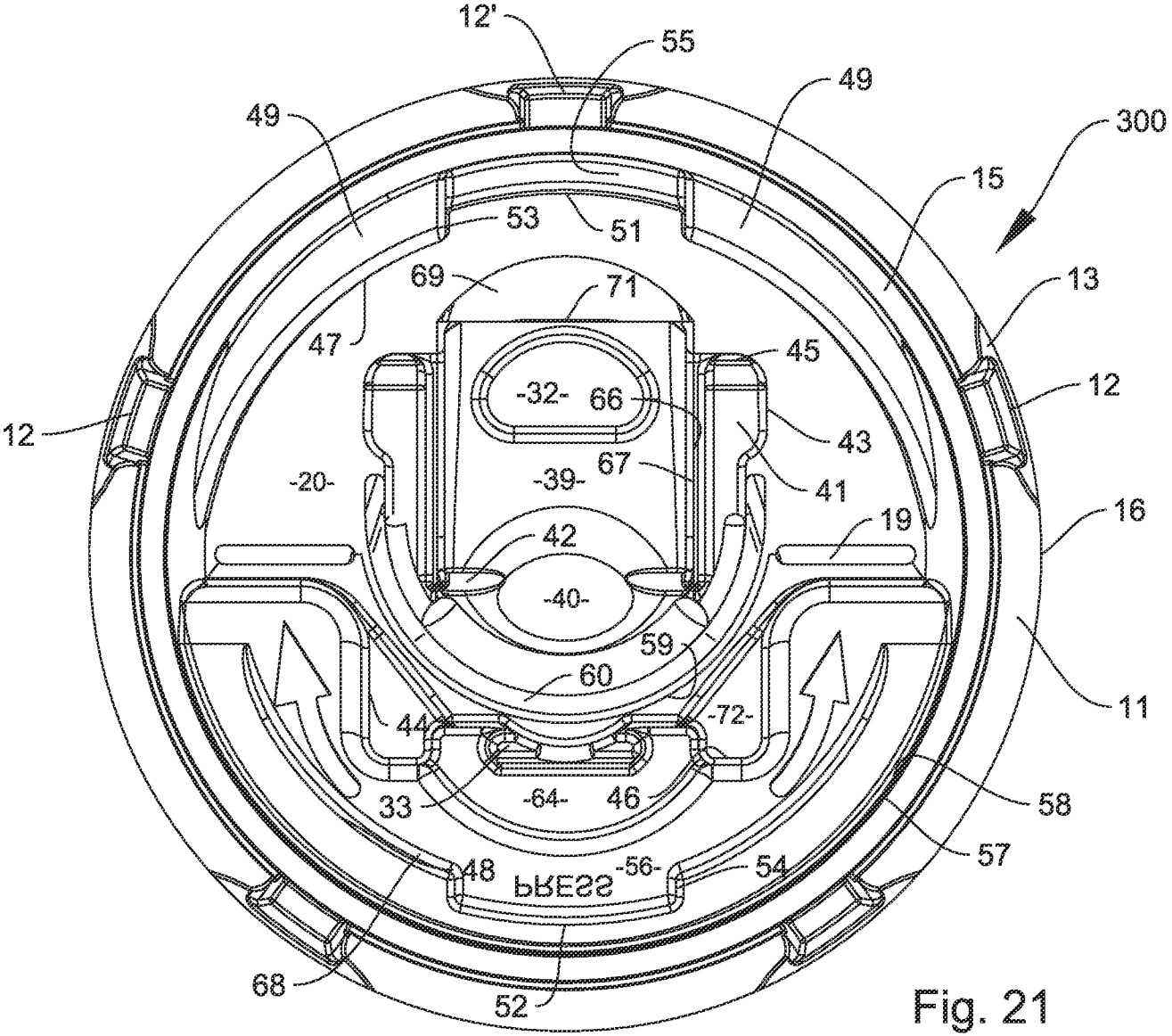
FIG. 21 is an enlarged top plan view of the first re-closeable cap according to the present invention showing the cap swinging structure thereof in a fully retracted, can opening-covering state.

The whole structure under the pressure from the back side 45 of the structural lever 41 leans forward and down, keeping flange 61 pressed against indention 6 of the can capping plate 7 and creates a seal in closed position when the re-closeable cap 300 is turned 180 degrees to the can opening covering configuration as generally depicted in FIGS. 19 and 19A. The lock-receiving protrusion 32 receives the lock 33 as generally depicted in FIGS. 10, 10A, 11, 17, 17A, 23, and 24. The interlocking action of multiple components by way of frictional engagement of numerously opposed surfaces provides significant stability and further eliminates gap or leakage points through which beverage may otherwise seep when in the rotatably closed position by turning the re-closeable cap 300 180 degrees from the reference point (shown in FIG. 17A) to the rotatable closed, can opening covering configuration generally depicted in FIGS. 19 and 19A.

The reader will note that the first dynamic structure exemplified by the cap swinging structure 21 overarches the second dynamic structure as exemplified by the swinging cover element 39 as well as a portion of the static structure 63 represented by flange 61 and a portion of the finger depression feature 40. The structure of flange 61 is a semi-dynamic structure, allowing the can opener element 5 to simultaneously move with the swinging cover element 39 by bending flexible material at the line between pivot points 42 and across the flange 61 structure. Thus, dynamically, it functions when the drinker uses the can opener element 5 to open the beverage can 10.

Because the tip 98 of the can opener element 5 extends beyond the center pivot point 2, it is difficult to provide a cap swinging structure 21 by just folding some structure toward the static structure 63 while at the same time retaining the ability to open the swinging cover element 39 while maintaining the structural integrity of cap plate. The resolution to the problem was to provide the perforation or cut line 95 that extends in a zig-zag like manner and extending the flange structure 61 past the pivot point 2 and totally or significantly overlapping the front end of can opener element 5 at or near the tip 98. These considerations provided the basis for the arch-like swinging action of the cap swinging structure.

The user can also close the re-closeable caps 300 and 200 by pushing one's fingertip into the fingertip depression 40. Referencing FIG. 11, the reader will there consider vector 77 depicting a fingertip force pushing the can opener-receiving protrusion 23 down toward or into the can opening 3 with the can opener element 5 underneath or underlying the can opener-receiving protrusion 23 as comparatively depicted in FIGS. 11 and 17A.

Figure 11:
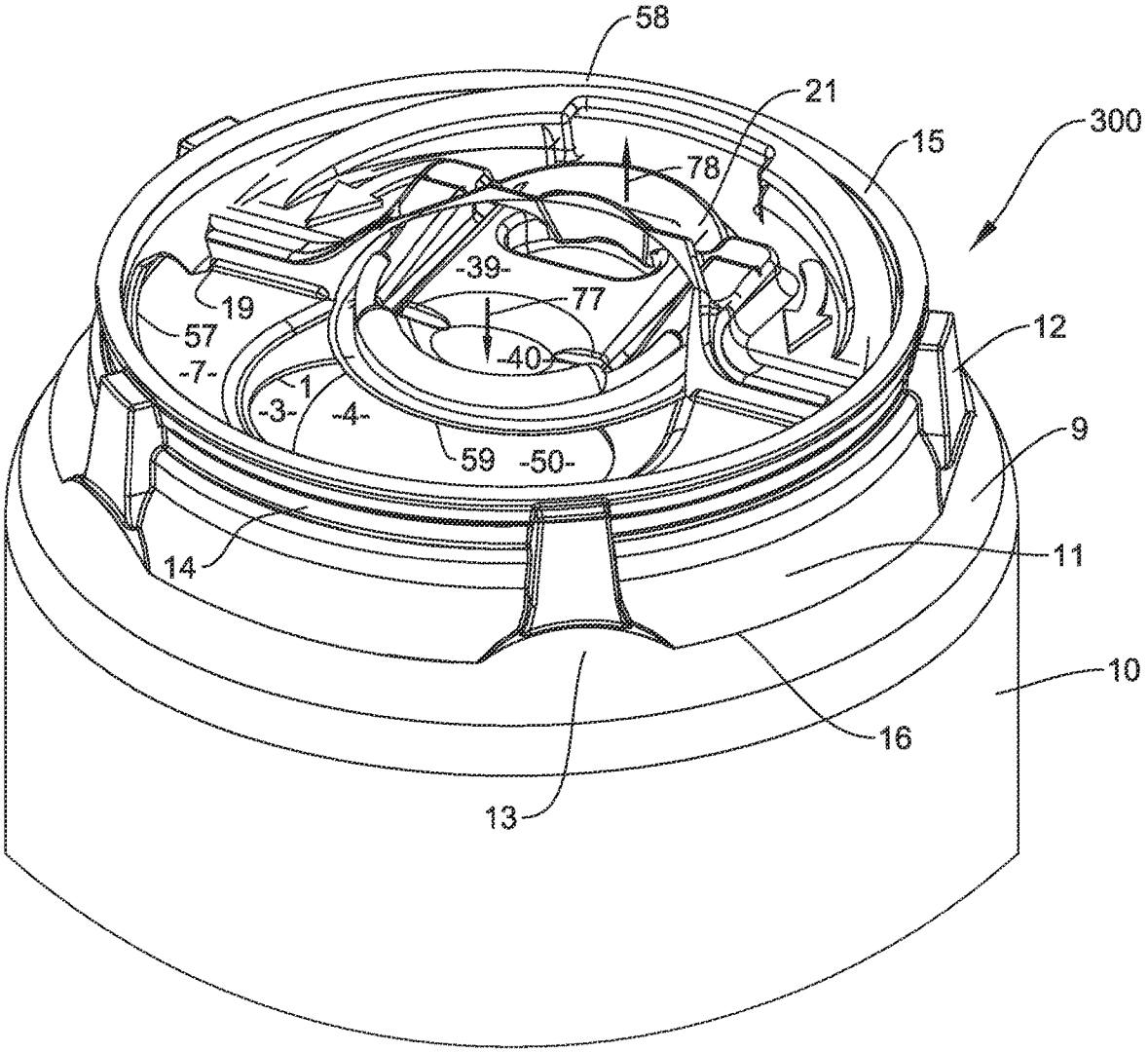
FIG. 11 is a top perspective view of a generic beverage can outfitted with the first re-closeable cap according to the present invention showing the cap swinging structure in a fully open state before a first state of swing retraction.
Figure 12A:
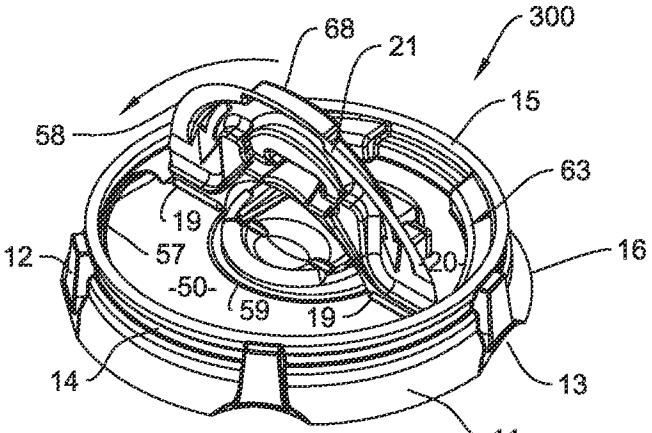
FIG. 12A is a second top perspective view of the first re-closeable cap according to the present invention showing the cap swinging structure in a second state of swing retraction.
Figure 12:
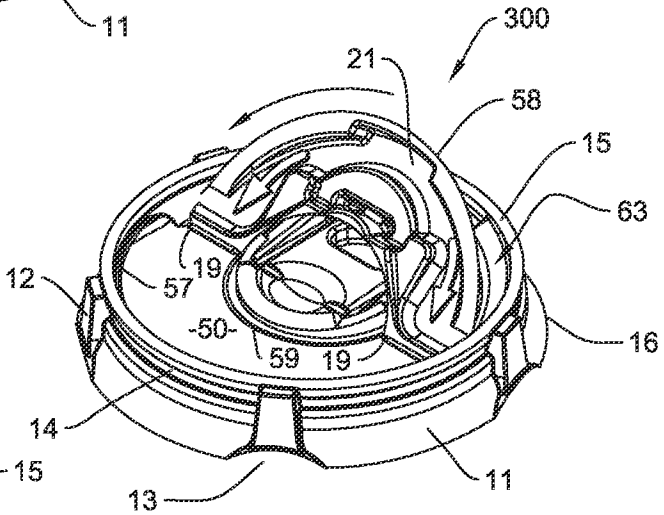
FIG. 12 is a first top perspective view of the first re-closeable cap according to the present invention showing the cap swinging structure in a first state of swing retraction.
Figure 13:
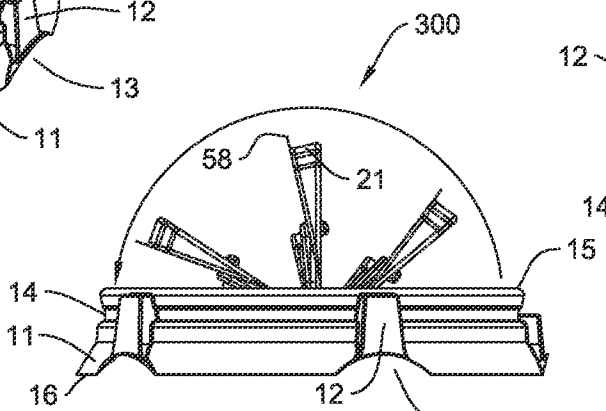
FIG. 13 is an edge view of the first re-closeable cap according to the present invention showing the cap swinging structure thereof in broken lining in the first, second, and third states of swing retraction.
Figure 12B:
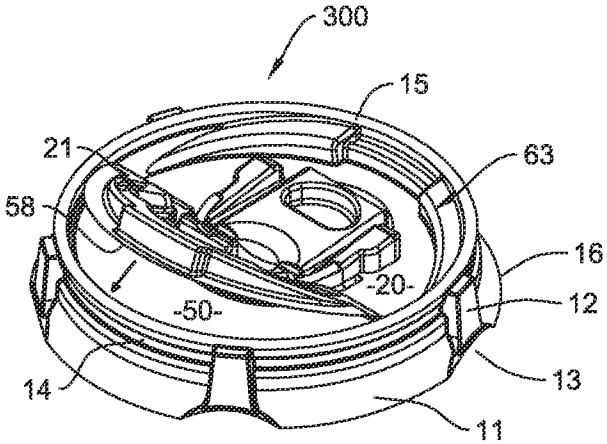
FIG. 12B is a third top perspective view of the first re-closeable cap according to the present invention showing the cap swinging structure in a third state of swing retraction.
Figure 14:
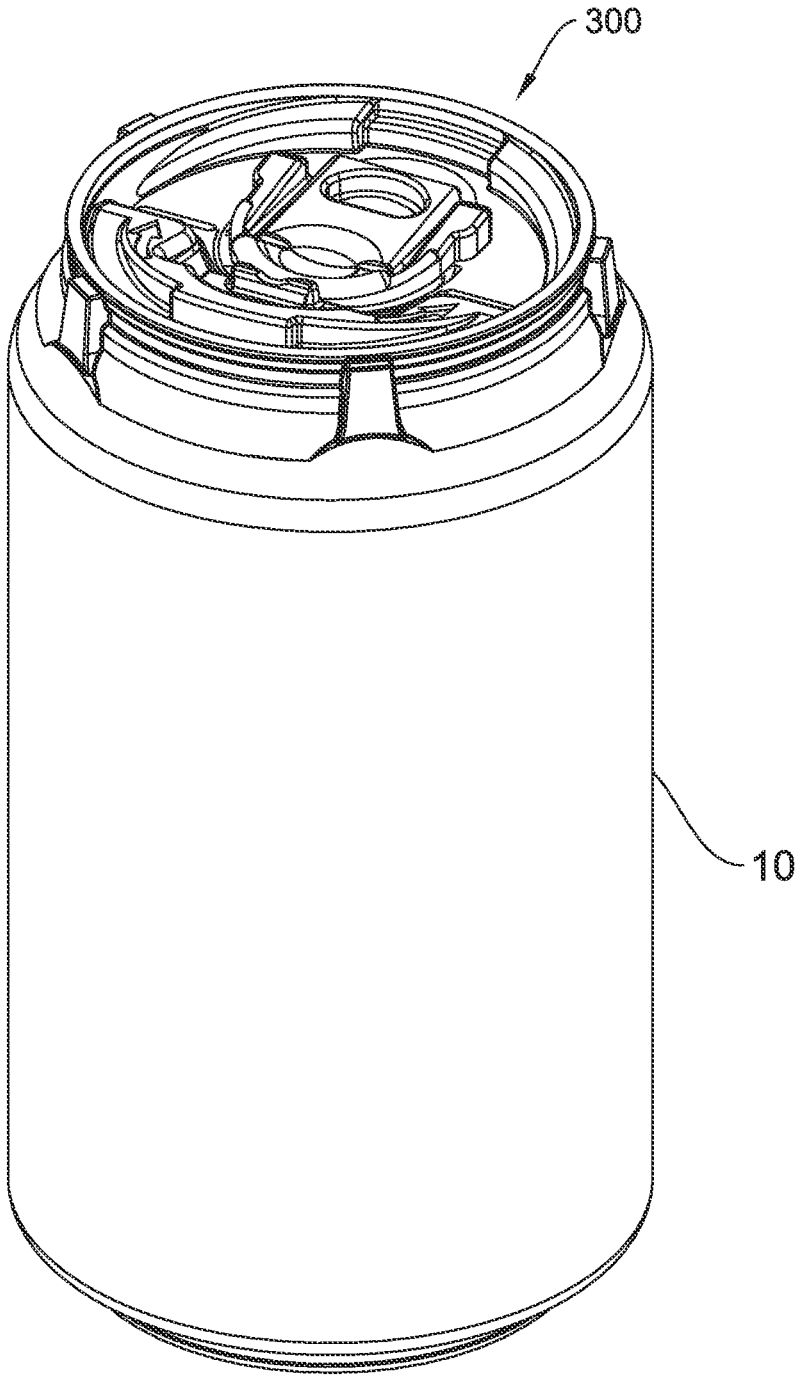
FIG. 14 is a top perspective view of a generic beverage can outfitted with the first re-closeable cap according to the present invention showing the cap swinging structure thereof in a fully retracted, can opening-covering state.
Figure 15:
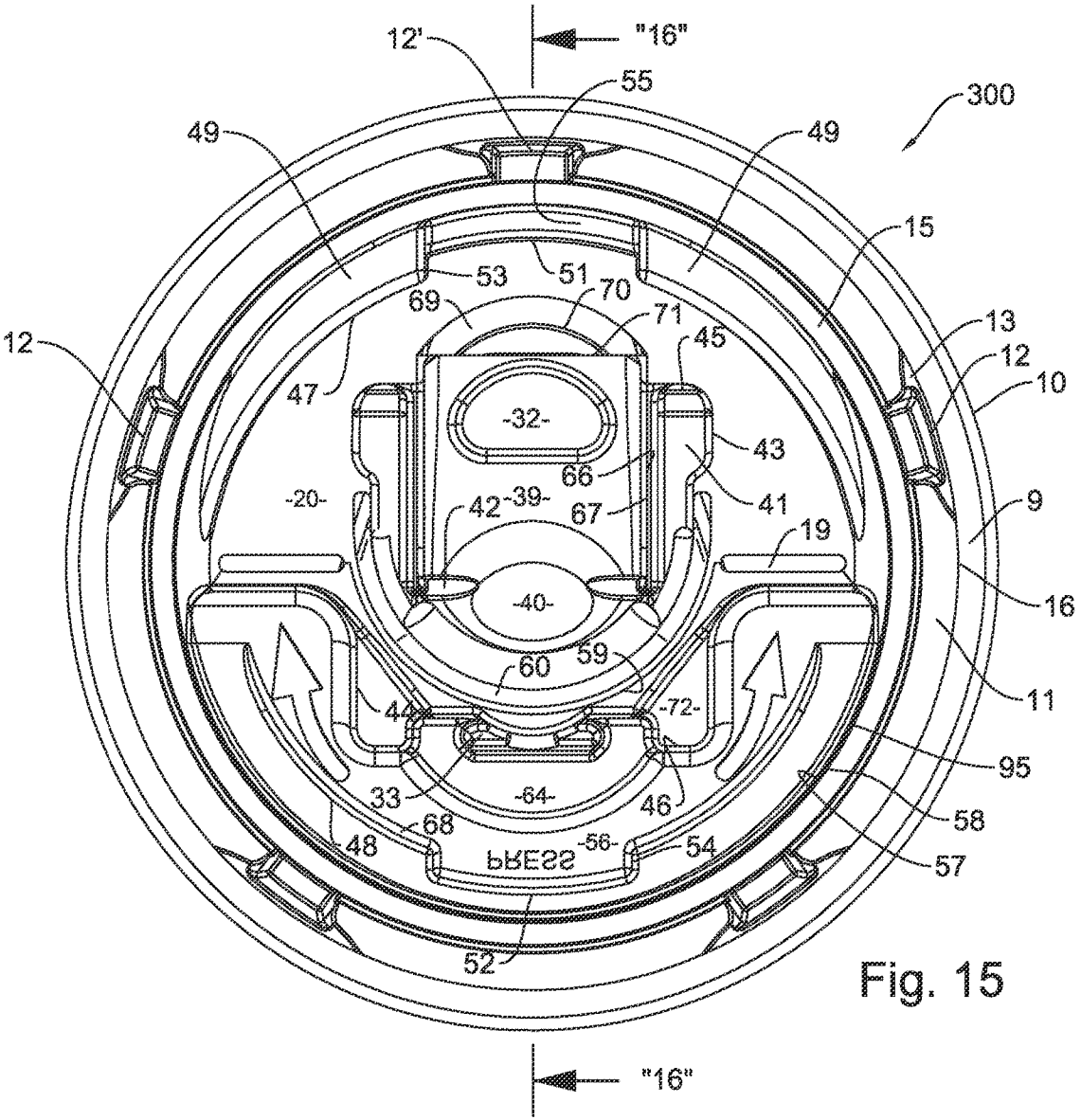
FIG. 15 is a top plan view of the first re-closeable cap according to the present invention as outfitted upon a generic beverage can showing the cap swinging structure thereof in a fully retracted, can opening-covering state.

At the same time, the opposite end of the can opener element 5, the can opener edge 70 is pushed up as at vector 78 in FIG. 11. The back sides 45 of levers 41 release pressure from the back wall 46 of the lever-receiving depression 72. With minimal force downwardly directed, the lock depression 55 of the locking structure 49 releases the key structure 56 of the cap swinging structure 21. The entire cap swinging structure 21 raises up under material internal resilience at the hinges 19 of the cap swinging structure 21 as generally depicted in FIG. 12.

Then user may then retract the cap swinging structure 21 back into or toward the cap opening 50 as generally depicted in FIGS. 12—16A. The reader will note that the back edge 57 of the cap opening 50 and the outer edge 58 of the cap swinging structure 21 are created as a result of cut made in the unibody material construction thereby forming a relatively tight fit and locking them together when the outer edge 58 is pressed past back edge 57. At the same time, the edge 59 of flange 61 meets the inner edge 60 of the cap swinging structure 21. Edges 59 and 60 are also formed as a result of a cut through the unibody material construction.

Referencing FIGS. 38-52, the reader will more particularly consider the third alternative re-closeable cap 200 according to the present invention. The dotted lines 95 depict a perforated line or cut lines for releasing the cap swinging structure 21 for dynamic movement intermediate the (locked) fully open or extended state or configuration, and the fully retracted state or configuration. The dotted lines 95 further define a perforation line or cut lines for releasing the swinging cover element 39.

The reader will note that the swinging structure hinges 19 and swinging cover hinges 42 are depicted at dots or points 19 and 42. In other words, the swinging structure hinges and swinging cover hinges of the third alternative re-closeable cap 200 are preferably pivot point. In the case of pivot points 19, a pivot point 19 remains after the perimeter of the cap swinging structure 21 defined by the anterior first dotted line 95 is cut or slit. The only spots or points not cut or slit are the pivot points 19 within the track of the first dotted line 95. Similarly, in the case of the swing cover element 39, the swinging cover hinges 42, the pivot points 42 are uncut points on the second or posterior perforation or cut line 95. The reader will note that the horizontal line between pivot points 42 is not cut or slit.

The reader will consider the tip or bend portion 81 adjacent the medial most pivot points 19 of the anterior or first cut line 95. The tip or bend portion 81 is intentionally formed as such in adjacency to the medial most pivot points 19 in order to create a novel "eccentric switch" effect as comparatively and figuratively depicted in FIGS. 46-48. The eccentric switch provided by tip or bend portion 81 allows the cap swinging structure 21 to be used as a "flip-flop" mechanism for maintaining a state of actuation by way of the inherent material resiliency of the material construction.

Referencing FIG. 46, it will be seen that the tip or bend portion 81 contacts the can capping plate 7 when being directed toward the fully open state or configuration at a first state of extension. At this state of extension, the pivot point 19 experiences a force as depicted at vector 87. With the tip or bend portion 81 in constant contact with the can capping plate 7, the cap swinging portion is further directed toward the fully open or extended state.

To enable further movement of the cap swinging portion 21 to the second state of extension, the static portion 63 is momentarily actuated as at 63' and a downward restorative force is created as at vectors 88. When further directed to the third state of extension, the cap swinging plate 21 with the tip or bend portion 81 still in contact with the can capping plate 7 again reaches a point where pivot point(s) 19 experience a force 87. The inherent resiliency of the material construction thereby helps maintain the cap swinging structure 21 in a state of extension at least at the first and third states of extension.

Comparatively referencing FIGS. 38 and 38A, it will be seen that FIG. 38A is a cross-sectional view as sectioned from FIG. 38 to depict a locking mechanism associated with the third alternative re-closeable cap 200. Reference numbers 57 and 58 in FIG. 38A depict opposing edges formed after the perforation or cut line is cut or slit. The gap between edges 57 and 58 is exaggerated in FIG. 38A to illustratively denote the separation. A more accurate rendering of the edge-to-edge separation point or configuration is depicted in FIG. 38D. In other words, the slit is depicted as a little space between edges 57 and 58, but in actuality there is no space when in the fully retracted position as otherwise shown in FIG. 38D. A similar description applies to the slit that forms the opposed edges 66 and 67 of the swinging cover element 39.

Referencing FIG. 38B through 38D, the reader will there further consider how the slit formed at line 95 enables locking/sealing functionality. The space 84 between the cap swing structure 21 and the can capping plate 7 provides enough travel distance for the cap swinging structure 21 and the outer edge 58 to be pressed as at vector 83 to snap past the static edge 57 and under restorative forces of the inherent material resiliency, the cap swinging structure 21 moves back to modified original position forming a "frictional seal/lock" where the edges 57 and 58 opposite the same slit 95 touch at the cutting point forming a "frictional seal/lock" that prevents liquid leakage.

Referencing FIGS. 40 and 40A, the reader will there consider the relative positions of edges 59 and 60 and pivot points of hinges 19 and the tip or bend portion 81 when the cap swinging portion 21 is a locked, fully open or extended state. It will be recalled that when the user retracts the cap swinging structure 21 back into or toward the cap opening 50, the back edge 57 of the cap opening 50 and the outer edge 58 of the cap swinging structure 21 form a relatively tight fit, locking them together when the outer edge 58 is pressed past back edge 57. At the same time, the edge 59 of flange 61 meets the inner edge 60 of the cap swinging structure 21. Edges 59 and 60 are also formed as a result of a cut through the unibody material construction. FIG. 40A depicts a double mated engagement of the cap swinging structure 21 and the lock mechanism 55 whereby tip or edge 68 fits into recess 99 and tip or edge 101 fits into groove 82.

Referencing FIGS. 49 through 49D, the reader will there consider an optional locking mechanism for the flip-flop cap swinging structure 21, the concepts of which may further extend to the swinging cover element 39. The primary concept being illustrated to provide a locking mechanism whereby the static edge 57 of the slit 95 is directed into overlapped relation with the opposed dynamic edge 58 of slit 95 for forming a tight seal at the overlap site. This is achieved by providing a rim wall-engaging protrusion as at 97 adjacent the target overlap site. The rim wall-engaging protrusion 97 presses against the inner can rim wall 18 of can rim 8 when the re-closeable caps are outfitted upon the upper can rim 8 thereby forcing as at 96 the side wall 22 of cap depression radially inwardly causing edges 57 and 58 to overlap as generally depicted in FIGS. 49C and 49D.

Referencing FIGS. 50-51A, the reader will there consider certain additional considerations directed to the re-closeable cap 200 operable in connection with a beverage can 10 and particularly the tip 98 of the can opener element 5. Referencing the opposed edges 59 and 60 formed by cutting or slicing the cut line 95. The can opener tip 98 may preferably serve or provide a support platform where the edges 59 and 60 meet when the cap swinging portion is in a fully retracted configuration a generally depicted in FIG. 51.

Referencing FIG. 51B, it will be seen that the can opener tip 98 supports the cap swinging structure 21 such that the edges 59 and 69 are tightly aligned for forming a better seal as enabled by the tip 98 support. The reader will further note that a further function of the can opener tip 98 is to help direct upwardly the flip-flop structure 21 when it is in a fully retracted state by pressing on the opposite side of opener 5 pivotable about turning center 2 serving as a fulcrum. The rocker pivot point raises tip 98 pushing the edge 60 of the cap swinging structure and as result the cap swinging structure 21 pops up at slit 95 allowing for an easier grip of the flip-flop, cap swinging structure 21.

The second alternative re-closeable cap 100 is presented in the illustrative support primarily to highlight the undercut features 74 as generally depicted and referenced in FIGS. 32-34 and to demonstrate a number of ways to outfit the re-closeable caps 300, 100, and 200. Referencing FIGS. 35-37 the reader will there consider the second alternative re-closeable cap 100 according to the present invention with cap-marking indicia for labeling re-closeable caps from top to bottom as 1 cap—2 cap—3 cap; A cap—B cap—C cap; and 5-point star cap—4-point star cap—7-point star cap. It is contemplated that the exemplary packaging arrangements 301 and 201 may provide a series of re-closeable caps outfitted with cap-marking indicia for individually labeling re-closeable caps so that consumers may more properly identify outfitted beverage cans as belonging to individual users by way of the cap-marking indicia.

While the above descriptions contain much specificity, this specificity should not be construed as limitations on the scope of the invention, but rather as an exemplification of the invention. In certain embodiments, the basic invention may be said to essentially teach or disclose a re-closeable can cap as variously exemplified for outfitting a beverage can for with a view toward improving or adding hygienic protections to beverage cans coming from manufacturers and packaging companies throughout the distribution channels terminating at the user consumption point. The re-closeable caps according to the present invention outfit an upper can portion of the beverage can primarily for providing means for selectively covering and uncovering a can opening so as to provide a readily available barrier atop the upper can portion.

The re-closeable caps according to the present invention may thus be said to essentially outfit a beverage can enabling a user to selectively cover an upper can portion of the beverage can having a can rim and a can capping plate. The re-closeable caps preferably and essential comprise a unibody material construction particularly configured to comprise a cap rim and a cap plate centrally located relative to the cap rim. The cap rim receives the can rim thereby attaching the re-closeable cap to the upper can portion.

The cap plate comprises a static structure and a first dynamic structure as exemplified by the cap swinging structure 21 pivotally attached to the static structure as at 63. The first dynamic structure is pivotal for selectively providing a can-opening access aperture as extended from portions of the static structure and selectively closing the can-opening access aperture as retracted back to a can opening covering configuration. The can-opening access aperture enables a user to consume can contents by way of an underlying can opening formed in the can capping plate.

The re-closeable caps are all preferably formed with a select material construction in a unibody form having an inherent material resiliency. Noting that the upper can portion is typically constructed from a relatively rigid material, it will be further noted that the can material construction may thus operate to actuate select portions of the re-closeable cap by way of its inherent material resiliency when outfitted upon the upper can portion for enhancing functionality of the re-closeable cap as outfitted upon the upper can portion.

In this regard, the first dynamic structure may preferably comprise an eccentric switch mechanism configured for maintaining the first dynamic structure in at least the first and second states of pivotal extension. In this regard, the static structure may be resiliently actuated by cooperative action of the switch mechanism to position the first dynamic structure in at least the first and second states of pivotal extension and the inherent resilience maintains the first dynamic structure in at least the first and second states of pivotal extension when outside forces are absent.

Further, it will be recalled that select portions of the first dynamic structure may resiliently overlap with select portions of the static structure when outfitted upon the upper can portion for enhancing functionality of the re-closeable cap. In this regard, an exemplary a rim wall-engaging protrusion formed opposite the first dynamic structure may provide a structural aid to direct edging of the first dynamic structure into overlapped relation with edging of the static structure for enhancing a can opening covering configuration by forming a seal at the overlap site of the opposed edging.

The first dynamic structure is preferably configured to mate with the static structure for maintaining the re-closeable cap in a can-opening access configuration. More particularly, the first dynamic structure is configured to simultaneously mate with the static structure by way of multiply spaced mate features as exemplified by the complex landscape of the cap surfacing as described in detail hereinabove. When the first dynamic structure clamshell closes into engagement with the static structure, multiple surfaces, spaced from one another, frictionally engage with one another. Thus, the multiply spaced mate features enhance mated engagement of the first dynamic structure with the static structure.

The re-closeable caps may further preferably comprise a second dynamic structure as exemplified by the swinging cover element 39. The second dynamic structure at least partially covers the can opener element/assembly of the upper can portion and is pivotal in a direction opposite that of the first dynamic structure for enabling the user to form the can opening in the can capping plate by moving in unison with the can opener element. The static structure may preferably comprise a can opener access window as described in connection with cap 300, which can opener access window enhances a user's ability to access the can opener element.

Preferably, the second dynamic structure is configured to mate with the can opener element for enhancing movement therewith in unison. Noting that the first dynamic structure mates with the complex upper surfacing of the cap, it follows that the first dynamic structure is further preferably configured to mate with the second dynamic structure for maintaining the re-closeable cap in a can-opening access configuration.

The re-closeable caps according to the present invention may further preferably comprise a cap rim groove matable with a can rim groove situated in inferior adjacency to the can rim as is relatively standard in the industry. The matable cap and can rim grooves enhance cap-to-can attachment. To further enhance the cap-to-can attachment hold, the cap rim may further comprise at least one undercut formation. As described hereinabove, the undercut formation(s) are configured for securing the cap rim groove in mated engagement with the can rim groove.

The re-closeable cap exemplified by cap 200 comprises a first dynamic structure and a static structure whereby opposed edging situated in superior adjacency to a tip portion of the can opener element. The tip portion of the can opener element operates to structurally support the opposed edging for enhancing a sealed interface at the opposed edging. The re-closeable caps according to the present invention may further preferably comprise a finger depression feature. The finger depression feature overlaps the first and second dynamic structures for enabling the user to depress the same and selectively actuate either of the first and second dynamic structures to initiate further movement thereof.

In the primary case of the cap 300, the re-closeable cap is rotatably outfitted upon the upper can portion for enabling the use to selectively cover the can opening with at least the static structure. As has been shown, this embodiment may preferably comprise at least one turning nub formed in adjacency to the cap rim for enhancing the user's ability to rotate the re-closeable cap relative to the upper can portion when outfitted thereupon. Further, at least one cap-removing grip formation is provided in connection with this embodiment and formed in alignment with the at least one turning nub for enhancing the user's ability to remove the re-closeable cap from the upper can portion.

The re-closeable cap 300 further preferably comprises a lower cap skirt that seats down upon a neck portion 9 of the upper can portion. It will be seen from a consideration of the illustrative matter submitted in support of these specifications that the neck portion extends obliquely relative to the can capping plate and that the lower cap skirt extends obliquely relative to the cap plate, the lower cap skirt paralleling the neck portion.

Noting that the neck portion comprises an upper neck portion and a lower neck portion, and that the lower cap skirt comprises a skirt edge, the skirt edge particularly terminates intermediate the upper and lower neck portions for enhancing safe use of the re-closeable cap during cap rotation relative to the upper can portion. In contrast to cap 300, cap 200 is designed for relatively permanent, non-rotatable attachment to the upper can portion and thus is preferably devoid of turning nubs, grip formations, and skirt features of this type. Recalling that the author determined improved marketability of a cap that mimics current or state of the art can mechanisms, the preferred cap 200 provides a preferred flip-flop mechanism that mimics state of the art can opener elements 5 and rendering rotatability of caps a secondary concern.

The re-closeable caps according to the present invention may all be preferably provided in series within a web form as at 90 for simultaneously outfitting a plurality of upper can portions of beverage cans by way of a multi-pack packaging arrangement as exemplified by arrangements 201 and 301. As has been discussed, cap 200 is designed for relatively permanent attachment to the upper can portions at the time of manufacture or packaging through contents consumption with a view toward further entering the recycling system in view of the fact that beverage cans are among the most recycled items in the system. The caps may further preferably comprise cap-marking indicia for individually labeling re-closeable caps as provided in series within the web form for enabling multiple consumers to properly identify outfitted beverage cans as belonging to individual consumers at the time of consumption.

What is claimed is:

1. A re-closeable cap for outfitting a beverage can enabling a user to selectively cover an upper can portion of the beverage can, the upper can portion comprising a can rim and a can capping plate, the re-closeable cap comprising:

a unibody material construction, the unibody material construction being configured to comprise a cap rim and a cap plate centrally located relative to the cap rim, the cap rim for receiving the can rim and attaching the re-closeable cap to the upper can portion, the cap plate comprising a static structure, a first dynamic structure pivotally attached to the static structure, and a second dynamic structure;

the first dynamic structure being pivotal for selectively providing a can-opening access aperture and selectively closing the can-opening access aperture, the can-opening access aperture for enabling a user to consume can contents by way of a can opening formed in the can capping plate, the second dynamic structure for at least partially covering a can opener element of the upper can portion and being pivotal for enabling the user to form the can opening in the can capping plate by moving in unison with the can opener element.

2. The re-closeable cap of claim 1 wherein the unibody material construction comprises an inherent material resiliency, the upper can portion for actuating select portions of the re-closeable cap by way of the inherent material resiliency when outfitted thereupon for enhancing functionality of the re-closeable cap as outfitted upon the upper can portion.

3. The re-closeable cap of claim 2 wherein the first dynamic structure is configured to mate with the static structure for maintaining the re-closeable cap in a can-opening access configuration.

4. The re-closeable cap of claim 3 wherein the first dynamic structure is configured to simultaneously mate with the static structure by way of multiply spaced mate features, the multiply spaced mate features for enhancing mated engagement of the first dynamic structure with the static structure.

5. The re-closeable cap of claim 3 wherein the first dynamic structure is configured to lock with the static structure by way of a locking mechanism for maintaining the re-closeable cap in a can-opening access configuration.

6. The re-closeable cap of claim 2 wherein select portions of the first dynamic structure resiliently overlap with select portions of the static structure when outfitted upon the upper can portion for enhancing functionality of the re-closeable cap.

7. The re-closeable cap of claim 6 wherein the cap rim comprises a rim wall-engaging protrusion opposite the first dynamic structure, the rim wall-engaging protrusion for directing edging of the first dynamic structure into overlapped relation with edging of the static structure for enhancing a can opening covering configuration.

8. The re-closeable cap of claim 1 wherein the static structure comprises a can opener access window, the can opener access window for enhancing a user's ability to access the can opener element.

9. The re-closeable cap of claim 1 wherein the second dynamic structure is configured to mate with the can opener element for enhancing movement therewith in unison.

10. The re-closeable cap of claim 1 wherein the first dynamic structure is configured to mate with the second dynamic structure for maintaining the re-closeable cap in a can-opening access configuration.

11. The re-closeable cap of claim 1 wherein the first dynamic structure comprises an eccentric switch mechanism, the eccentric switch mechanism being configured for maintaining the first dynamic structure in at least first and second states of pivotal extension.

12. The re-closeable cap of claim 11 wherein the eccentric switch mechanism, in cooperation with an inherent material resiliency thereof, is configured to maintain the first dynamic structure in at least first and second states of pivotal extension.

13. The re-closeable cap of claim 1 wherein the cap rim comprises a cap rim groove matable with a can rim groove, the matable cap and can rim grooves for enhancing cap-to-can attachment.

14. The re-closeable cap of claim 13 wherein the cap rim comprises at least one undercut formation, the at least undercut formation being configured for securing the cap rim groove in mated engagement with the can rim groove.

15. The re-closeable cap of claim 1 wherein the first dynamic structure and the static structure comprise opposed edging situated in superior adjacency to the can opener element, a portion of the can opener element for structurally supporting the opposed edging for enhancing a sealed interface at the opposed edging.

16. The re-closeable cap of claim 1 comprising a finger depression feature, the finger depression feature overlapping the first and second dynamic structures for enabling the user to depress the same and selectively actuate the first and second dynamic structures.

17. The re-closeable cap of claim 1 wherein the re-closeable cap is rotatably outfitted upon the upper can portion for enabling the use to selectively cover the can opening with at least the static structure.

18. The re-closeable cap of claim 17 comprising at least one turning nub formed in adjacency to the cap rim, the at least one turning nub for enhancing the user's ability to rotate the re-closeable cap relative to the upper can portion when outfitted thereupon.

19. The re-closeable cap of claim 18 comprising at least one cap-removing grip formation, the at least one cap-removing grip formation for enhancing the user's ability to remove the re-closeable cap from the upper can portion.

20. The re-closeable cap of claim 19 wherein the at least one cap-removing grip formation is formed in alignment with the at least one turning nub.

21. The re-closeable cap of claim 17 comprising a lower cap skirt, the lower cap skirt for seating down upon a neck portion of the upper can portion.

22. The re-closeable cap of claim 21 wherein the neck portion extends obliquely relative to the can capping plate and the lower cap skirt extends obliquely relative to the cap plate, the lower cap skirt paralleling the neck portion.

23. The re-closeable cap of claim 22 wherein the neck portion comprises an upper neck portion and a lower neck portion, the lower cap skirt comprising a skirt edge, the skirt edge terminating intermediate the upper and lower neck portions for enhancing safe use of the re-closeable cap during cap rotation relative to the upper can portion.

24. The re-closeable cap of claim 1 being provided in series within a web form for simultaneously outfitting a plurality of upper can portions by way of a multi-pack packaging arrangement.

25. The re-closeable cap of claim 24 comprising cap-marking indicia for individually labeling re-closeable caps as provided in series within the web form for enabling multiple consumers to properly identify outfitted beverage cans as belonging to individual consumers.

26. A re-closeable cap for a beverage can comprising:

a unibody material construction, the unibody material construction being configured to comprise a cap rim and a cap plate centrally located relative to the cap rim, the cap rim for attaching the re-closeable cap to the can rim, the cap plate comprising a static portion and first and second dynamic portions, the first dynamic portion comprising an eccentric switch mechanism, the eccentric switch mechanism being configured for maintaining the first dynamic portion in at least first and second states of pivotal extension, the first and second dynamic portions being pivotal relative to the static portion for providing a can-opening access aperture and closing the can-opening access aperture.

27. The re-closeable cap of claim 26 wherein the first and second dynamic portions pivot in opposite directions from respective fully retracted states to fully extended states.

28. The re-closeable cap of claim 27 wherein the first and second dynamic portions are matable with one another when the first dynamic portion is in a fully extended state.

29. The re-closeable cap of claim 26 wherein the eccentric switch mechanism, in cooperation with an inherent material resiliency thereof, is configured to maintain the first dynamic portion in at least first and second states of pivotal extension.

30. A re-closeable cap comprising:

a unibody material construction, the unibody material construction being configured to comprise a cap rim and a cap plate, the cap rim for attaching the re-closeable cap to a can rim, the cap plate comprising a static structure, a first dynamic structure, and a second dynamic structure;

the first dynamic structure comprising an eccentric switch mechanism, the eccentric switch mechanism being configured for maintaining the first dynamic structure in at least first and second states of pivotal extension, the first dynamic structure being pivotally matable with the static structure for selectively providing a can-opening access aperture and selectively closing the can-opening access aperture;

the second dynamic structure for at least partially covering a can opener element and being pivotal for enabling the user to form the can opening in the can capping plate by moving in unison with the can opener element.

31. The re-closeable cap of claim 30 wherein the eccentric switch mechanism, in cooperation with an inherent material resiliency thereof, is configured to maintain the first dynamic structure in at least first and second states of pivotal extension.

32. A re-closeable cap for outfitting a beverage can enabling a user to selectively cover an upper can portion of the beverage can, the upper can portion comprising a can rim and a can capping plate recessed relative to the can rim, the re-closeable cap comprising:

a unibody material construction, the unibody material construction being configured to comprise a cap rim and a cap plate recessed and centrally located relative to the cap rim, the cap rim for receiving the can rim and attaching the re-closeable cap to the upper can portion such that the cap rim and cap plate mimic the can rim and can capping plate, the cap plate comprising a static structure, a first dynamic structure pivotally attached to the static structure, and a second dynamic structure;

the first dynamic structure being pivotal for selectively providing a can-opening access aperture and selectively closing the can-opening access aperture, the can-opening access aperture for enabling a user to consume can contents by way of a can opening formed in the can capping plate, the second dynamic structure for at least partially covering a can opener element of the upper can portion and being pivotal for enabling the user to form the can opening in the can capping plate by moving in unison with the can opener element.

33. The re-closeable cap of claim 32 wherein the first dynamic structure comprising an eccentric switch mechanism, the eccentric switch mechanism being configured for maintaining the first dynamic structure in at least first and second states of pivotal extension.

34. The re-closeable cap of claim 33 wherein the eccentric switch mechanism, in cooperation with an inherent material resiliency thereof, is configured to maintain the first dynamic structure in at least first and second states of pivotal extension.

* * * * *